US012078433B2

(12) United States Patent
Hosono et al.

(10) Patent No.: US 12,078,433 B2
(45) Date of Patent: Sep. 3, 2024

(54) HEAT EXCHANGER

(71) Applicant: DENSO CORPORATION, Kariya (JP)

(72) Inventors: Takefumi Hosono, Kariya (JP); Kimio Kohara, Kariya (JP)

(73) Assignee: DENSO CORPORATION, Kariya (JP)

( * ) Notice: Subject to any disclaimer, the term of this patent is extended or adjusted under 35 U.S.C. 154(b) by 423 days.

(21) Appl. No.: 17/578,922

(22) Filed: Jan. 19, 2022

(65) Prior Publication Data

US 2022/0136785 A1 May 5, 2022

Related U.S. Application Data

(63) Continuation of application No. PCT/JP2020/025345, filed on Jun. 26, 2020.

(30) Foreign Application Priority Data

Jul. 23, 2019 (JP) ..... 2019-135405
Dec. 19, 2019 (JP) ..... 2019-229631

(51) Int. Cl.
*F28F 3/08* (2006.01)
*F25B 41/30* (2021.01)

(52) U.S. Cl.
CPC ..... *F28F 3/086* (2013.01); *F25B 41/30* (2021.01); *F25B 2400/21* (2013.01)

(58) Field of Classification Search
CPC .... F28F 3/086; F28F 1/126; F28F 9/26; F28F 2009/0287; F28F 17/005; F25B 41/30; F25B 2400/21; F25B 40/02; F25B 40/06; F25B 39/00; F25B 39/022; F25B 47/00; F28D 2021/007; F28D 2021/0071; F28D 1/0333; F28D 9/00
See application file for complete search history.

(56) References Cited

U.S. PATENT DOCUMENTS

2010/0155028 A1* 6/2010 Lemee ..... F25B 40/00 165/104.21
2017/0097179 A1* 4/2017 Martin ..... F25B 39/00

FOREIGN PATENT DOCUMENTS

CN 105074375 A * 11/2015 ..... F28D 9/006
JP 2006329511 A * 12/2006 ..... F28D 1/05366
JP 2018066536 A * 4/2018 ..... F25B 39/00

(Continued)

*Primary Examiner* — Emmanuel E Duke
(74) *Attorney, Agent, or Firm* — Harness, Dickey & Pierce, P.L.C.

(57) ABSTRACT

A heat releasing unit includes heat releasing constituents which are stacked and are joined together while heat releasing flow passages are formed in the heat releasing constituents, respectively. An evaporating unit includes evaporating constituents which are stacked and are joined together, while evaporating flow passages are formed in the evaporating constituents, respectively. The evaporating unit and the heat releasing unit are arranged one after another in a direction along a side plate portion. A heat releasing unit outlet is formed at an outlet-side heat releasing constituent that is one of the heat releasing constituents placed at an end thereof. An evaporating unit inlet is formed at an inlet-side evaporating constituent that is one of the evaporating constituents placed at an end thereof. All of the heat releasing flow passages are connected to the evaporating flow passages through the heat releasing unit outlet and the evaporating unit inlet.

12 Claims, 54 Drawing Sheets

(56) References Cited

FOREIGN PATENT DOCUMENTS

| | | | | | |
|---|---|---|---|---|---|
| JP | 2018197613 | A | * | 12/2018 | |
| JP | 2018536133 | A | * | 12/2018 | |
| JP | 2021018051 | A | | 2/2021 | |
| JP | 2021018052 | A | | 2/2021 | |
| KR | 20160147342 | A | * | 12/2016 | ..... B60H 1/3227 |
| WO | WO-2018235765 | A1 | * | 12/2018 | ..... B60H 1/00 |

* cited by examiner

HEAT EXCHANGER

CROSS REFERENCE TO RELATED APPLICATIONS

This application is a continuation application of International Patent Application No. PCT/JP2020/025345 filed on Jun. 26, 2020, which designated the U.S. and claims the benefit of priority from Japanese Patent Application No. 2019-135405 filed on Jul. 23, 2019 and Japanese Patent Application No. 2019-229631 filed on Dec. 19, 2019. The entire disclosures of all of the above applications are incorporated herein by reference.

TECHNICAL FIELD

The present disclosure relates to a heat exchanger configured to conduct refrigerant through the heat exchanger.

BACKGROUND

As this type of heat exchanger, there has been previously proposed a flow passage unit. The flow passage unit forms a portion of a refrigeration cycle circuit in which the refrigerant is circulated.

The flow passage unit is formed by a pair of plate members that are joined together. The flow passage unit includes a refrigerant flow passage for conducting the refrigerant at an inside of the flow passage unit. The refrigerant flow passage of the flow passage unit includes: a condensing flow passage that releases heat from the refrigerant to condense the refrigerant; a pressure reducing flow passage that depressurizes the refrigerant outputted from the condensing flow passage; and an evaporating flow passage that evaporates the refrigerant which is depressurized at the pressure reducing flow passage.

The flow passage unit is one of a plurality of flow passage units that are stacked in a thickness direction thereof. The stacked flow passage units form a heat exchanger as a whole. The flow passage units of the heat exchanger form a plurality of refrigerant flow passages which are arranged in parallel in the refrigeration cycle circuit.

As described above, in the heat exchanger, the refrigerant flow passages are arranged in parallel in the refrigeration cycle circuit. Therefore, when the number of the flow passage units stacked one after another is increased, the number of parallel refrigerant flow passages, which include the condensing flow passages (in other words, heat releasing flow passages), the pressure reducing flow passages and the evaporating flow passages, is increased. A cooling capacity or a heating capacity of an air conditioning apparatus, which includes the heat exchanger including the flow passage units, is determined by the number of the flow passage units stacked one after another. The cooling capacity or the heating capacity of the air conditioning apparatus can be increased by increasing the number of the stacked flow passage units.

SUMMARY

This section provides a general summary of the disclosure, and is not a comprehensive disclosure of its full scope or all of its features.

According to the present disclosure, there is provided a heat exchanger configured to conduct refrigerant through the heat exchanger. The heat exchanger includes a side plate portion, a heat releasing unit and an evaporating unit. The evaporating unit and the heat releasing unit are arranged one after another in a direction along the side plate portion. In the heat releasing unit, a heat releasing unit outlet is formed at an outlet-side heat releasing constituent that is one of a plurality of heat releasing constituents placed at an end of the plurality of heat releasing constituents. In the evaporating unit, an evaporating unit inlet is formed at an inlet-side evaporating constituent that is one of a plurality of evaporating constituents placed at an end of the plurality of evaporating constituents. All of a plurality of heat releasing flow passages, which are respectively formed in the plurality of heat releasing constituents, are connected to a plurality of evaporating flow passages, which are respectively formed in the plurality of evaporating constituents, through the heat releasing unit outlet and the evaporating unit inlet.

DETAILED DESCRIPTION

Figure 1:
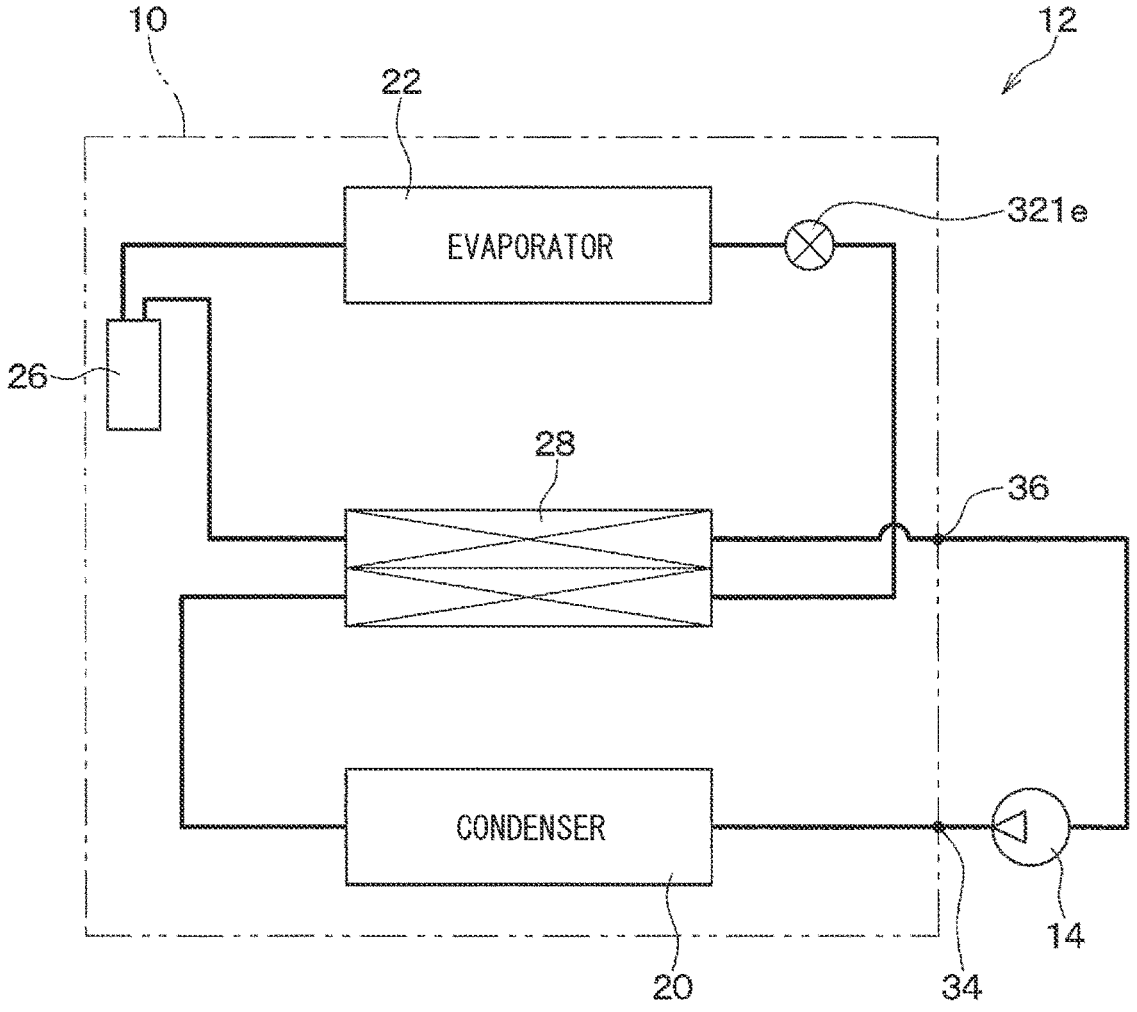
FIG. 1 is a refrigerant circuit diagram showing a refrigeration cycle circuit having a heat exchanger of a first embodiment.

As a heat exchanger, for example, there has been previously proposed a flow passage unit. The flow passage unit forms a portion of a refrigeration cycle circuit in which the refrigerant is circulated.

The flow passage unit is formed by a pair of plate members that are joined together. The flow passage unit includes a refrigerant flow passage for conducting the refrigerant at an inside of the flow passage unit. The refrigerant flow passage of the flow passage unit includes: a condensing flow passage that releases heat from the refrigerant to condense the refrigerant; a pressure reducing flow passage that depressurizes the refrigerant outputted from the condensing flow passage; and an evaporating flow passage that evaporates the refrigerant which is depressurized at the pressure reducing flow passage.

The flow passage unit is one of a plurality of flow passage units that are stacked in a thickness direction thereof. The stacked flow passage units form a heat exchanger as a whole. The flow passage units of the heat exchanger form a plurality of refrigerant flow passages which are arranged in parallel in the refrigeration cycle circuit.

As described above, in the heat exchanger, the refrigerant flow passages are arranged in parallel in the refrigeration cycle circuit. Therefore, when the number of the flow passage units stacked one after another is increased, the number of parallel refrigerant flow passages, which include the condensing flow passages (in other words, heat releasing flow passages), the pressure reducing flow passages and the evaporating flow passages, is increased. A cooling capacity or a heating capacity of an air conditioning apparatus, which includes the heat exchanger including the flow passage units, is determined by the number of the flow passage units stacked one after another. The cooling capacity or the heating capacity of the air conditioning apparatus can be increased by increasing the number of the stacked flow passage units.

However, in the heat exchanger including the stacked flow passage units, all of the heat releasing flow passages are connected in parallel along the refrigerant flow, and all of the evaporating flow passages are connected in parallel along the refrigerant flow. Therefore, due to variations in a shape of the respective components which form the refrigerant flow passages and/or differences in the refrigerant paths, a refrigerant flow rate tends to vary among the heat releasing flow passages, and also a refrigerant flow rate tends to vary among the evaporating flow passages.

Specifically, in the heat exchanger, a refrigerant distribution tends to vary among the heat releasing flow passages in the heat releasing unit including the heat releasing flow passages, and a refrigerant distribution tends to vary among the evaporating flow passages in the evaporating unit including the evaporating flow passages. This phenomenon will cause a deterioration in the cooling capacity or the heating capacity of the air conditioning apparatus, and this phenomenon will be more prominent when the number of the stacked flow passage units is increased to increase the cooling capacity or the heating capacity of the air conditioning apparatus. As a result of detailed examination by the inventors of the present application, the above phenomenon was found.

According to one aspect of the present disclosure, there is provided a heat exchanger configured to conduct refrigerant through the heat exchanger, including:

- a side plate portion, wherein a thickness direction of the side plate portion serves as a stacking direction that is predetermined;
- a heat releasing unit that includes a plurality of heat releasing constituents which are stacked on one side of the side plate portion in the stacking direction and are joined together, wherein:
  - a plurality of heat releasing flow passages are formed in the plurality of heat releasing constituents, respectively; and
  - the heat releasing unit is configured to release heat from the refrigerant flowing in the plurality of heat releasing flow passages; and
- an evaporating unit that includes a plurality of evaporating constituents which are stacked on the one side of the side plate portion in the stacking direction and are joined together, wherein:
- a plurality of evaporating flow passages are formed in the plurality of evaporating constituents, respectively;
- the evaporating unit and the heat releasing unit are arranged one after another in a direction along the side plate portion;
- the evaporating unit is configured to evaporate the refrigerant by let the refrigerant flowing in the plurality of evaporating flow passages absorb heat;

the heat releasing unit and the evaporating unit are both fixed to the side plate portion;

a heat releasing unit outlet is formed at an outlet-side heat releasing constituent that is one of the plurality of heat releasing constituents placed at an end of the plurality of heat releasing constituents;

an evaporating unit inlet is formed at an inlet-side evaporating constituent that is one of the plurality of evaporating constituents placed at an end of the plurality of evaporating constituents; and all of the plurality of heat releasing flow passages, which are respectively formed in the plurality of heat releasing constituents, are connected to the plurality of evaporating flow passages through the heat releasing unit outlet and the evaporating unit inlet.

With the above-described configuration, the heat releasing unit and the evaporating unit can be integrated together by the side plate portion.

Furthermore, it is not necessary that all of the plurality of heat releasing flow passages are connected in parallel along the refrigerant flow, and a connection relationship among the heat releasing flow passages can be made into a desired configuration in the heat releasing unit. For example, all of the heat releasing flow passages may be connected in series. Alternatively, the heat releasing flow passages may be divided into a plurality of flow passage groups, and the flow passage groups may be connected in series.

In this way, the refrigerant distribution among the heat releasing flow passages can be improved over, for example, the above-described heat exchanger. This is also true for the evaporating flow passages. That is, the refrigerant distribution among the evaporating flow passages can be improved over, for example, the above-described heat exchanger.

Hereinafter, embodiments will be described with reference to the drawings. In each of the following embodiments, parts that are the same or equal to each other are indicated by the same reference signs in the drawings.

First Embodiment

As shown in FIG. 1, a heat exchanger 10 of the present embodiment constitutes a part of a refrigeration cycle circuit 12 in which refrigerant is circulated. Specifically, in the refrigeration cycle circuit 12, the refrigerant, which is compressed by a compressor 14 of the refrigeration cycle circuit 12, flows into the heat exchanger 10, and the refrigerant, which flows into the heat exchanger 10, flows through the heat exchanger 10 and is then suctioned into the compressor 14.

The heat exchanger 10 exchanges heat between the air, which will flow into an air conditioning subject space where cooling or heating is performed, and the refrigerant. For example, in the case where the air conditioning subject space is cooled, the heat exchanger 10 cools the air, which will flow into the air conditioning subject space, with the refrigerant. Furthermore, in the case where the air conditioning subject space is heated, the heat exchanger 10 heats the air, which will flow into the air conditioning subject space, with the refrigerant.

Figure 2:
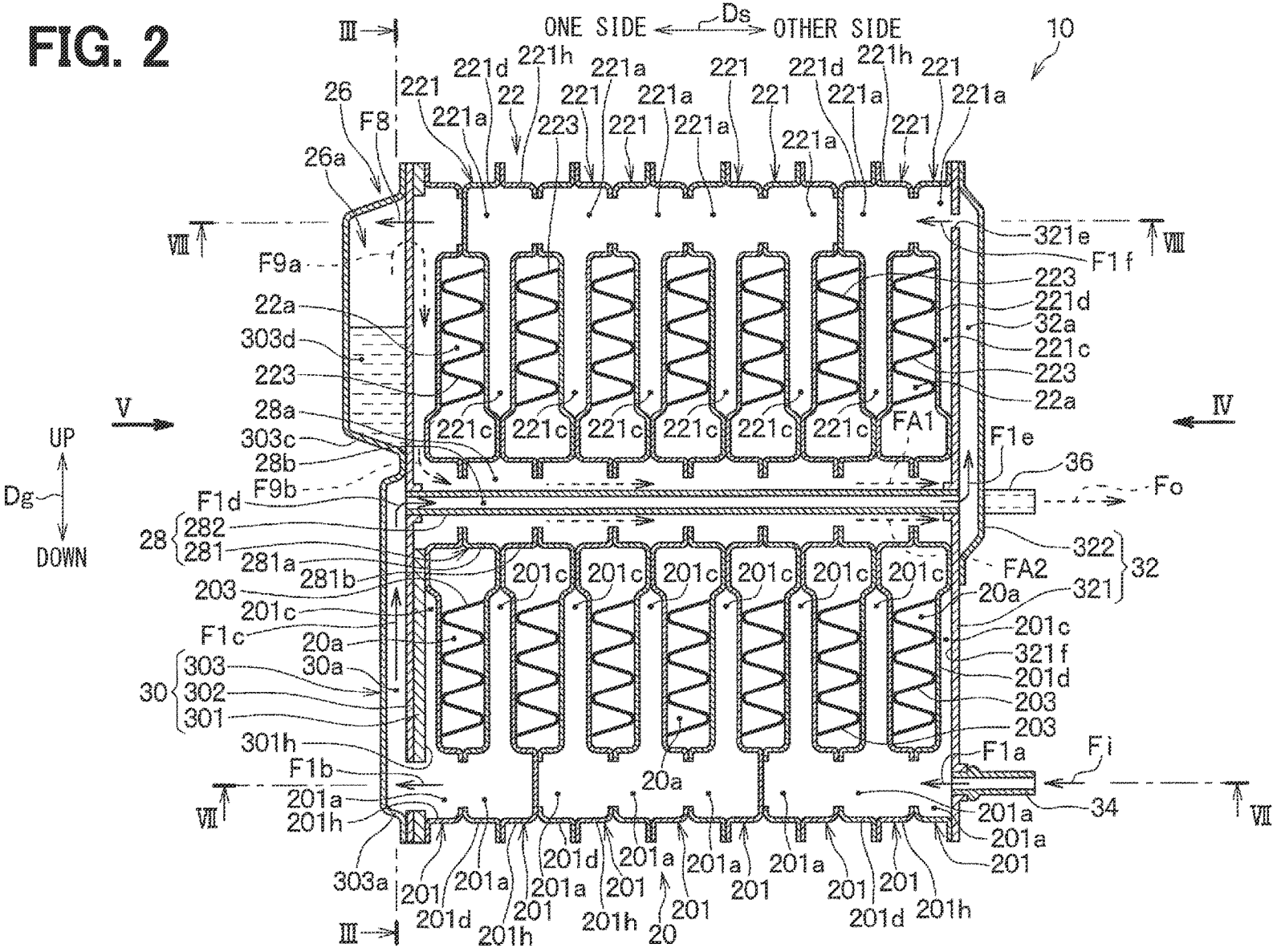
FIG. 2 is a cross-sectional view schematically showing a structure of the heat exchanger of the first embodiment.

As shown in FIGS. 1 and 2, the heat exchanger 10 of the present embodiment is formed by brazing and joining a plurality of constituent members, which are made of metal (e.g., an aluminum alloy), to each other. The heat exchanger 10 of the present embodiment includes: a condensing unit 20, which functions as a condenser; an evaporating unit 22, which functions as an evaporator; an internal heat exchanging unit 28, which functions as an internal heat exchanger; a one-side side plate portion 30; an other-side side plate portion 32; an inlet pipe 34, which is shaped in a tubular form; and an outlet pipe 36, which is shaped in a tubular form.

Figure 3:
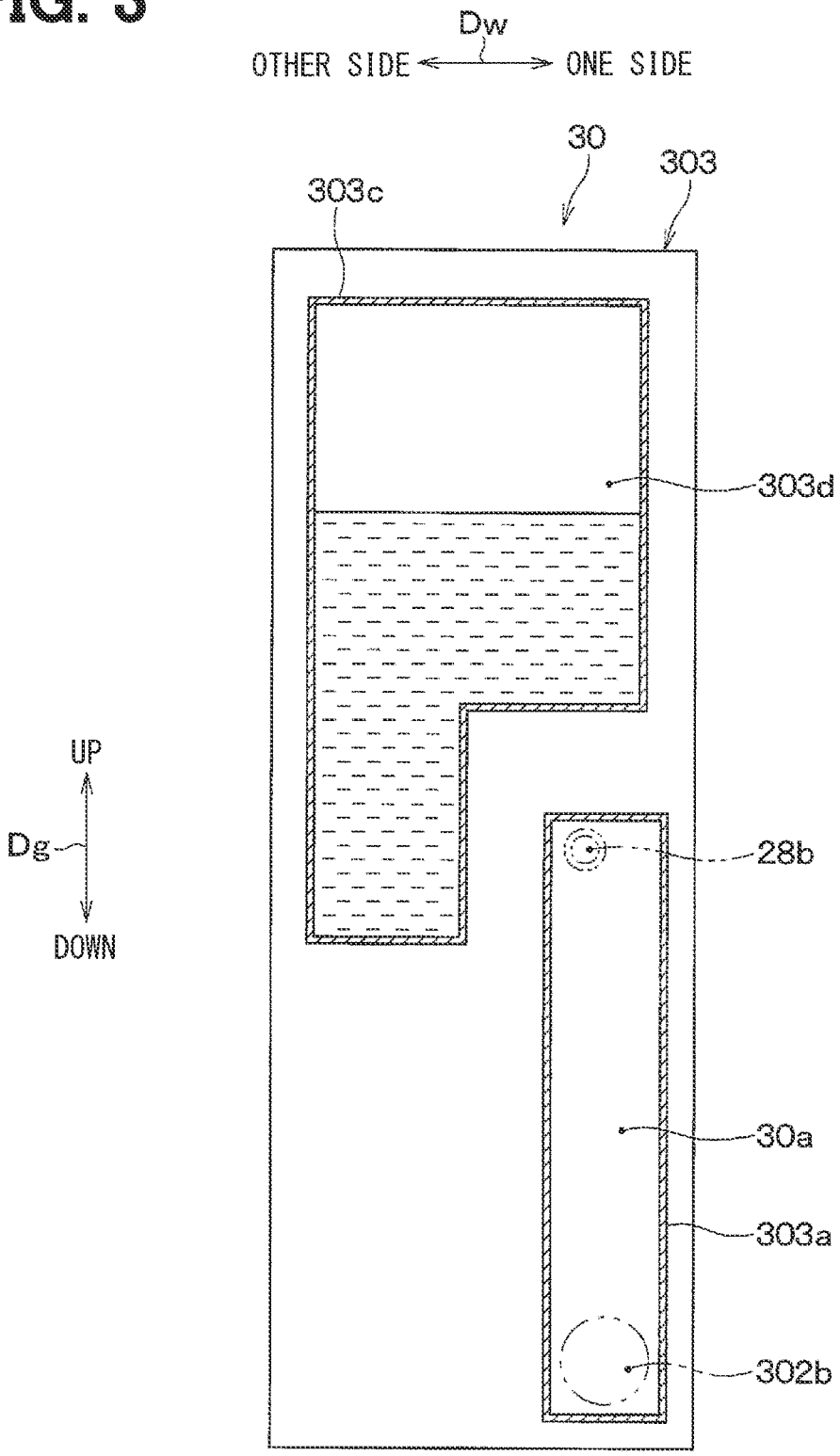
FIG. 3 is a cross-sectional view taken along line III-III of FIG. 2 of the first embodiment, showing a one-side tertiary plate of a one-side side plate portion.
Figure 4:
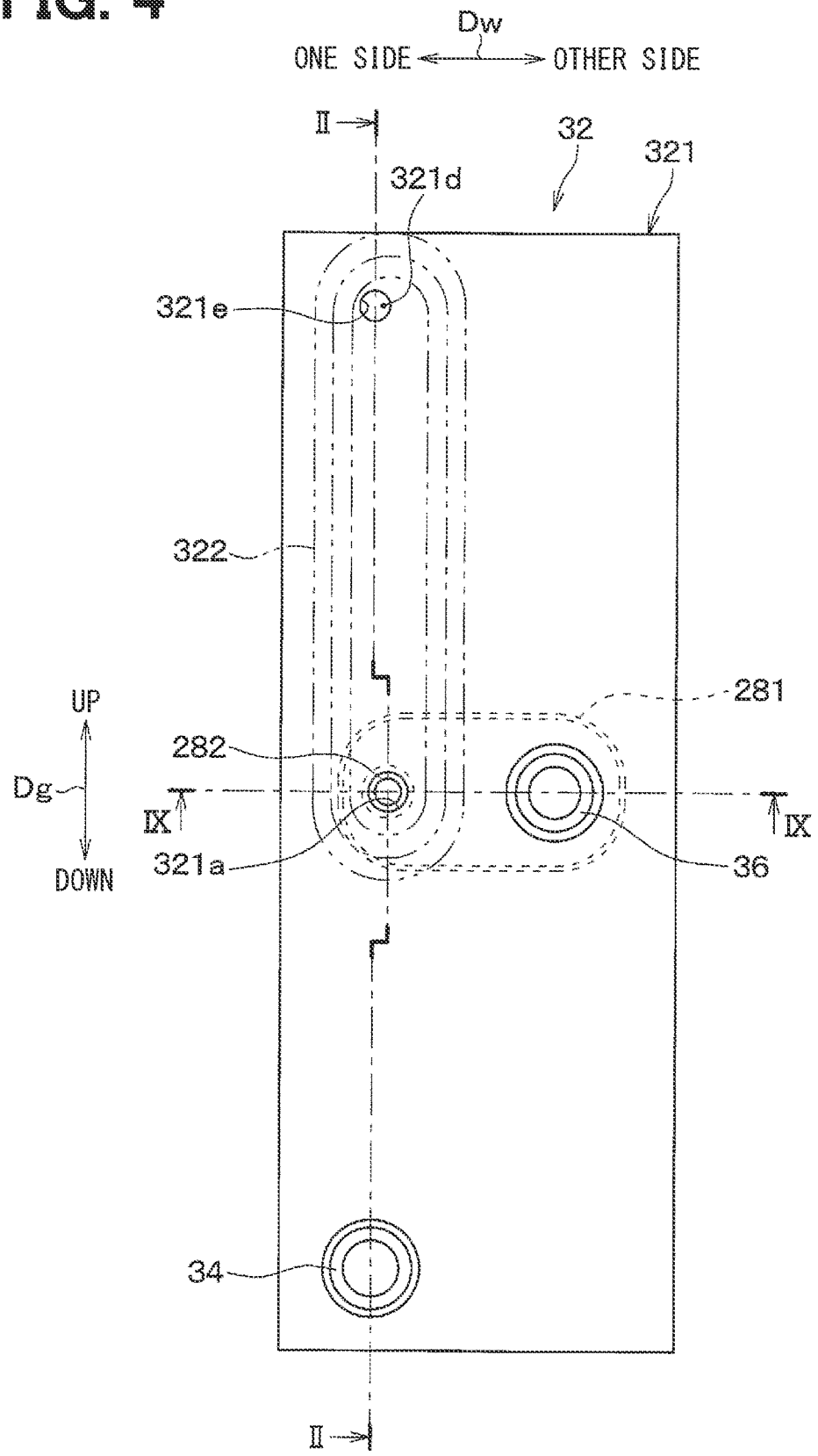
FIG. 4 is a view in a direction of an arrow IV in FIG. 2 of the first embodiment, showing an other-side secondary plate of an other-side side plate portion with a dot-dot-dash line.

As shown in FIGS. 2 to 4, the one-side side plate portion 30 and the other-side side plate portion 32 are respectively shaped generally in a form of a plate while a thickness direction of each of the one-side side plate portion 30 and the other-side side plate portion 32 serves as a stacking direction Ds that is predetermined, and a longitudinal direction of each of the one-side side plate portion 30 and the other-side side plate portion 32 coincides with a gravity direction Dg. The stacking direction Ds is a direction intersecting the gravity direction Dg, strictly speaking, a direction perpendicular to the gravity direction Dg. Here, it should be noted that FIG. 2 is a cross-sectional view taken along line II-II in FIG. 4. Furthermore, in the present embodiment, a direction, which is perpendicular to both of the stacking direction Ds and the gravity direction Dg, will be also referred to as a heat exchanger width direction Dw.

The one-side side plate portion 30 is placed at one end of the heat exchanger 10 located on one side in the stacking direction Ds, and the other-side side plate portion 32 is placed at the other end of the heat exchanger 10 located on the other side in the stacking direction Ds. The condensing unit 20, the evaporating unit 22 and the internal heat exchanging unit 28 are placed between the one-side side plate portion 30 and the other-side side plate portion 32 in the stacking direction Ds.

Specifically, the one-side side plate portion 30 is placed on the one side of the condensing unit 20, the evaporating unit 22 and the internal heat exchanging unit 28 in the stacking direction Ds, and the other-side side plate portion 32 is placed on the other side of the condensing unit 20, the evaporating unit 22 and the internal heat exchanging unit 28 in the stacking direction Ds. The one-side side plate portion 30 and the other-side side plate portion 32 clamp the condensing unit 20, the evaporating unit 22 and the internal heat exchanging unit 28 therebetween.

The condensing unit 20 has a stack structure in which a plurality of condensing constituents 201 are stacked in the stacking direction Ds to form a stack of the condensing constituents 201. A thickness direction of each condensing constituent 201 coincides with the stacking direction Ds, and a longitudinal direction of the condensing constituent 201 coincides with the gravity direction Dg. Specifically, the condensing unit 20 includes the plurality of condensing constituents 201, which are stacked in the stacking direction Ds and are joined together.

Figure 5:
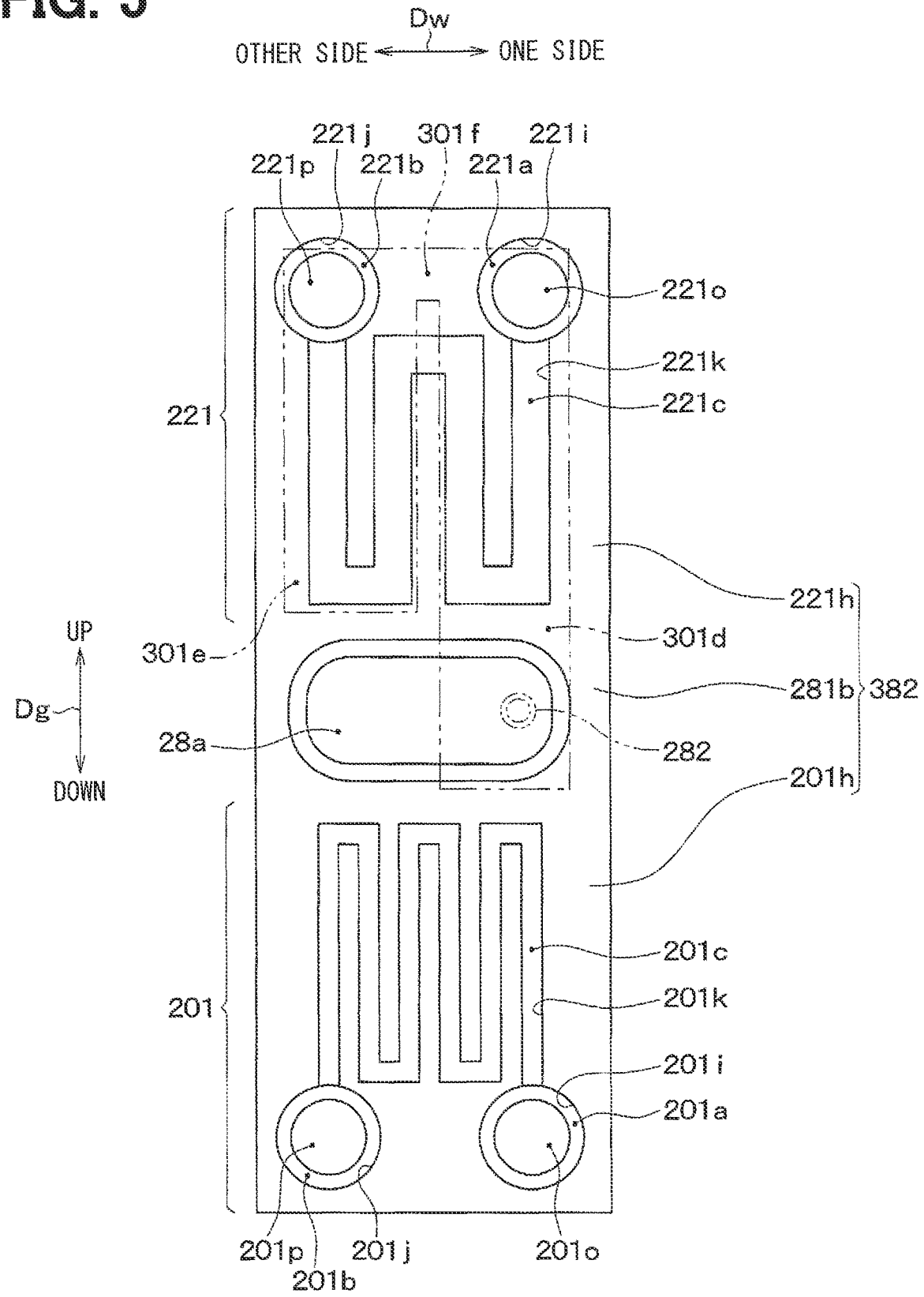
FIG. 5 is a view showing a secondary plate member viewed in a direction of an arrow V in FIG. 2 while the secondary plate member is placed on the other side in a stacking direction among a pair of plate members which form a condensing constituent and an evaporating constituent of the first embodiment.
Figure 6:
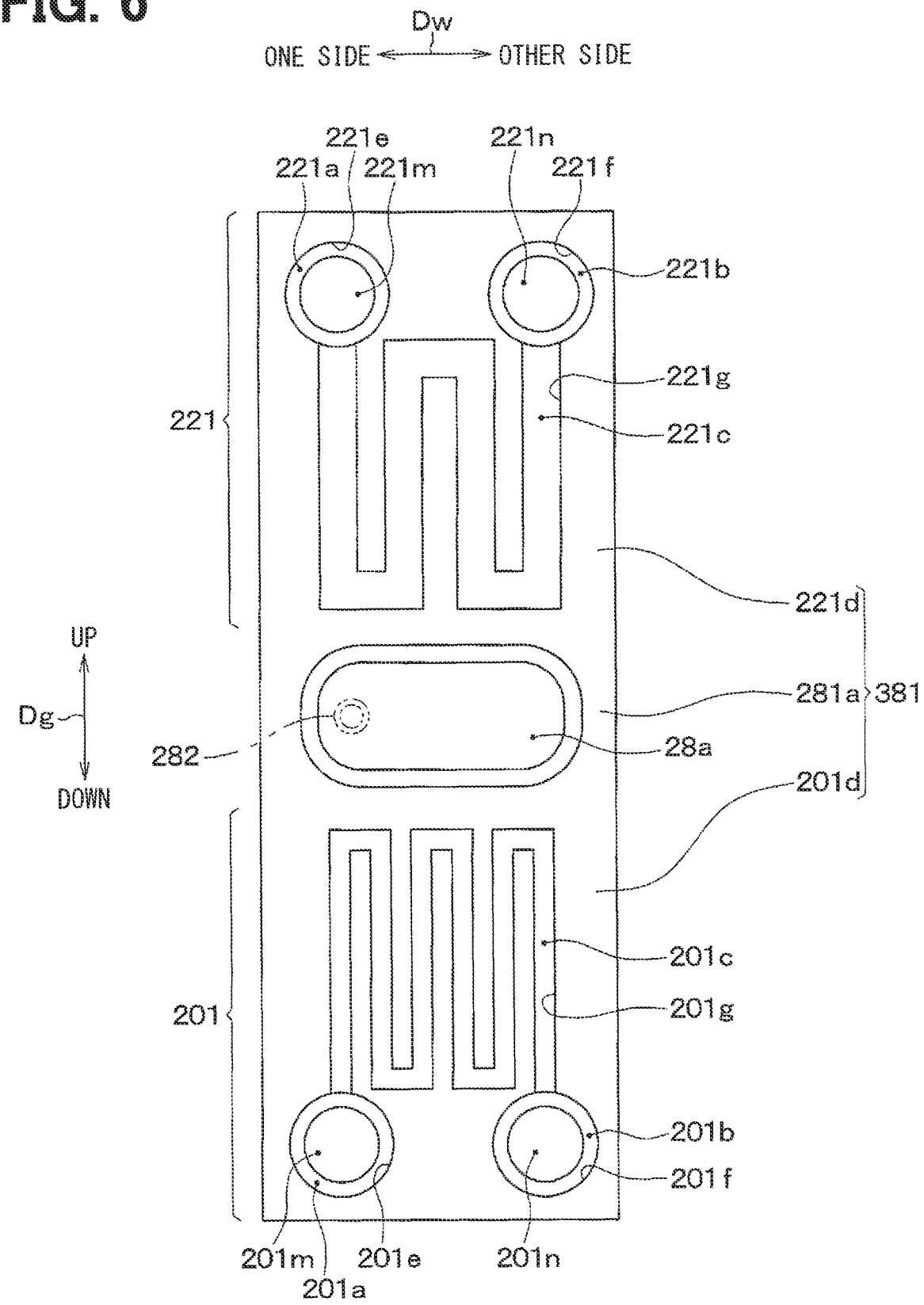
FIG. 6 is a view showing a primary plate member viewed in the direction of the arrow IV in FIG. 2 while the primary plate member is placed on one side in the stacking direction among the pair of plate members which form the condensing constituent and the evaporating constituent of the first embodiment.

As shown in FIGS. 2, 5 and 6, an internal space, which is formed by a one-side condensing tank space 201*a*, an other-side condensing tank space 201*b* and a condensing flow passage 201*c*, is formed at an inside of each of the condensing constituents 201. Each of the one-side condensing tank space 201*a*, the other-side condensing tank space 201*b* and the condensing flow passage 201*c* is a space that conducts the refrigerant.

The one-side condensing tank space 201*a* is connected to one end of the condensing flow passage 201*c*, and the other-side condensing tank space 201*b* is connected to the other end of the condensing flow passage 201*c*. The condensing flow passage 201*c* extends, for example, along a wavy path that is reciprocated (is turning forward and then backward) a plurality of times in the gravity direction Dg. In the present embodiment, the condensing flow passage 201*c* extends along the wavy path that is reciprocated three times in the gravity direction Dg.

The condensing flow passage 201*c* is located on an upper side of the one-side condensing tank space 201*a* and the other-side condensing tank space 201*b* in the gravity direction Dg. Furthermore, the one-side condensing tank space 201*a* is located on one side of the other-side condensing tank space 201*b* in the heat exchanger width direction Dw.

Figure 7:
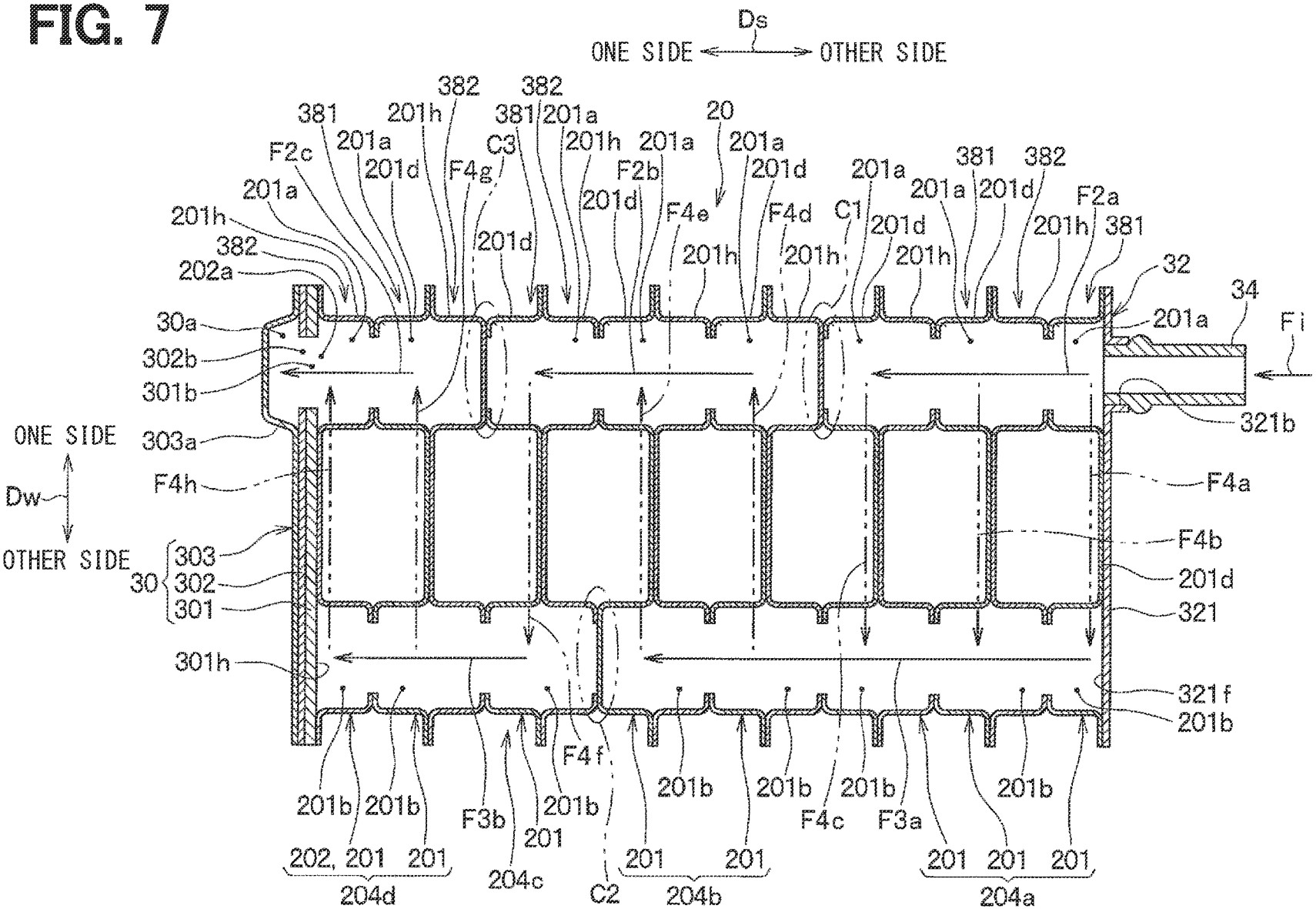
FIG. 7 is a cross-sectional view taken along line VII-VII in FIG. 2 of the first embodiment, schematically showing a refrigerant flow in a condensing unit with arrows.

Furthermore, as shown in FIGS. 2 and 7, at least the one-side condensing tank spaces 201*a* or the other-side condensing tank spaces 201*b* of each adjacent two of the condensing constituents 201 are communicated with each other.

The refrigerant, which is discharged from the compressor 14 (see FIG. 1), flows into the condensing unit 20 through the inlet pipe 34 as indicated by arrows Fi, F1*a* and thereafter flows in the condensing flow passages 201*c* of the corresponding condensing constituents 201. The condensing unit 20, which serves as a heat releasing unit for releasing the heat from the refrigerant, exchanges the heat between the air around the condensing unit 20 and the refrigerant flowing in the condensing flow passages 201*c* to release the heat from the refrigerant and condense the refrigerant.

Each of arrows F2*a*, F2*b*, F2*c* of FIG. 7 indicates the refrigerant flow that flows in the corresponding one-side condensing tank spaces 201*a* which are adjacent to one another in the stacking direction Ds and are connected with each other. Furthermore, each of arrows F3*a*, F3*b* indicates the refrigerant flow that flows in the corresponding other-side condensing tank spaces 201*b* which are adjacent to one another in the stacking direction Ds and are connected with each other. Furthermore, each of arrows F4*a*-F4*h* indicates the refrigerant flow that flows in the corresponding condensing flow passage 201*c*.

The evaporating unit 22 has a stack structure in which a plurality of evaporating constituents 221 are stacked in the stacking direction Ds to form a stack of the evaporating constituents 221. A thickness direction of each evaporating constituent 221 coincides with the stacking direction Ds, and a longitudinal direction of the evaporating constituent 221 coincides with the gravity direction Dg. Specifically, the evaporating unit 22 includes the plurality of evaporating constituents 221 which are stacked in the stacking direction Ds and are joined together.

As shown in FIGS. 2, 5 and 6, an internal space, which is formed by a one-side evaporating tank space 221*a*, an other-side evaporating tank space 221*b* and an evaporating flow passage 221*c*, is formed at an inside of each of the evaporating constituents 221. Each of the one-side evaporating tank space 221*a*, the other-side evaporating tank space 221*b* and the evaporating flow passage 221*c* is a space that conducts the refrigerant.

The one-side evaporating tank space 221*a* is connected to one end of the evaporating flow passage 221*c*, and the other-side evaporating tank space 221*b* is connected to the other end of the evaporating flow passage 221*c*. The evaporating flow passage 221*c* extends, for example, along a wavy path that is reciprocated (is turning forward and then backward) a plurality of times in the gravity direction Dg. In the present embodiment, the evaporating flow passage 221*c* extends along the wavy path that is reciprocated two times in the gravity direction Dg. The evaporating flow passage 221*c* is formed such that a size of a flow passage cross-sectional area of evaporating flow passage 221*c* is larger than that of the condensing flow passage 201*c*.

The evaporating flow passage 221*c* is located on a lower side of the one-side evaporating tank space 221*a* and the other-side evaporating tank space 221*b* in the gravity direction Dg. Furthermore, the one-side evaporating tank space 221*a* is located on one side of the other-side evaporating tank space 221*b* in the heat exchanger width direction Dw.

Figure 8:
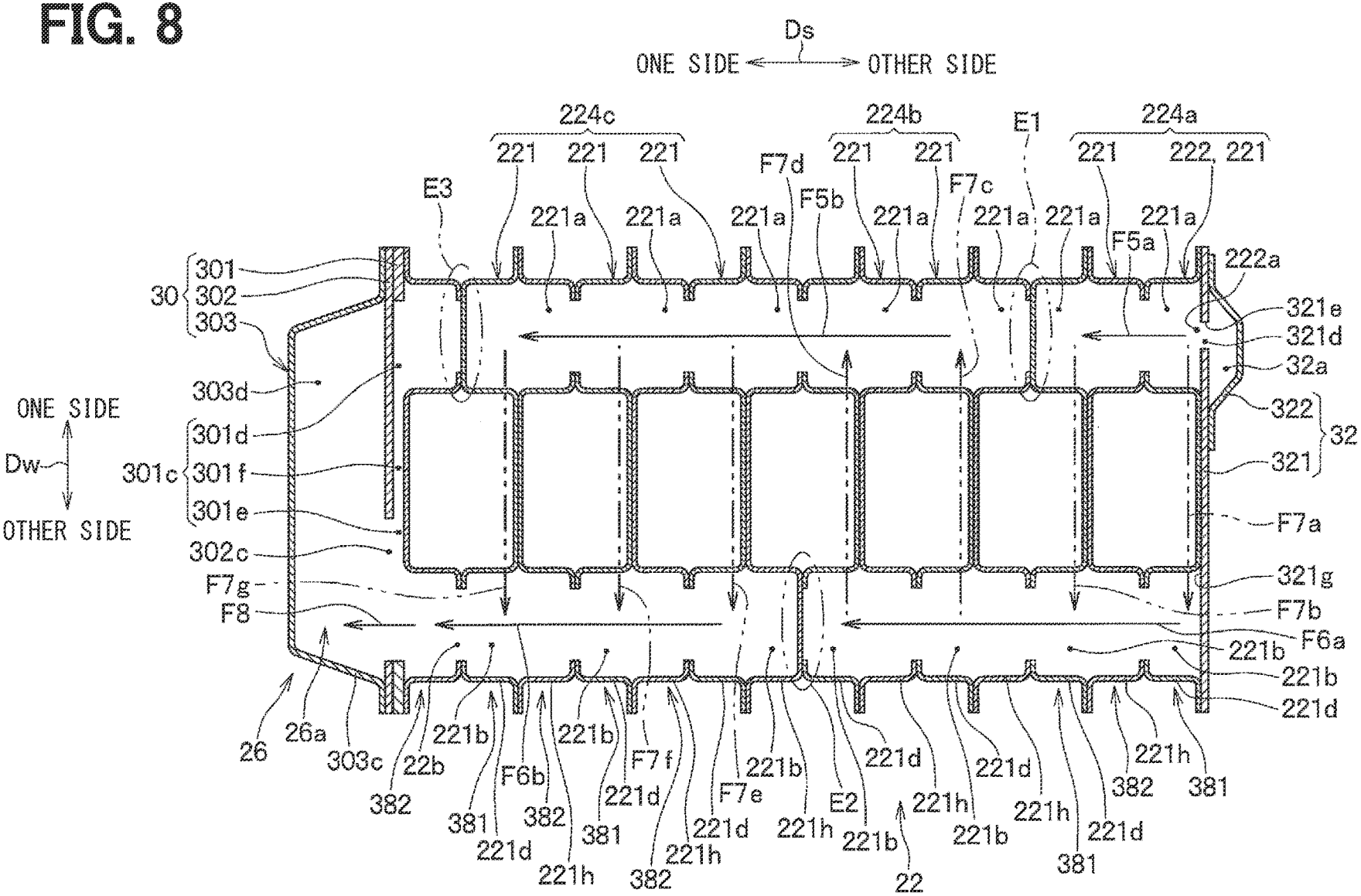
FIG. 8 is a cross-sectional view taken along line VIII-VIII in FIG. 2 of the first embodiment, schematically showing a refrigerant flow in an evaporating unit with arrows.

Furthermore, as shown in FIGS. 2 and 8, at least the one-side evaporating tank spaces 221*a* or the other-side evaporating tank spaces 221*b* of each adjacent two of the evaporating constituents 221 are communicated with each other.

The evaporating unit 22, the internal heat exchanging unit 28 and the condensing unit 20 are arranged in this order in the gravity direction Dg. Specifically, the evaporating unit 22, the internal heat exchanging unit 28 and the condensing unit 20 are arranged in this order from the upper side in the gravity direction Dg. That is, the internal heat exchanging unit 28 is placed on the lower side of the evaporating unit 22 such that the internal heat exchanging unit 28 overlaps with the evaporating unit 22. The condensing unit 20 is placed on the lower side of both of the evaporating unit 22 and the internal heat exchanging unit 28 such that the condensing unit 20 overlaps with both of the evaporating unit 22 and the internal heat exchanging unit 28. Here, it should be noted that the gravity direction Dg is a direction along the one-side side plate portion 30 and also a direction along the other-side side plate portion 32.

The refrigerant, which is outputted from the condensing unit 20, flows through the internal heat exchanging unit 28 and the flow restricting portion 321*e* of the other-side side plate portion 32 in this order and enters the evaporating unit 22 after depressurization of the refrigerant through the flow restricting portion 321*e*. This refrigerant flow from the condensing unit 20 to the evaporating unit 22 is indicated by, for example, arrows F1*b*-F1*f* of FIG. 2.

The refrigerant, which is inputted into the evaporating unit 22 through the flow restricting portion 321*e*, flows to the evaporating flow passages 221*c* of the corresponding evaporating constituents 221. The evaporating unit 22 exchanges the heat between the air around the evaporating unit 22 and the refrigerant flowing in the evaporating flow passage 221*c* to let the refrigerant absorb the heat and evaporate.

Here, it should be noted that each of arrows F5*a*, F5*b* of FIG. 8 indicates the refrigerant flow in the corresponding one-side evaporating tank spaces 221*a* which are adjacent to each other in the stacking direction Ds and are connected one after another. Furthermore, each of arrows F6*a*, F6*b* indicates the refrigerant flow in the corresponding other-side evaporating tank spaces 221*b* which are adjacent to each other in the stacking direction Ds and are connected one after another. Furthermore, each of arrows F7*a*-F7*g* indicates the refrigerant flow in the corresponding evaporating flow passage 221*c*.

As shown in FIG. 2, the one-side side plate portion 30 includes a one-side primary plate 301, a one-side secondary plate 302 and a one-side tertiary plate 303 each of which is a member shaped in a form of a plate. The one-side side plate portion 30 is formed by stacking and joining the one-side primary plate 301, the one-side secondary plate 302 and the one-side tertiary plate 303 one after another. The one-side primary plate 301, the one-side secondary plate 302 and the one-side tertiary plate 303 are stacked in this order from the other side toward the one side in the stacking direction Ds.

The condensing unit 20 and the evaporating unit 22 are both fixed to the one-side side plate portion 30. Specifically, the condensing unit 20 and the evaporating unit 22 are joined in parallel to the other side of the one-side primary plate 301 in the stacking direction Ds. That is, the condensing constituents 201 and the evaporating constituents 221 are stacked on the other side of the one-side side plate portion 30 in the stacking direction Ds.

The other-side side plate portion 32 includes an other-side primary plate 321 and an other-side secondary plate 322 each of which is a member shaped in a form of a plate, and the other-side side plate portion 32 is formed by stacking and joining the other-side primary plate 321 and the other-side secondary plate 322 one after another. The other-side primary plate 321 and the other-side secondary plate 322 are stacked in this order from the one side toward the other side in the stacking direction Ds.

The condensing unit 20 and the evaporating unit 22 are both fixed to the other-side side plate portion 32. Specifically, the condensing unit 20 and the evaporating unit 22 are joined in parallel to the one side of the other-side primary plate 321 in the stacking direction Ds. That is, the condensing constituents 201 and the evaporating constituents 221 are stacked on the one side of the other-side side plate portion 32 in the stacking direction Ds.

Figure 9:
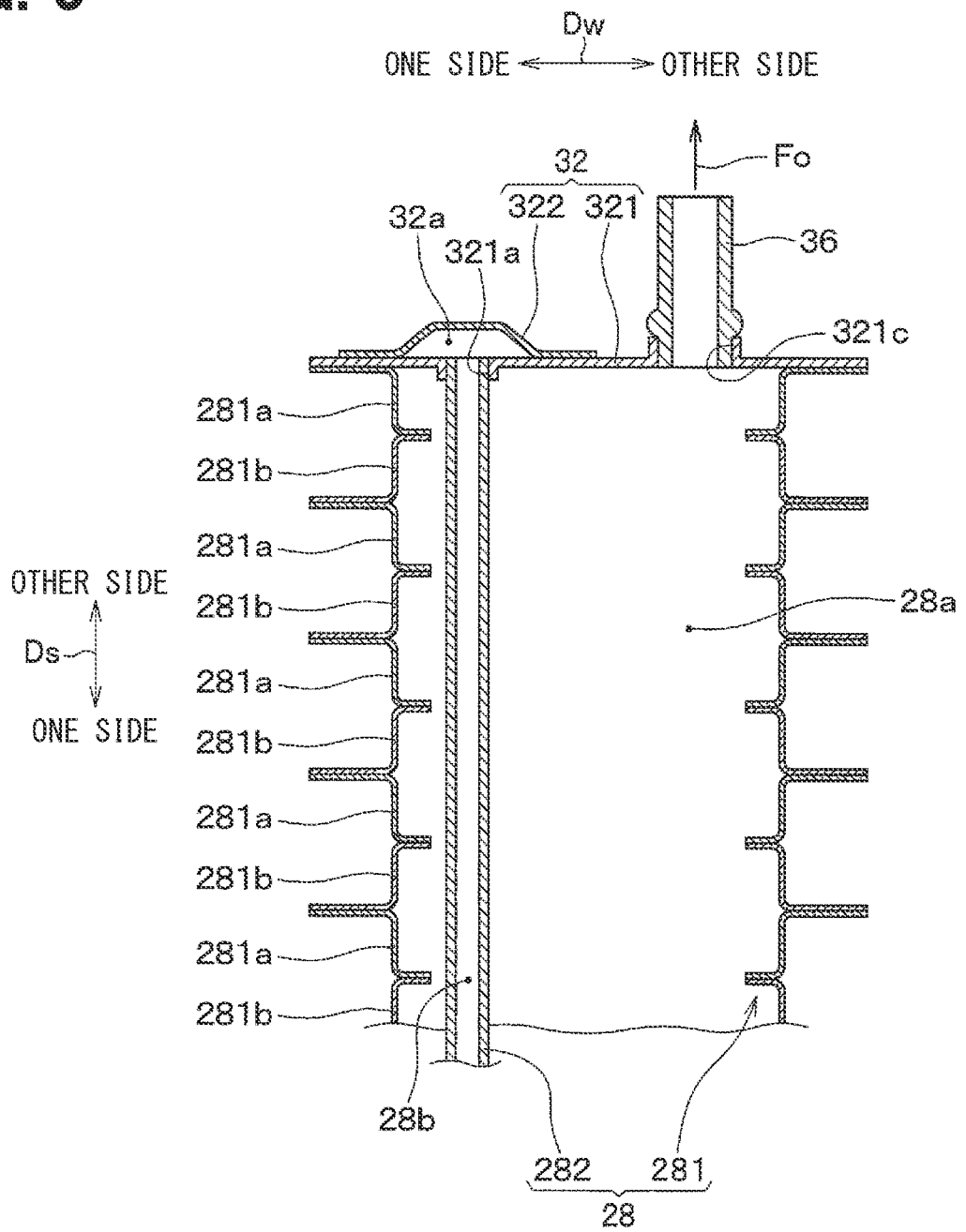
FIG. 9 is a cross-sectional view taken along line IX-IX in FIG. 4 of the first embodiment, schematically showing a structure of an internal heat exchanging unit.

With reference to FIGS. 2, 4 and 9, the internal heat exchanging unit 28 exchanges the heat between the refrigerant, which is outputted from the condensing unit 20, and the refrigerant, which is outputted from the evaporating unit 22. Therefore, the internal heat exchanging unit 28 has a double-tube structure extending in the stacking direction Ds and includes an outer tube portion 281, which is shaped in a tubular form, and an inner tube portion 282, which is shaped in a tubular form and is inserted into the outer tube portion 281. The internal heat exchanging unit 28 is placed between the one-side primary plate 301 and the other-side primary plate 321 such that the internal heat exchanging unit 28 is arranged side by side with the condensing unit 20 and the evaporating unit 22 and is joined to the one-side primary plate 301 and the other-side primary plate 321.

The outer tube portion 281 includes a plurality of outer tube constituents 281*a*, 281*b*. The outer tube constituents 281*a*, 281*b* are joined in series in the stacking direction Ds, so that the outer tube portion 281 is shaped in the tubular form extending in the stacking direction Ds.

Specifically, the outer tube portion 281 includes a plurality of primary outer tube constituents 281*a* and a plurality of secondary outer tube constituents 281*b* as the outer tube constituents 281*a*, 281*b* while a shape of the respective secondary outer tube constituents 281*b* differs from a shape of the respective primary outer tube constituents 281*a*. For example, each of the primary outer tube constituents 281*a* and the secondary outer tube constituents 281*b* is shaped in a tubular form extending in the stacking direction Ds, and each of the secondary outer tube constituents 281*b* is symmetrically arranged relative to an adjacent one of the primary outer tube constituents 281*a* in the stacking direction Ds. The primary outer tube constituents 281*a* and the secondary outer tube constituents 281*b* are alternately arranged in series in the stacking direction Ds and are joined together by brazing. The outer tube portion 281 is formed in the above-described manner.

Figure 10:
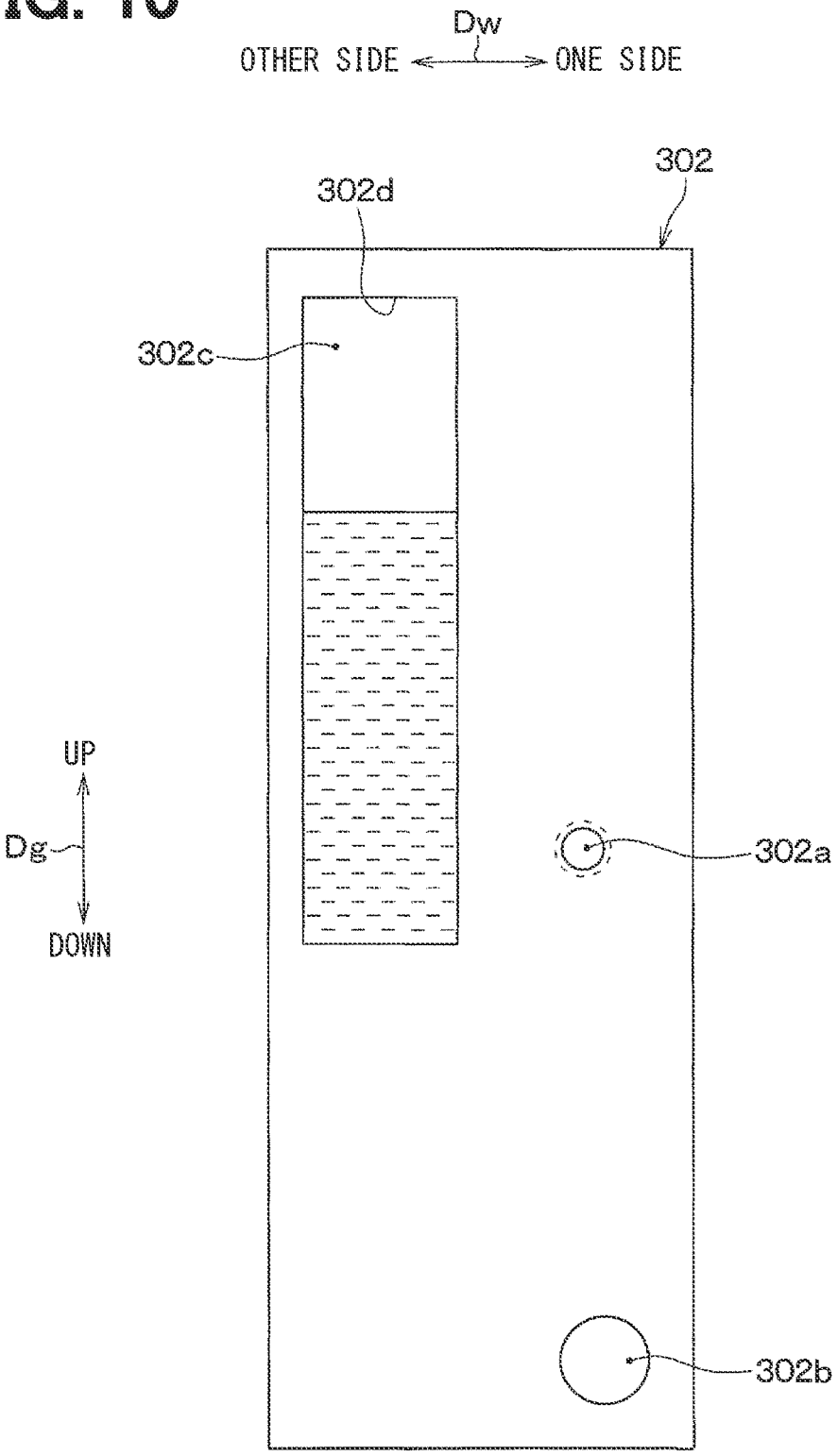
FIG. 10 is a view showing a one-side secondary plate of the one-side side plate portion of the first embodiment viewed in the direction of the arrow V in FIG. 2.

The inner tube portion 282 is formed by a tube member that extends in the stacking direction Ds. As shown in FIGS. 2 and 10, one end of the inner tube portion 282 is inserted into a one-end through hole 302*a* formed at the one-side secondary plate 302 and is joined to the one-side secondary plate 302 through the one end through hole 302*a* by brazing. Furthermore, as shown in FIGS. 2 and 9, the other end of the inner tube portion 282 is inserted into an other-end through hole 321*a* formed at the other-side primary plate 321 and is joined to the other-side primary plate 321 through the other-end through hole 321*a* by brazing.

With the above-described structure, the internal heat exchanging unit 28 has two flow passages extending in the stacking direction Ds, specifically, an outer flow passage 28*a*, which conducts the refrigerant outputted from the evaporating unit 22, and an inner flow passage 28*b*, which conducts the refrigerant outputted from the condensing unit 20. The outer flow passage 28*a* is located on an inner side of the outer tube portion 281, and the inner flow passage 28*b* is located on an inner side of the outer flow passage 28*a* such that a tubular wall of the inner tube portion 282 is interposed between the outer flow passage 28*a* and the inner flow passage 28*b*. Therefore, in the internal heat exchanging unit 28, the refrigerant, which is conducted in the outer flow passage 28*a*, and the refrigerant, which is conducted in the inner flow passage 28*b*, exchange the heat therebetween through the tubular wall of the inner tube portion 282.

As shown in FIGS. 4, 7 and 9, the other-side primary plate 321 includes an inlet through hole 321*b* and an outlet through hole 321*c* besides the other-end through hole 321*a* described above. The other-side primary plate 321 also includes a flow restricting hole 321*d* that functions as an orifice hole (a flow restrictor hole). That is, the other-side side plate portion 32 has a portion of the other-side primary plate 321, in which the flow restricting hole 321*d* is formed, as a flow restricting portion 321*e*. This flow restricting portion 321*e* is an orifice (a flow restrictor).

The inlet pipe 34 is inserted into the inlet through hole 321*b*, and the inlet pipe 34 is joined to the other-side primary plate 321 through the inlet through hole 321*b* by brazing. In this way, the inlet pipe 34 is connected to the condensing unit 20 such that the inlet pipe 34 is communicated with an inside of the condensing unit 20.

The outlet pipe 36 is inserted into the outlet through hole 321*c*, and the outlet pipe 36 is joined to the other-side primary plate 321 through the outlet through hole 321*c* by brazing. In this way, the outlet pipe 36 is connected to the internal heat exchanging unit 28 such that the outlet pipe 36 is communicated with the outer flow passage 28*a* of the internal heat exchanging unit 28.

As shown in FIGS. 2, 4 and 9, at the other-side side plate portion 32, the other-side secondary plate 322 is joined to the other side of the other-side primary plate 321 in the stacking direction Ds by brazing such that an other-side relay flow passage 32*a* is formed between the other-side secondary plate 322 and the other-side primary plate 321.

The other-side relay flow passage 32*a* extends in the gravity direction Dg and is located between the inner flow passage 28*b* of the internal heat exchanging unit 28 and the flow restricting hole 321*d* along the refrigerant flow (the flow of the refrigerant). That is, the other-side relay flow passage 32*a* is a flow passage that connects between a refrigerant outlet of the inner flow passage 28*b* and a refrigerant inlet of the flow restricting hole 321*d*.

As shown in FIGS. 2 and 8, among the evaporating constituents 221, an inlet-side evaporating constituent 222, which is located at an end of the stack of the evaporating constituents 221 (i.e., at an end of the plurality of evaporating constituents 221) on the other side in the stacking direction Ds, includes an evaporating unit inlet 222*a* through which the refrigerant is inputted from the flow restricting hole 321*d* (serving as a flow restricting flow passage) into the inside of the evaporating unit 22. The evaporating unit inlet 222*a* is included in the one-side evaporating tank space 221*a* of the inlet-side evaporating constituent 222. The flow restricting hole 321*d* of the other-side side plate portion 32 is connected to the evaporating unit inlet 222*a*. Thus, the evaporating unit inlet 222*a* serves as a portion of the one-side evaporating tank space 221*a* of the inlet-side evaporating constituent 222 which is connected to a downstream end of the flow restricting hole 321*d* that is a downstream end in a flow direction of the refrigerant.

A hole diameter of the flow restricting hole 321*d* of the other-side side plate portion 32 is set such that a predetermined depressurizing effect is exerted on the refrigerant which passes through the flow restricting hole 321*d*. That is, the flow restricting portion 321*e* is a fixed flow restrictor that restricts the refrigerant flow, and the flow restricting portion 321*e* functions as a pressure reducing portion which depressurizes the refrigerant outputted from the condensing unit 20 and then outputs the depressurized refrigerant to the evaporating unit 22. In the present embodiment, since the internal heat exchanging unit 28 is provided, the refrigerant, which has been outputted from the condensing unit 20 and has passed through the inner flow passage 28*b* of the internal heat exchanging unit 28 and the other-side relay flow passage 32*a*, is inputted into the flow restricting hole 321*d* of the flow restricting portion 321*e*.

Figure 11:
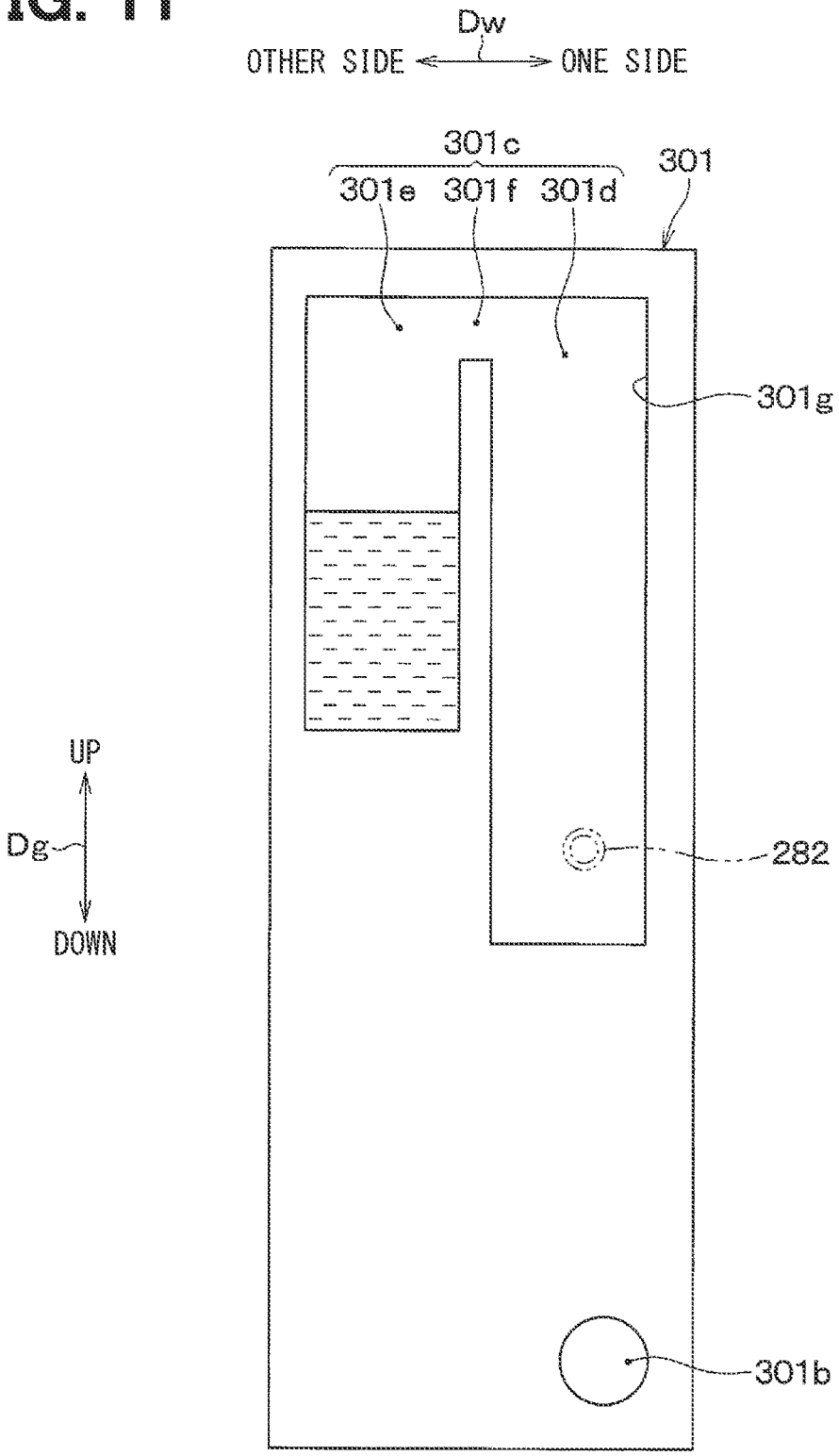
FIG. 11 is a view showing a one-side primary plate of the one-side side plate portion of the first embodiment viewed in the direction of the arrow V in FIG. 2.

As shown in FIG. 11, the one-side primary plate 301 of the one-side side plate portion 30 includes a condensing unit through hole 301*b* and a gas-liquid separating through hole 301*c*. The condensing unit through hole 301*b* is located on the lower side of the gas-liquid separating through hole 301*c*.

Furthermore, as shown in FIG. 10, the one-side secondary plate 302 includes a condensing unit through hole 302*b* and a gas-liquid separating through hole 302*c* besides the one-end through hole 302*a* described above. The condensing unit through hole 302*b* is located on the lower side of the one-end through hole 302*a* and the gas-liquid separating through hole 302*c* and is coaxial with the condensing unit through hole 301*b* of the one-side primary plate 301.

Furthermore, as indicated in FIGS. 2 and 3, the one-side tertiary plate 303 includes a flow passage cover portion 303*a* and a gas-liquid separating cover portion 303*c* while the gas-liquid separating cover portion 303*c* is located on the upper side of the flow passage cover portion 303*a*.

As shown in FIGS. 2 and 7, among the condensing constituents 201, an outlet-side condensing constituent 202, which is located at an end of the stack of the condensing constituents 201 (i.e., at an end of the plurality of condensing constituents 201) on the one side in the stacking direction Ds, includes a condensing unit outlet 202*a* through which the refrigerant is outputted from the condensing unit 20. The condensing unit outlet 202*a* is included in the one-side condensing tank space 201*a* of the outlet-side condensing constituent 202. The condensing unit through hole 301*b* of the one-side primary plate 301 and the condensing unit through hole 302*b* of the one-side secondary plate 302 are connected to the condensing unit outlet 202*a*.

Furthermore, the one-side tertiary plate 303 is joined to the one side of the one-side secondary plate 302 in the stacking direction Ds by brazing, so that the flow passage cover portion 303*a* of the one-side tertiary plate 303 forms a one-side relay flow passage 30*a* between the flow passage cover portion 303*a* and the one-side secondary plate 302.

The one-side relay flow passage 30*a* extends in the gravity direction Dg and is formed between the condensing unit through hole 302*b* of the one-side secondary plate 302 and the inner flow passage 28*b* of the internal heat exchanging unit 28 along the refrigerant flow. That is, the one-side relay flow passage 30*a* forms a flow passage that connects between the condensing unit outlet 202*a* of the condensing unit 20 and the refrigerant inlet of the inner flow passage 28*b*. With the flow passage structure for the refrigerant described above, the flow restricting portion 321*e* of the other-side side plate portion 32 is located between the condensing unit outlet 202*a* and the evaporating unit inlet 222*a* along the refrigerant flow.

As shown in FIG. 11, the gas-liquid separating through hole 301*c* of the one-side primary plate 301 includes a one-side hole portion 301*d*, an other-side hole portion 301*e* and a connecting hole portion 301*f*. The one-side hole portion 301*d* and the other-side hole portion 301*e* extend in the gravity direction Dg.

The other-side hole portion 301*e* is slightly spaced from the one-side hole portion 301*d* and is located on the other side of the one-side hole portion 301*d* which is opposite to the one side in the heat exchanger width direction Dw. The connecting hole portion 301*f* is located between the one-side hole portion 301*d* and the other-side hole portion 301*e* and connects between an upper end portion of the one-side hole portion 301*d* and an upper end portion of the other-side hole portion 301*e*.

Furthermore, with reference to FIGS. 8 and 11, the evaporating unit 22 includes an evaporating unit outlet 22*b* for outputting the refrigerant from the inside of the evaporating unit 22. The evaporating unit outlet 22*b* is an opening hole that opens in the stacking direction Ds. The gas-liquid separating through hole 301*c* is formed as follows. That is, the other-side hole portion 301*e* of the gas-liquid separating through hole 301*c* is placed on the one side of the evaporating unit outlet 22*b* in the stacking direction Ds such that the other-side hole portion 301*e* of the gas-liquid separating through hole 301*c* overlaps with the evaporating unit outlet 22*b*.

As shown in FIG. 10, the gas-liquid separating through hole 302*c* of the one-side secondary plate 302 extends in the gravity direction Dg. The gas-liquid separating through hole 302*c* is placed to overlap with the other-side hole portion 301*e* of the one-side primary plate 301. In contrast, the gas-liquid separating through hole 302*c* of the one-side secondary plate 302 is spaced from the one-side hole portion 301*d* of the one-side primary plate 301 toward the other side in the heat exchanger width direction Dw.

As shown in FIGS. 2 and 3, the gas-liquid separating cover portion 303*c* of the one-side tertiary plate 303 is recessed toward the one side in the stacking direction Ds and forms a cover internal space 303*d* between the gas-liquid separating cover portion 303*c* and the one-side secondary plate 302. The cover internal space 303*d* is a space connected to the gas-liquid separating through hole 302*c* of the one-side secondary plate 302.

The gas-liquid separating cover portion 303*c*; the primary gas-liquid separator constituent 301*g* of the one-side primary plate 301 having the gas-liquid separating through hole 301*c*; and the secondary gas-liquid separator constituent 302*d* of the one-side secondary plate 302 having the gas-liquid separating through hole 302*c* form a gas-liquid separating device 26.

That is, the one-side side plate portion 30 includes the gas-liquid separating device 26. The refrigerant flows from the evaporating unit 22 into the gas-liquid separating device 26 as indicated by an arrow F8 (see FIGS. 2 and 8). The gas-liquid separating device 26 functions as an accumulator that separates the refrigerant inputted from the evaporating unit 22 into gas-phase refrigerant and liquid-phase refrigerant. The gas-liquid separating device 26 enables the gas phase refrigerant, which is separated in the gas-liquid separating device 26, to flow from the gas-liquid separating device 26 into the outer flow passage 28*a* of the internal heat exchanging unit 28 and stores the liquid phase refrigerant in a liquid storage space 26*a* of the gas-liquid separating device 26.

With reference to FIGS. 3, 10 and 11, the liquid storage space 26*a* is formed by: the other-side hole portion 301*e* of the one-side primary plate 301; the gas-liquid separating through hole 302*c* of the one-side secondary plate 302; and the cover internal space 303*d*. In FIGS. 2, 3, 10 and 11, the liquid phase refrigerant stored in a lower portion of the liquid storage space 26*a* is indicated by hatching.

The inner tube portion 282 of the internal heat exchanging unit 28 is inserted into the one-side hole portion 301*d* of the one-side primary plate 301 and reaches the one-end through hole 302*a* of the one-side secondary plate 302. The one-side hole portion 301*d* of the one-side primary plate 301 is communicated with the outer flow passage 28*a* of the internal heat exchanging unit 28 at a lower portion of the one-side hole portion 301*d*. Therefore, the one-side hole portion 301*d* and the connecting hole portion 301*f* of the one-side primary plate 301 function as a refrigerant outlet flow passage which guides the gas phase refrigerant from the liquid storage space 26*a* to the outer flow passage 28*a* as indicated by arrows F9*a*, F9*b*.

The structure of the condensing unit 20 will now be described in detail. As shown in FIGS. 2 and 7, each of the condensing constituents 201 includes a pair of condensing plate portions 201*d*, 201*h* each of which is shaped in a form of a plate. In each of the condensing constituents 201, the pair of condensing plate portions 201*d*, 201*h* are stacked in the stacking direction Ds. Each of the condensing constituents 201 is formed by joining the pair of condensing plate portions 201*d*, 201*h* such that the condensing flow passage 201*c* and the condensing tank spaces 201*a*, 201*b* are formed between the pair of condensing plate portions 201*d*, 201*h*.

Specifically, the pair of condensing plate portions 201*d*, 201*h* include a one-side condensing plate portion 201*d* and an other-side condensing plate portion 201*h* while the other-side condensing plate portion 201*h* is placed on the other side of the one-side condensing plate portion 201*d* in the stacking direction Ds.

As shown in FIGS. 2, 5 and 6, the one-side condensing plate portion 201*d*, which is one of the pair of condensing plate portions 201*d*, 201*h*, includes a primary condensing tank forming portion 201*e*, a secondary condensing tank forming portion 201*f* and a condensing flow passage forming portion 201*g* which are recessed toward the one side in the stacking direction Ds. Furthermore, the other-side condensing plate portion 201*h*, which is the other one of the pair of condensing plate portions 201*d*, 201*h*, includes a primary condensing tank forming portion 201*i*, a secondary condensing tank forming portion 201*j* and a condensing flow passage forming portion 201*k* which are recessed toward the other side in the stacking direction Ds. The one-side condensing tank space 201*a* is formed between the primary condensing tank forming portions 201*e*, 201*i*, and the other-side condensing tank space 201*b* is formed between the secondary condensing tank forming portions 201*f*, 201*j*. Furthermore, the condensing flow passage 201*c* is formed between the condensing flow passage forming portions 201*g*, 201*k*.

Furthermore, in the one-side condensing plate portion 201*d*, a width of the primary condensing tank forming portion 201*e* measured in the stacking direction Ds and a width of the secondary condensing tank forming portion 201*f* measured in the stacking direction Ds are equal to each other and are larger than a width of the condensing flow passage forming portion 201*g* measured in the stacking direction Ds. Likewise, in the other-side condensing plate portion 201*h*, a width of the primary condensing tank forming portion 201*i* measured in the stacking direction Ds and a width of the secondary condensing tank forming portion 201*j* measured in the stacking direction Ds are equal to each other and are larger than a width of the condensing flow passage forming portion 201*k* measured in the stacking direction Ds.

Therefore, in the condensing unit 20, the primary condensing tank forming portions 201*e*, 201*i* of the adjacent two condensing constituents 201 are joined together, and the secondary condensing tank forming portions 201*f*, 201*j* of the adjacent two condensing constituents 201 are joined together. Furthermore, an air flow space 20*a*, through which the air passes, is formed between the adjacent condensing flow passage forming portions 201*g*, 201*k* of each adjacent two of the condensing constituents 201.

Thus, this air flow space 20*a* is one of a plurality of air flow spaces 20*a* arranged one after another in the stacking direction Ds, and a condensing unit fin 203, which is a corrugated fin, is placed in each of the air flow spaces 20*a* such that the condensing unit fin 203 is brazed to the outsides of the adjacent condensing flow passage forming portions 201*g*, 201*k*. The condensing unit fins 203 promote the heat exchange between the air flowing through the air flow spaces 20*a* and the refrigerant in the condensing unit 20.

As shown in FIGS. 2 and 7, two opposite outermost ones of the condensing constituents 201, which are located at the one end and the other end of the stack of the condensing constituents 201 in the stacking direction Ds, respectively, have a different shape that is different from that of the rest of the condensing constituents 201. For example, one of these two opposite outermost condensing constituents 201, which is located on the one side, includes the other-side condensing plate portion 201*h* and an opposing portion 301*h* of the one-side primary plate 301 while the opposing portion 301*h* is opposed to the other-side condensing plate portion 201*h*. Furthermore, the other one of the two opposite outermost condensing constituents 201, which is located on the other side, includes the one-side condensing plate portion 201*d* and an opposing portion 321*f* of the other-side primary plate 321 while the opposing portion 321*f* is opposed to the one-side condensing plate portion 201*d*.

Furthermore, with reference to FIGS. 5 to 7, in the one-side condensing plate portion 201*d*, a primary communication hole 201*m* extends through the primary condensing tank forming portion 201*e* in the stacking direction Ds, and a secondary communication hole 201*n* extends through the secondary condensing tank forming portion 201*f* in the stacking direction Ds. Likewise, in the other-side condensing plate portion 201*h*, a primary communication hole 201*o* extends through the primary condensing tank forming portion 201*i* in the stacking direction Ds, and a secondary communication hole 201*p* extends through the secondary condensing tank forming portion 201*j* in the stacking direction Ds.

The one-side condensing tank spaces 201*a* of each adjacent two of the condensing constituents 201 are communicated with each other since the primary communication holes 201*m*, 201*o* of these two condensing constituents 201 overlap with each other. Furthermore, the other-side condensing tank spaces 201*b* of each adjacent two of the condensing constituents 201 are communicated with each other since the secondary communication holes 201*n*, 201*p* of these two condensing constituents 201 overlap with each other.

However, some of the condensing constituents 201 do not have one of the primary and secondary communication holes 201*m*, 201*n*, 201*o*, 201*p*. Therefore, there is provided a plurality of condensing constituent groups 204*a*-204*d* each of which includes one or two or more of the condensing constituents 201. In the present embodiment, these condensing constituent groups 204*a*-204*d* include a first condensing constituent group 204*a*, a second condensing constituent group 204*b*, a third condensing constituent group 204*c* and a fourth condensing constituent group 204*d*.

In the condensing unit 20, the first condensing constituent group 204*a*, the second condensing constituent group 204*b*, the third condensing constituent group 204*c* and the fourth condensing constituent group 204*d* are arranged in this order from the other side toward the one side in the stacking direction Ds. The first condensing constituent group 204*a*, the second condensing constituent group 204*b*, the third condensing constituent group 204*c* and the fourth condensing constituent group 204*d* are connected in series in this order from the upstream side toward the downstream side along the refrigerant flow in the condensing unit 20.

Furthermore, in some of the condensing constituent groups 204*a*-204*d*, which include the plurality of condensing constituents 201, the plurality of condensing flow passages 201*c* are connected in parallel along the refrigerant flow.

Figure 12:
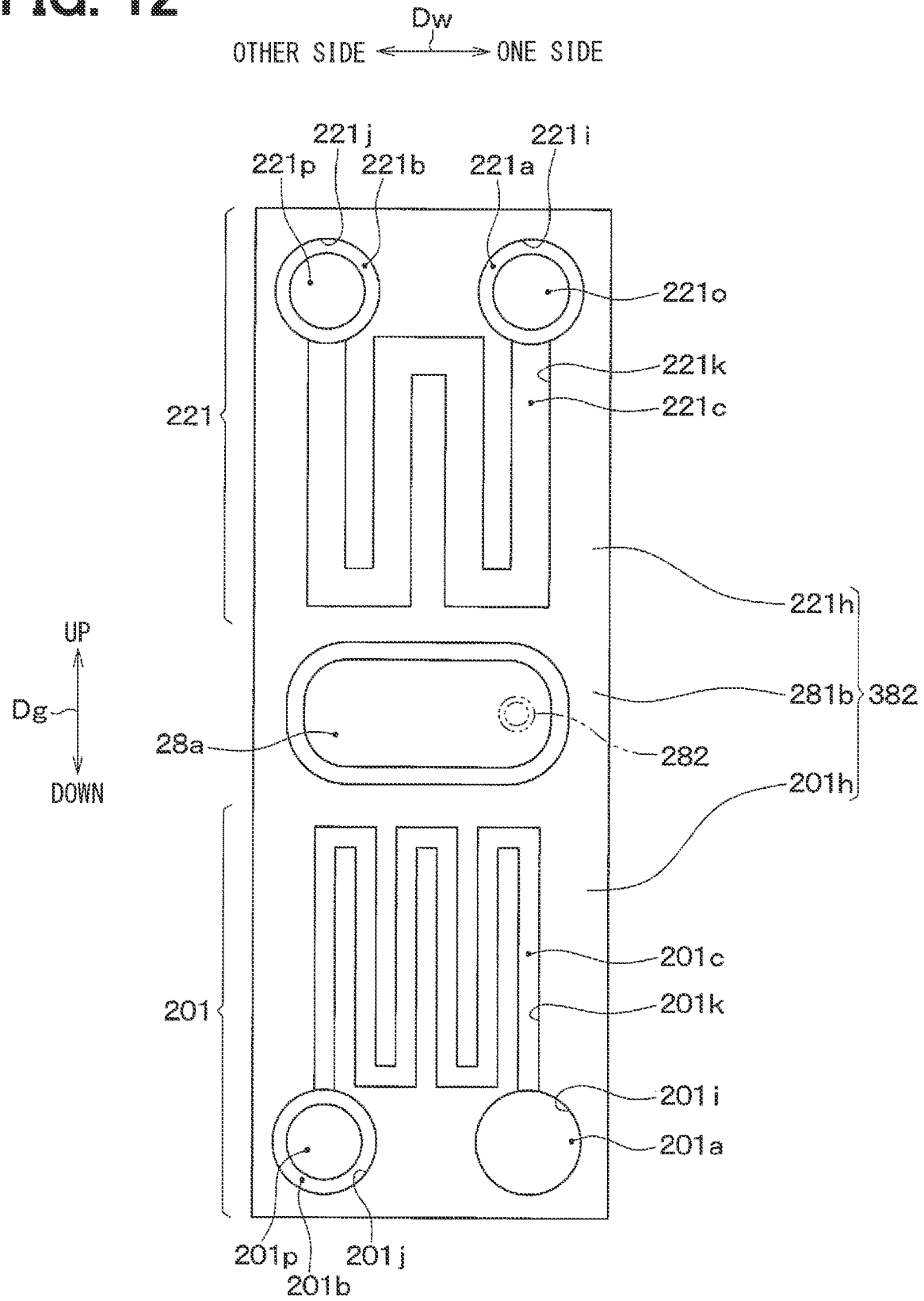
FIG. 12 is a view corresponding to FIG. 5 and showing a structure of an other-side condensing plate portion of the secondary plate member of FIG. 5, in which a primary communication hole is not formed.

In order to realize such a refrigerant flow path, as shown in a portion C1 of FIG. 7, the primary communication hole 2010 is not formed in the other-side condensing plate portion 201*h* that is located at an end of the second condensing constituent group 204*b* on the other side in the stacking direction Ds. Furthermore, as shown in a portion C2, the secondary communication hole 201*n* is not formed in the one-side condensing plate portion 201*d* that is located at an end of the second condensing constituent group 204*b* on the one side in the stacking direction Ds. Furthermore, as shown in a portion C3, the primary communication hole 2010 is not formed in the other-side condensing plate portion 201*h* that is located at an end of the fourth condensing constituent group 204*d* on the other side in the stacking direction Ds. For example, the other-side condensing plate portion 201*h*, in which the secondary communication hole 201*p* is formed but the primary communication hole 2010 is not formed, is shown in FIG. 12.

The structure of the evaporating unit 22 is basically the same as the structure of the condensing unit 20 described above. Specifically, as shown in FIGS. 2 and 8, the evaporating constituents 221 respectively include a pair of evaporating plate portions 221*d*, 221*h*. In each of the evaporating constituents 221, the pair of evaporating plate portions 221*d*, 221*h* are stacked in the stacking direction Ds. The evaporating constituents 221 are joined together such that the evaporating flow passage 221*c* and the evaporating tank spaces 221*a*, 221*b* are formed between the pair of evaporating plate portions 221*d*, 221*h*.

Specifically, the pair of evaporating plate portions 221*d*, 221*h* includes a one-side evaporating plate portion 221*d* and an other-side evaporating plate portion 221*h* while the other-side evaporating plate portion 221*h* is placed on the other side of the one-side evaporating plate portion 221*d* in the stacking direction Ds.

As shown in FIGS. 2, 5 and 6, the one-side evaporating plate portion 221*d*, which is one of the pair of evaporating plate portions 221*d*, 221*h*, includes a primary evaporating tank forming portion 221*e*, a secondary evaporating tank forming portion 221*f* and an evaporating flow passage forming portion 221*g* which are recessed toward the one side in the stacking direction Ds. Furthermore, the other-side evaporating plate portion 221*h*, which is the other one of the pair of evaporating plate portions 221*d*, 221*h*, includes a primary evaporating tank forming portion 221*i*, a secondary evaporating tank forming portion 221*j* and an evaporating flow passage forming portion 221*k* which are recessed toward the other side in the stacking direction Ds. The one-side evaporating tank space 221*a* is formed between the primary evaporating tank forming portions 221*e*, 221*i*, and the other-side evaporating tank space 221*b* is formed between the secondary evaporating tank forming portions 221*f*, 221*j*. Furthermore, the evaporating flow passage 221*c* is formed between the evaporating flow passage forming portions 221*g*, 221*k*.

Furthermore, in the one-side evaporating plate portion 221*d*, a width of the primary evaporating tank forming portion 221*e* measured in the stacking direction Ds and a width of the secondary evaporating tank forming portion 221*f* measured in the stacking direction Ds are equal to each other and are larger than a width of the evaporating flow passage forming portion 221*g* measured in the stacking direction Ds. Furthermore, the width of the primary and secondary evaporating tank forming portions 221*e*, 221*f* measured in the stacking direction Ds is equal to the width of the condensing tank forming portions 201*e*, 201*f* of the one-side condensing plate portion 201*d* measured in the stacking direction Ds.

Likewise, in the other-side evaporating plate portion 221*h*, a width of the primary evaporating tank forming portion 221*i* measured in the stacking direction Ds and a width of the secondary evaporating tank forming portion 221*j* measured in the stacking direction Ds are equal to each other and are larger than a width of the evaporating flow passage forming portion 221*k* measured in the stacking direction Ds. Furthermore, the width of the evaporating tank forming portions 221*i*, 221*j* measured in the stacking direction Ds is equal to the width of the condensing tank forming portions 201*i*, 201*j* of the other-side condensing plate portion 201*h* measured in the stacking direction Ds.

Therefore, in the evaporating unit 22, the primary evaporating tank forming portions 221*e*, 221*i* of the adjacent two evaporating constituents 221 are joined together, and the secondary evaporating tank forming portions 221*f*, 221*j* of the adjacent two evaporating constituents 221 are joined together. Furthermore, an air flow space 22*a*, through which the air passes, is formed between the adjacent evaporating flow passage forming portions 221*g*, 221*k* of each adjacent two of the adjacent evaporating constituents 221.

Thus, this air flow space 22*a* is one a plurality of air flow spaces 22*a* arranged one after another in the stacking direction Ds, and an evaporating unit fin 223, which is a corrugated fin, is placed in each of the air flow spaces 22*a* such that the evaporating unit fin 223 is brazed to the outsides of the adjacent evaporating flow passage forming portions 221*g*, 221*k*. The evaporating unit fins 223 promote the heat exchange between the air flowing through the air flow spaces 22*a* and the refrigerant in the evaporating unit 22.

As shown in FIGS. 2 and 8, an outermost one of the evaporating constituents 221, which is located at the other end of the stack of the evaporating constituents 221 in the stacking direction Ds, has a different shape that is different from that of the rest of the evaporating constituents 221. For example, this outermost evaporating constituent 221, which is located at the other end of the stack of the evaporating constituents 221, includes the one-side evaporating plate portion 221*d* and an opposing portion 321*g* of the other-side primary plate 321 while the opposing portion 321*g* is opposed to the one-side evaporating plate portion 221*d*.

With reference to FIGS. 5, 6 and 8, in the one-side evaporating plate portion 221*d*, a primary communication hole 221*m* extends through the primary evaporating tank forming portion 221*e* in the stacking direction Ds, and a secondary communication hole 221*n* extends through the secondary evaporating tank forming portion 221*f* in the stacking direction Ds. Likewise, in the other-side evaporating plate portion 221*h*, a primary communication hole 2210 extends through the primary evaporating tank forming portion 221*i* in the stacking direction Ds, and a secondary communication hole 221*p* extends through the secondary evaporating tank forming portion 221*j* in the stacking direction Ds.

The one-side evaporating tank spaces 221*a* of each adjacent two of the evaporating constituents 221 are communicated with each other since the primary communication holes 221*m*, 221*o* of these two evaporating constituents 221 overlap with each other. Furthermore, the other-side evaporating tank spaces 221*b* of each adjacent two of the evaporating constituents 221 are communicated with each other since the secondary communication holes 221*n*, 221*p* of these two evaporating constituents 221 overlap with each other.

However, some of the evaporating constituents 221 do not have one of the primary and secondary communication holes 221*m*, 221*n*, 221*o*, 221*p*. Therefore, there is provided a plurality of evaporating constituent groups 224*a*-224*c* each of which includes one or two or more of the evaporating constituents 221. In the present embodiment, these evaporating constituent groups 224*a*-224*c* include a first evaporating constituent group 224*a*, a second evaporating constituent group 224*b* and a third evaporating constituent group 224*c*.

In the evaporating unit 22, the first evaporating constituent group 224*a*, the second evaporating constituent group 224*b* and the third evaporating constituent group 224*c* are arranged in this order from the other side toward the one side in the stacking direction Ds. The first evaporating constituent group 224*a*, the second evaporating constituent group 224*b* and the third evaporating constituent group 224*c* are connected in series in this order from the upstream side toward the downstream side along the refrigerant flow in the evaporating unit 22.

Furthermore, in some of the evaporating constituent groups 224*a*-224*c*, which include the plurality of evaporating constituents 221, the plurality of evaporating flow passages 221*c* are connected in parallel along the refrigerant flow.

Figure 13:
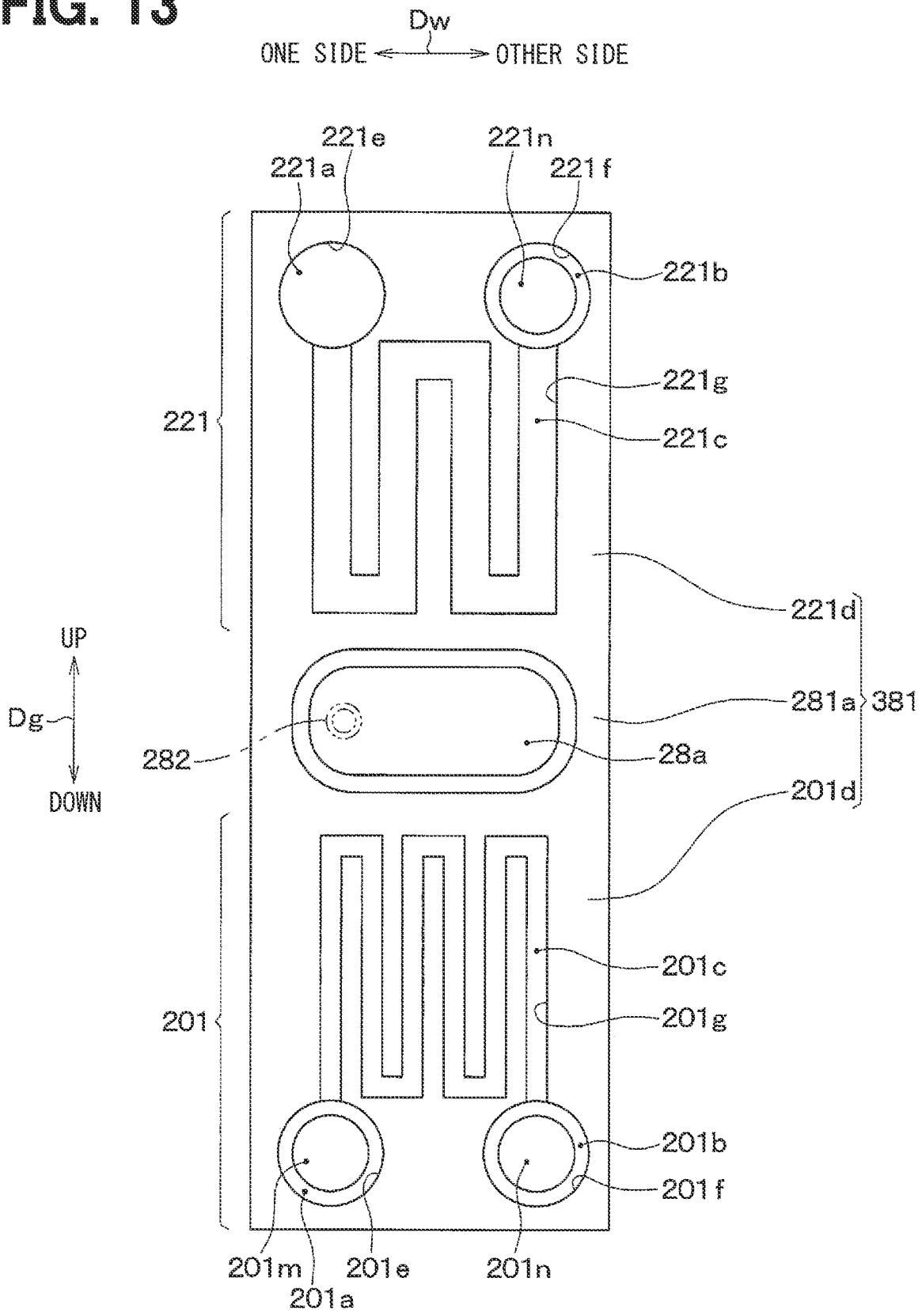
FIG. 13 is a view corresponding to FIG. 6 and showing a structure of a one-side evaporating plate portion of the primary plate member of FIG. 6, in which a primary communication hole is not formed.

In order to realize such a refrigerant flow path, as shown in a portion E1 of FIG. 8, the primary communication hole 221*m* is not formed in the one-side evaporating plate portion 221*d* that is located at an end of the first evaporating constituent group 224*a* on the one side in the stacking direction Ds. Furthermore, as shown in a portion E2, the secondary communication hole 221*p* is not formed in the outermost other-side evaporating plate portion 221*h* that is located at an end of the third evaporating constituent group 224*c* on the other side in the stacking direction Ds. Furthermore, as shown in a portion E3, the primary communication hole 221*m* is not formed in the outermost one-side evaporating plate portion 221*d* that is located at an end of the third evaporating constituent group 224*c* on the one side in the stacking direction Ds. For example, the one-side evaporating plate portion 221*d*, in which the secondary communication hole 221*n* is formed but the primary communication hole 221*m* is not formed, is shown in FIG. 13.

As shown in FIGS. 2, 5 and 6, the one-side condensing plate portion 201*d*, the one-side evaporating plate portion 221*d* and the primary outer tube constituent 281*a* are integrally formed in one-piece as a single component. Specifically, the one-side condensing plate portion 201*d*, the one-side evaporating plate portion 221*d* and the primary outer tube constituent 281*a* form a primary plate member 381. In the primary plate member 381, the one-side condensing plate portion 201*d*, the primary outer tube constituent 281*a* and the one-side evaporating plate portion 221*d* are arranged in this order from the lower side toward the upper side in the gravity direction Dg.

Therefore, the primary plate member 381 has the primary outer tube constituent 281*a*, which forms a portion of the internal heat exchanging unit 28, at a location between the one-side condensing plate portion 201*d* and the one-side evaporating plate portion 221*d*. That is, the primary plate member 381 forms the portion of the internal heat exchanging unit 28.

Likewise, the other-side condensing plate portion 201*h*, the other-side evaporating plate portion 221*h* and the secondary outer tube constituent 281*b* are integrally formed in one-piece as a single component. Specifically, the other-side condensing plate portion 201*h*, the other-side evaporating plate portion 221*h* and the secondary outer tube constituent 281*b* form a secondary plate member 382. In the secondary plate member 382, the other-side condensing plate portion 201*h*, the secondary outer tube constituent 281*b* and the other-side evaporating plate portion 221*h* are arranged in this order from the lower side toward the upper side in the gravity direction Dg.

Therefore, the secondary plate member 382 has the secondary outer tube constituent 281*b*, which forms a portion of the internal heat exchanging unit 28, at a location between the other-side condensing plate portion 201*h* and the other-side evaporating plate portion 221*h*. That is, the secondary plate member 382 forms the portion of the internal heat exchanging unit 28.

Both of the primary plate member 381 and the secondary plate member 382 are made of metal, such as an aluminum alloy which has good thermal conductivity. Furthermore, the primary plate members 381 and the secondary plate members 382 are alternately stacked in the stacking direction Ds and are joined together by brazing. In the present embodiment, among the stack structure formed by the primary plate members 381 and the secondary plate members 382, the outermost plate member located at the one end of the stack structure on the one side in the stacking direction Ds, i.e., the plate member joined to the one-side primary plate 301 is the secondary plate member 382. Furthermore, the outermost plate member located at the other end of the stack structure on the other side in the stacking direction Ds, i.e., the plate member joined to the other-side primary plate 321 is the primary plate member 381.

Furthermore, in the present embodiment, the shape of the secondary plate member 382 coincides with a shape that is formed by flipping the primary plate member 381 to reverse the front surface and the rear surface of the primary plate member 381 in the stacking direction Ds except for the presence or absence of the primary and secondary communication holes 201*m*, 201*n*, 201*o*, 201*p*, 221*m*, 221*n*, 221*o*, 221*p*. Each of the shape of the primary plate member 381 and the shape of the secondary plate member 382 is symmetrical in the heat exchanger width direction Dw. Therefore, the components are commonized between at least some of the primary plate members 381 and at least some of the secondary plate members 382.

Furthermore, in the pair of the primary plate member 381 and the secondary plate member 382, the internal space of the condensing constituent 201, the internal space of the evaporating constituent 221 and the outer flow passage 28*a* of the internal heat exchanging unit 28 are respectively formed as independent spaces which are formed independently from each other. That is, the primary plate member 381 is formed such that the condensing flow passage 201*c*, the outer flow passage 28*a* and the evaporating flow passage 221*c* of the primary plate member 381 are separated from each other. Likewise, the secondary plate member 382 is formed such that the condensing flow passage 201*c*, the outer flow passage 28*a* and the evaporating flow passage 221*c* of the secondary plate member 382 are separated from each other.

The refrigerant flows as follows in the heat exchanger 10 and the refrigeration cycle circuit 12 having the heat exchanger 10 constructed in the above-described manner. First of all, as shown in FIGS. 1, 2 and 7, the refrigerant discharged from the compressor 14 is inputted into an upstream-side space, which is formed by the one-side condensing tank spaces 201*a* connected one after another in the first condensing constituent group 204*a* of the condensing unit 20, through the inlet pipe 34 as indicated by arrows Fi, F1*a*. The refrigerant, which is inputted into the upstream-side space of the first condensing constituent group 204*a*, flows toward the one side in the stacking direction Ds as indicated by an arrow F2*a* and at the same time is distributed to the condensing flow passages 201*c*. The refrigerant flows in parallel in the condensing flow passages 201*c* as indicated by arrows F4*a*, F4*b*, F4*c* and at the same time exchanges the heat with the air around the condensing constituents 201 to release the heat to the air.

Then, the refrigerant flows from the condensing flow passages 201*c* into a downstream-side space which is formed by the other-side condensing tank spaces 201*b* connected one after another. Furthermore, the refrigerant flows from the downstream-side space of the first condensing constituent group 204*a* into an upstream-side space which is formed by the other-side condensing tank spaces 201*b* connected one after another in the second condensing constituent group 204*b* as indicated by an arrow F3*a*. The refrigerant, which flows into the upstream-side space of the second condensing constituent group 204*b*, flows toward the one side in the stacking direction Ds in the upstream-side space and at the same time is distributed to the condensing flow passages 201*c*. The refrigerant flows in parallel in the condensing flow passages 201*c* as indicated by arrows F4*d*, F4*e* and at the same time exchanges the heat with the air around the condensing constituents 201 to release the heat to the air.

Then, the refrigerant flows from the condensing flow passages 201*c* into a downstream-side space which is formed by the one-side condensing tank spaces 201*a* connected one after another. Furthermore, the refrigerant flows from the downstream-side space of the second condensing constituent group 204*b* into the one-side condensing tank space 201*a*, which serve as an upstream-side space, of the third condensing constituent group 204*c* as indicated by an arrow F2*b*. The refrigerant, which flows into the upstream-side space of the third condensing constituent group 204*c*, flows into the condensing flow passage 201*c*. The refrigerant flows in the condensing flow passage 201*c* as indicated by an arrow F4*f* and at the same time exchanges the heat with the air around the condensing constituent 201 to release the heat to the air.

The refrigerant flows from the condensing flow passage 201*c* into the other-side condensing tank space 201*b*, which serves as a downstream-side space. Furthermore, the refrigerant flows from the downstream-side space of the third condensing constituent group 204*c* into an upstream-side space which is formed by the other-side condensing tank spaces 201*b* connected one after another in the fourth condensing constituent group 204*d* as indicated by an arrow F3*b*. The refrigerant, which flows into the upstream-side space of the fourth condensing constituent group 204*d*, flows toward the one side in the stacking direction Ds in the upstream-side space and at the same time is distributed to the condensing flow passages 201*c*. The refrigerant flows in parallel in the condensing flow passages 201*c* as indicated by arrows F4*g*, F4*h* and at the same time exchanges the heat with the air around the condensing constituents 201 to release the heat to the air.

Then, the refrigerant flows from the condensing flow passages 201*c* into a downstream-side space which is formed by the one-side condensing tank spaces 201*a* connected one after another. The refrigerant, which flows into the downstream-side space of the fourth condensing constituent group 204*d*, flows from the condensing unit outlet 202*a* into the one-side relay flow passage 30*a* through the condensing unit through hole 301*b* of the one-side primary plate 301 and the condensing unit through hole 302*b* of the one-side secondary plate 302 as indicated by arrows F1*b*, F2*c*. In the one-side relay flow passage 30*a*, the refrigerant flows from the lower side toward the upper side in the gravity direction Dg as indicated by an arrow F1*c* in FIG. 2, and then this refrigerant flows from the one-side relay flow passage 30*a* into the inner flow passage 28*b* of the internal heat exchanging unit 28 as indicated by an arrow F1*d*. In the inner flow passage 28*b*, the refrigerant flows from the one side toward the other side in the stacking direction Ds, and then this refrigerant flows from the inner flow passage 28*b* into the other-side relay flow passage 32*a* as indicated by an arrow F1*e*.

In the other-side relay flow passage 32*a*, the refrigerant flows from the lower side toward the upper side in the gravity direction Dg, and then this refrigerant flows from the other-side relay flow passage 32*a* into the evaporating unit 22 through the flow restricting hole 321*d* of the other-side primary plate 321. At this time, in the flow restricting hole 321*d*, the refrigerant flow is restricted, so that the pressure of the refrigerant after passing through the flow restricting hole 321*d* is reduced in comparison to the pressure of the refrigerant before passing through the flow restricting hole 321*d*.

As indicated in FIGS. 2 and 8, the refrigerant, which has passed through the flow restricting hole 321*d* of the flow restricting portion 321*e*, flows into the evaporating unit 22 through the evaporating unit inlet 222*a*. Therefore, all of the condensing flow passages 201*c* formed in the condensing unit 20 are connected to the evaporating flow passages 221*c* of the evaporating unit 22 through the condensing unit outlet 202*a* (see FIG. 7), the flow restricting portion 321*e* and the evaporating unit inlet 222*a* in this order.

The refrigerant, which flows from the evaporating unit inlet 222*a* into the evaporating unit 22, first flows in an upstream-side space which is formed by the one-side evaporating tank spaces 221*a* connected one after another in the first evaporating constituent group 224*a*. The refrigerant, which flows into the upstream-side space of the first evaporating constituent group 224*a*, flows toward the one side in the stacking direction Ds in the upstream-side space as indicated by an arrow F5*a* and at the same time is distributed to the evaporating flow passages 221*c*. The refrigerant flows in parallel in the evaporating flow passages 221*c* as indicated by arrows F7*a*, F7*b* and at the same time exchanges the heat with the air around the evaporating constituents 221 to absorb the heat from the air.

Then, the refrigerant flows from the evaporating flow passages 221*c* into a downstream-side space which is formed by the other-side evaporating tank spaces 221*b* connected one after another. Furthermore, the refrigerant flows from the downstream-side space of the first evaporating constituent group 224*a* into an upstream-side space which is formed by the other-side evaporating tank space 221*b* connected one after another in the second evaporating constituent group 224*b* as indicated by an arrow F6*a*. The refrigerant, which flows into the upstream-side space of the second evaporating constituent group 224*b*, flows toward the one side in the stacking direction Ds in the upstream-side space and at the same time is distributed to the evaporating flow passages 221*c*. The refrigerant flows in parallel in the evaporating flow passages 221*c* as indicated by arrows F7*c*, F7*d* and at the same time exchanges the heat with the air around the evaporating constituents 221 to absorb the heat from the air.

Then, the refrigerant flows from the evaporating flow passages 221*c* into a downstream-side space which is formed by the one-side evaporating tank spaces 221*a* connected one after another. Furthermore, the refrigerant flows from the downstream-side space of the second evaporating constituent group 224*b* into an upstream-side space which is formed by the one-side evaporating tank space 221*a* connected one after another in the third evaporating constituent group 224*c* as indicated by an arrow F5*b*. The refrigerant, which flows into the upstream-side space of the third evaporating constituent group 224*c*, flows toward the one side in the stacking direction Ds in the upstream-side space and at the same time is distributed to the evaporating flow passages 221*c*. The refrigerant flows in parallel in the evaporating flow passages 221*c* as indicated by arrows F7*e*, F7*f*, F7*g* and at the same time exchanges the heat with the air around the evaporating constituents 221 to absorb the heat from the air.

Then, the refrigerant flows from the evaporating flow passages 221*c* into a downstream-side space which is formed by the other-side evaporating tank spaces 221*b* connected one after another. The refrigerant, which flows into the downstream-side space of the third evaporating constituent group 224*c*, flows from the evaporating unit outlet 22*b* to the liquid storage space 26*a* of the gas-liquid separating device 26 provided in the one-side side plate portion 30 as indicated by arrows F6*b*, F8.

The refrigerant is separated in the gas phase refrigerant and the liquid phase refrigerant at the gas-liquid separating device 26, and the separated gas phase refrigerant flows to the outer flow passage 28*a* of the internal heat exchanging unit 28 as indicated by arrows F9*a*, F9*b*. In contrast, the separated liquid phase refrigerant is stored in the liquid storage space 26*a*.

The refrigerant, which flows in the outer flow passage 28*a* of the internal heat exchanging unit 28, flows from the one side toward the other side in the stacking direction Ds as indicated by arrows FA1, FA2 in FIG. 2 and at the same time exchanges the heat with the refrigerant flowing in the inner flow passage 28*b*. Then, the refrigerant, which is outputted from the outer flow passage 28*a*, flows from the outlet pipe 36 to the outside of the heat exchanger 10 as indicated by an arrow Fo. The refrigerant, which is outputted from the outlet pipe 36, is suctioned into the compressor 14 as indicated in FIG. 1. The refrigerant flows in the heat exchanger 10 and the refrigeration cycle circuit 12 in the above-described manner.

As described above, in the present embodiment, the condensing unit 20 corresponds to the heat releasing unit. Therefore, the condensing constituents 201 may be referred to as heat releasing constituents, and the condensing flow passage 201*c* may be referred to as a heat releasing flow passage. Furthermore, the one-side condensing plate portion 201*d* may be referred to as a one-side heat releasing plate portion, and the other-side condensing plate portion 201*h* may be referred to as an other-side heat releasing plate portion. Additionally, the outlet-side condensing constituent 202 may be referred to as an outlet-side heat releasing constituent, and the condensing unit outlet 202*a* may be referred to as a heat releasing unit outlet.

As described above, according to the present embodiment, as shown in FIGS. 2, 7 and 8, the condensing constituents 201 and the evaporating constituents 221 are stacked on the one side of the other-side side plate portion 32 in the stacking direction Ds. Also, the evaporating unit 22 and the condensing unit 20 are arranged one after another in the direction along the other-side side plate portion 32 (more specifically, the gravity direction Dg) and are both fixed to the other-side side plate portion 32.

Therefore, the condensing unit 20 and the evaporating unit 22 can be integrated together by the other-side side plate portion 32 regardless of whether the condensing unit 20 and the evaporating unit 22 are integrated together by the primary plate members 381 and the secondary plate members 382.

Furthermore, the condensing flow passages 201*c* formed in the condensing unit 20 are all connected to the evaporating flow passages 221*c* of the evaporating unit 22 through the condensing unit outlet 202*a* and the evaporating unit inlet 222*a*. That is, the structure of the heat exchanger 10 is not limited to that all of the condensing flow passages 201*c* are connected in parallel along the refrigerant flow. Therefore, in the present embodiment, the connection relationship among the condensing flow passages 201*c* can be easily set to a desirable relationship in the condensing unit 20 by arbitrarily setting the locations, at each of which the communication hole 201*m*, 201*n*, 201*o*, 201*p* is not formed as shown at the portions C1-C3 of FIG. 7.

For example, by setting the presence/absence of the communication hole 201*m*, 201*n*, 201*o*, 201*p* (see FIGS. 5 and 6) in a manner shown in FIG. 7, the connection relationship among the condensing flow passages 201*c* according to the present embodiment can be easily implemented. That is, it can be easily implemented that the condensing constituent groups 204*a*-204*d*, in each of which the one or two or more of the condensing flow passages 201*c* are formed, are connected in series along the refrigerant flow, and the two or more of the condensing flow passages 201*c* are connected in parallel in each of the corresponding ones of the condensing constituent groups 204*a*-204*d*.

Further, although different from the present embodiment, depending on the setting of the locations, at each of which the communication hole 201*m*, 201*n*, 201*o*, 201*p* is not formed, it can be easily implemented that all of the condensing flow passages 201*c* of the condensing unit 20 are connected in series along the refrigerant flow.

In this way, the refrigerant distribution among the condensing flow passages 201*c* can be improved over, for example, the previously proposed heat exchanger described above. The improvement of the refrigerant distribution is, in other words, the suppression of the variation in the refrigerant flow rate.

This point will be further explained. That is, for example, in a case where all of the condensing flow passages 201*c* of the condensing unit 20 are connected in parallel, when the number of the condensing constituents 201 stacked one after another is increased, the distributability of the refrigerant to the condensing flow passages 201*c* is deteriorated. In short, the variation in the flow rate of the refrigerant becomes large in the distribution of the refrigerant to the respective condensing flow passages 201*c*. In contrast, since the structure of the heat exchanger 10 of the present embodiment is not limited to that all of the condensing flow passages 201*c* are connected in parallel along the refrigerant flow, it is possible to avoid the deterioration in the distributability of the refrigerant to the condensing flow passages 201*c* even when the number of the condensing constituents 201 stacked one after another is increased.

Furthermore, this is also true with respect to the evaporating flow passages 221*c*. Specifically, as shown in FIGS. 2 and 8, the structure of the heat exchanger 10 is not limited to that all of the evaporating flow passages 221*c* are connected in parallel along the refrigerant flow. Therefore, in the present embodiment, the connection relationship among the evaporating flow passages 221*c* can be easily set to a desirable relationship in the evaporating unit 22 by arbitrarily setting the locations (see the portions E1-E3 of FIG. 8), at each of which the communication hole 221*m*, 221*n*, 221*o*, 221*p* is not formed.

Therefore, like the refrigerant distribution among the condensing flow passages 201*c*, the refrigerant distribution among the evaporating flow passages 221*c* can be improved over, for example, the previously proposed heat exchanger described above. It should be noted that the ability to avoid the deterioration in the distributability of the refrigerant is particularly effective in the evaporating unit 22 rather than in the condensing unit 20. Furthermore, the presence/absence of the communication hole 201*m*-201*p*, 221*m*-221*p* can be easily selected depending on the presence/absence of the hole drilling step at the time of manufacturing the primary plate members 381 and the secondary plate members 382.

Furthermore, in the case where all of the condensing flow passages 201*c* are connected in parallel along the refrigerant flow like in the previously proposed heat exchanger described above, although the pressure loss in the condensing unit 20 can be reduced, it is difficult to optimize the flow speed of the refrigerant in the condensing flow passages 201*c*. Therefore, in such a case, the heat transfer coefficient between the refrigerant and the member in contact with the refrigerant is reduced, and thereby it is difficult to optimize the cooling capacity or the heating capacity.

In contrast, in the heat exchanger 10 of the present embodiment, the locations, at each of which the communication hole 201*m*, 201*n*, 201*o*, 201*p* is not formed, can be easily set such that the refrigerant flow speed, which can optimize the cooling capacity or the heating capacity, is obtained.

With respect to such optimization of the cooling capacity or the heating capacity, the same effect and advantage, which are the same as those discussed above, can be obtained in the evaporating unit 22.

Furthermore, at the time of manufacturing the heat exchanger 10 of the present embodiment, the heat exchanger 10 can be assembled by alternately stacking the primary plate members 381 and the secondary plate members 382 while one of the one-side side plate portion 30 and the other-side side plate portion 32 is used as the base for the primary plate members 381 and the secondary plate members 382. That is, the heat exchanger 10 can be assembled in one direction by stacking and assembling the constituent members in the one direction. As a result, the manufacturing work of the heat exchanger 10 becomes simple, and thereby the cost of the heat exchanger 10 can be reduced.

Furthermore, as shown in FIGS. 2, 5 and 6, the condensing unit 20, the evaporating unit 22 and the outer tube portion 281 of the internal heat exchanging unit 28 are integrated together by the primary and secondary plate members 381, 382. Therefore, in comparison to a case where these components are separately formed, the size and the cost of the heat exchanger 10 can be easily reduced. Furthermore, the condensed water, which is generated in the evaporating unit 22, can be guided to the condensing unit 20 along the primary and secondary plate members 381, 382, so that it is possible to limit disadvantages, such as splashing of the condensed water. Therefore, it is possible to reduce the loss of the condensed water which contributes to the heat releasing of the condensing unit 20. This leads to the higher performance of the heat exchanger 10.

In addition, the one-side condensing plate portion 201*d* and the one-side evaporating plate portion 221*d* can be formed by a single die device, and the one-side condensing plate portion 201*d* and the one-side evaporating plate portion 221*d* can be shaped into different shapes (e.g., optimum shapes). This is also true for the other-side condensing plate portion 201*h* and the other-side evaporating plate portion 221*h*. Therefore, this also makes it possible to improve the performance of the heat exchanger 10 and reduce the cost of the heat exchanger 10.

Furthermore, according to the present embodiment, as shown in FIGS. 2, 7 and 8, the other-side side plate portion 32 includes the flow restricting portion 321*e* that functions as the pressure reducing portion for reducing the pressure of the refrigerant, and this flow restricting portion 321*e* is located between the condensing unit outlet 202*a* and the evaporating unit inlet 222*a* along the refrigerant flow. Therefore, it is possible to limit an increase in the size of the heat exchanger 10 including the flow restricting portion 321*e*. Furthermore, in comparison to, for example, the previously proposed heat exchanger described above, in which a large number of flow passage units are stacked, the flow restricting portion 321*e* can be easily constructed.

More specifically, for example, in the previously proposed heat exchanger described above, in which the large number of the flow passage units are stacked, the same number of flow restricting portions as the number of the flow passage units stacked one after another are provided in parallel along the refrigerant flow. However, in order to obtain an appropriate pressure reducing effect for the refrigerant, a finer and more accurate shape of each flow restricting portion is required as the number of flow restricting portions connected in parallel is increased. In such a case, due to variations in, for example, processing and brazing of the members, variations in the shape among the flow restricting portions are likely to occur. Therefore, in the previously proposed heat exchanger described above, a reduction in the cooling/heating performance is likely to occur due to the variations in the shape among the flow restricting portions.

In contrast, in the present embodiment, it is not required to provide the flow restricting portion 321*e* as a plurality of flow restricting portions connected in parallel. Thus, in comparison to the previously proposed heat exchanger described above, the flow restricting portion 321*e* can be configured in the simple form as described above, and thereby it is possible to avoid a reduction in the cooling/heating performance. Then, the flow restricting portion 321*e* can be provided as, for example, one simple flow restricting portion.

Furthermore, since the other-side side plate portion 32 includes the flow restricting portion 321*e*, it is possible to integrally braze the condensing unit 20, the evaporating unit 22 and the flow restricting portion 321*e* together. Therefore, it is possible to limit an increase in the size of the integrated body in which the condensing unit 20, the evaporating unit 22 and the flow restricting portion 321*e* are integrated together. Furthermore, it is possible to reduce the cost of the heat exchanger 10 including the flow restricting portion 321*e*. Furthermore, at the time of manufacturing the heat exchanger 10, the heat exchanger 10 can be assembled in the one direction described above.

Further, according to the present embodiment, as shown in FIG. 2, the stacking direction Ds is a direction that intersects the gravity direction Dg. The condensing unit 20 is placed on the lower side of the evaporating unit 22. Therefore, the heat releasing performance of the condensing unit 20 can be improved by a watering effect that applies the condensed water generated at the evaporating unit 22 to the condensing unit 20 by the action of gravity. Furthermore, since the evaporation process of evaporating the condensed water generated at the evaporating unit 22 by the heat of the condensing unit 20 can be performed, it is possible to eliminate or reduce the drain water which is the discharged condensed water.

Further, according to the present embodiment, as shown in FIGS. 2, 5 and 6, each of the condensing constituents 201 includes the pair of condensing plate portions 201*d*, 201*h* each of which is shaped in the form of plate. Each of the condensing constituents 201 is formed by stacking the pair of condensing plate portions 201*d*, 201*h* in the stacking direction Ds and joining the pair of condensing plate portions 201*d*, 201*h* together such that the condensing flow passage 201*c* is formed between the pair of condensing plate portions 201*d*, 201*h*. Therefore, each of the condensing constituents 201 can have the simple structure. At the same time, depending on the shape of the internal space of the condensing constituent 201, such as the shape of the condensing flow passage 201*c*, there is a merit that it is easy to make the component of the one-side condensing plate portion 201*d* and the component of the other-side condensing plate portion 201*h* as the common component.

Further, according to the present embodiment, each of the evaporating constituents 221 includes the pair of evaporating plate portions 221*d*, 221*h* each of which is shaped in the form of plate. Each of the evaporating constituents 221 is formed by stacking the pair of evaporating plate portions 221*d*, 221*h* in the stacking direction Ds and joining the pair of evaporating plate portions 221*d*, 221*h* together such that the evaporating flow passage 221*c* is formed between the pair of evaporating plate portions 221*d*, 221*h*. Therefore, each of the evaporating constituents 221 can have the simple structure. At the same time, depending on the shape of the internal space of the evaporating constituent 221, such as the shape of the evaporating flow passage 221*c*, there is a merit that it is easy to make the component of the one-side evaporating plate portion 221*d* and the component of the other-side evaporating plate portion 221*h* as the common component.

Furthermore, according to the present embodiment, the one-side condensing plate portion 201*d*, the one-side evaporating plate portion 221*d* and the primary outer tube constituent 281*a* form the primary plate member 381. Furthermore, the other-side condensing plate portion 201*h*, the other-side evaporating plate portion 221*h* and the secondary outer tube constituent 281*b* form the secondary plate member 382.

Therefore, the condensing unit 20, the evaporating unit 22 and the outer tube portion 281 of the internal heat exchanging unit 28 can be integrated together by the primary plate members 381 and the secondary plate members 382 in addition to the one-side and other-side side plate portions 30, 32 respectively placed at the two opposite sides.

Furthermore, the condensing unit 20, the evaporating unit 22 and the outer tube portion 281 of the internal heat exchanging unit 28 can support with each other not only by the one-side and other-side side plate portions 30, 32 respectively placed at the two opposite sides but also by the primary plate members 381 and the secondary plate members 382. Therefore, the heat exchanger 10 can be made more robust in comparison to the case where the condensing unit 20, the evaporating unit 22 and the outer tube portion 281 of the internal heat exchanging unit 28 are coupled together only by, for example, the one-side and other-side side plate portions 30, 32 respectively placed at the two opposite sides.

Furthermore, according to the present embodiment, the outlet-side condensing constituent 202 is the outermost condensing constituent located at the end of the stack of the condensing constituents 201 on the one side in the stacking direction Ds. Furthermore, the inlet-side evaporating constituent 222 is the outermost evaporating constituent located at the end of the stack of the evaporating constituents 221 on the other side in the stacking direction Ds. Therefore, as compared with the case where the inlet-side evaporating constituent 222 is not arranged in this way, it is easy to provide the refrigerant flow path from the condensing unit outlet 202*a* to the evaporating unit inlet 222*a*. Thus, the refrigerant flow path can be easily simplified. For example, it is possible to provide the refrigerant flow path from the condensing unit outlet 202*a* to the evaporating unit inlet 222*a* by using the side plate portions 30, 32.

Furthermore, according to the present embodiment, as shown in FIGS. 2, 5 and 6, the heat exchanger 10 includes the internal heat exchanging unit 28, and the primary plate members 381 and the secondary plate members 382 form a portion of the internal heat exchanging unit 28. Therefore, in comparison to a case where, for example, the internal heat exchanging unit 28 is formed separately from the plate members 381, 382, an increase in the size of the heat exchanger 10 caused by the provision of the internal heat exchanging unit 28 can be limited, and the number of the components can be reduced.

Furthermore, in the present embodiment, the evaporating unit 22, the internal heat exchanging unit 28 and the condensing unit 20 are arranged in this order in the gravity direction Dg. The primary plate member 381 has the primary outer tube constituent 281*a*, which forms a portion of the internal heat exchanging unit 28, at the location between the one-side condensing plate portion 201*d* and the one-side evaporating plate portion 221*d*. Furthermore, the secondary plate member 382 has the secondary outer tube constituent 281*b*, which forms the portion of the internal heat exchanging unit 28, at the location between the other-side condensing plate portion 201*h* and the other-side evaporating plate portion 221*h*. Therefore, for example, in comparison to a case where each of the plate members 381, 382 has a structure which is different from the above-described one, the refrigerant flow passage, which connects between the evaporating unit 22 and the internal heat exchanging unit 28, and the refrigerant flow passage, which connects between the condensing unit 20 and the internal heat exchanging unit 28, are less unlikely to overlap each other.

Furthermore, in the present embodiment, as shown in FIGS. 2 and 8, the one-side side plate portion 30 is formed by stacking the one-side primary plate 301, the one-side secondary plate 302 and the one-side tertiary plate 303 in the stacking direction Ds. The gas-liquid separating device 26 of the one-side side plate portion 30 includes the liquid storage space 26*a* which stores the liquid phase refrigerant. Furthermore, the liquid storage space 26*a* is formed by overlapping the gas-liquid separating through hole 301*c* of the one-side primary plate 301 and the gas-liquid separating through hole 302*c* of the one-side secondary plate 302 with each other and covering the one side of the liquid storage space 26*a* in the stacking direction Ds with the one-side tertiary plate 303.

In short, the through holes 301*c*, 302*c* formed in the plates 301, 302 of the one-side side plate portion 30 overlap with each other, and the one side of the liquid storage space 26*a* is covered with the other plate 303 which is different from the plates 301, 302. Thereby, the liquid storage space 26*a* is formed.

Therefore, by using the thickness of the one-side side plate portion 30, it is possible to suppress the width of the gas-liquid separating device 26 in the stacking direction Ds, and it is possible to form the gas-liquid separating device 26 at the one-side side plate portion 30.

Second Embodiment

Next, a second embodiment will be described. In the present embodiment, differences with respect to the above-described first embodiment will be mainly described. In addition, description of components, which are the same or equivalent to those of the above-described embodiment will be omitted or simplified. This also applies to the description of the embodiments described later.

Figure 14:
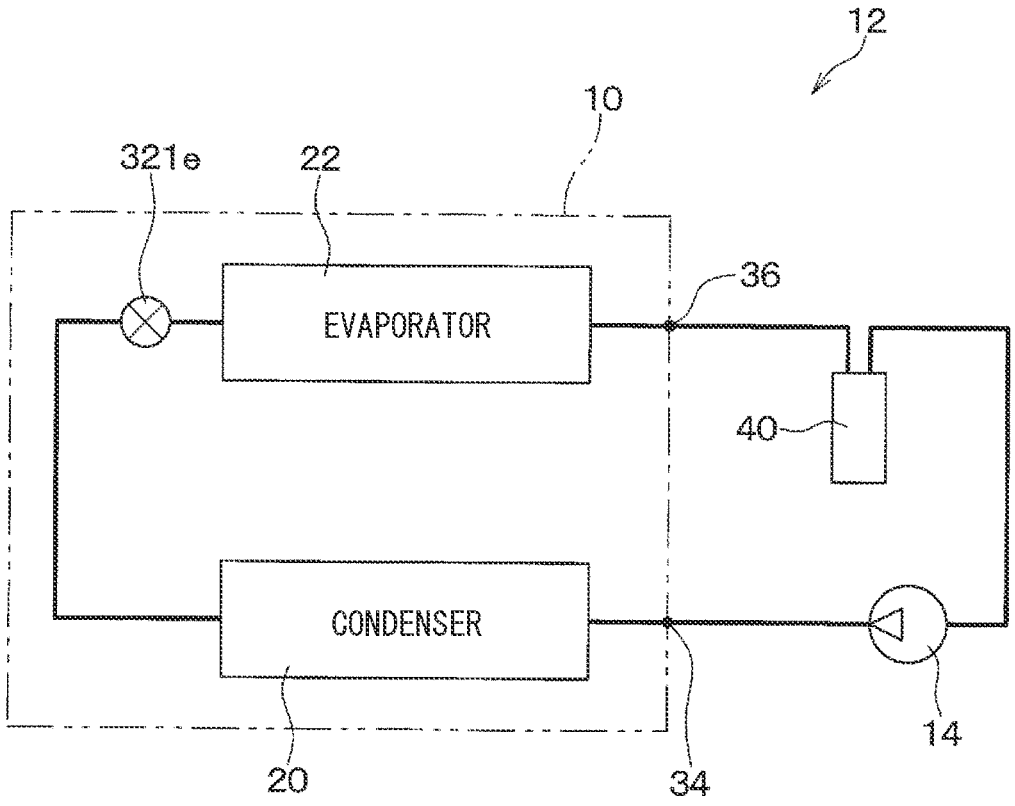
FIG. 14 is a refrigerant circuit diagram showing a refrigeration cycle circuit having a heat exchanger of a second embodiment and corresponding to FIG. 1.
Figure 15:
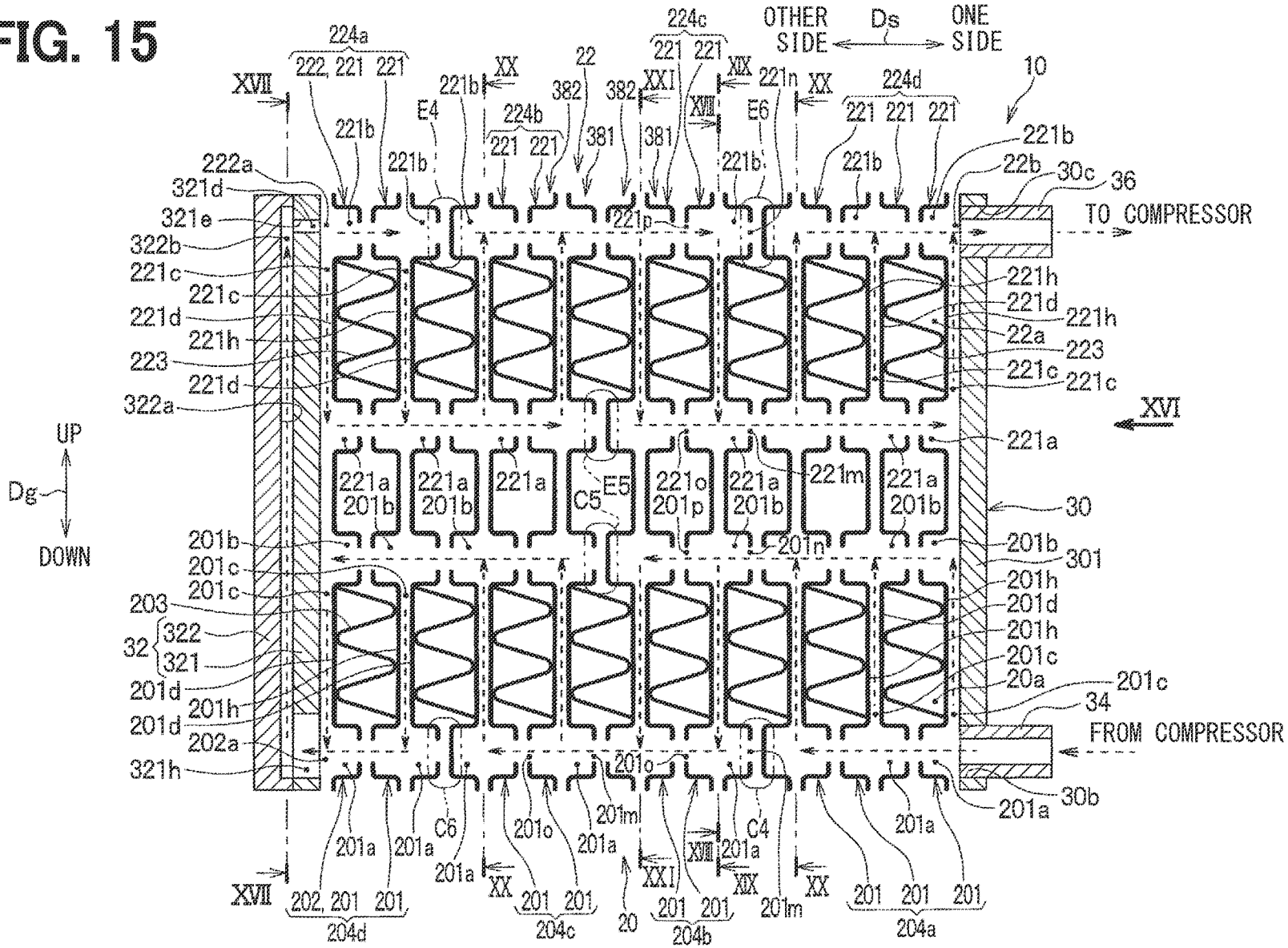
FIG. 15 is a cross-sectional view, schematically showing a structure of the heat exchanger of the second embodiment and corresponding to FIG. 2.

As shown in FIGS. 14 and 15, the heat exchanger 10 of the present embodiment includes the condensing unit 20, the evaporating unit 22 and the flow restricting portion 321*e* like in the first embodiment. However, the heat exchanger 10 of the present embodiment does not include the gas-liquid separating device 26 (see FIG. 2) and the internal heat exchanging unit 28 unlike the first embodiment. Due to the absence of the internal heat exchanging unit 28, although the primary plate member 381 includes the one-side condensing plate portion 201*d* and the one-side evaporating plate portion 221*d*, the primary plate member 381 does not include the primary outer tube constituent 281*a* (see FIG. 2). Furthermore, although the secondary plate member 382 includes the other-side condensing plate portion 201*h* and the other-side evaporating plate portion 221*h*, the secondary plate member 382 does not include the secondary outer tube constituent 281*b* (see FIG. 2).

In FIG. 15, the cross sections of the primary plate member 381, the secondary plate member 382, the condensing unit fins 203 and the evaporating unit fin 223 are shown by bold lines instead of hatching. Further, in order to make the illustration easy to see, FIG. 15 indicates a deliberate gap (that is, an actually non-existing gap) between each adjacent two among the primary plate member 381, the secondary plate member 382, the one-side side plate portion 30 and the other-side side plate portion 32. This also applies to the drawings which correspond to FIG. 15 and are described later.

The refrigeration cycle circuit 12 of the present embodiment includes a gas-liquid separator 40, which corresponds to the gas-liquid separating device 26 of the first embodiment as a separate device that is provided separately from the heat exchanger 10. The gas-liquid separator 40 is an accumulator that has the same function as the gas-liquid separating device 26. The gas-liquid separator 40 is located on the downstream side of the outlet pipe 36 of the heat exchanger 10 and on the upstream side of the compressor 14 along the refrigerant flow.

Figure 16:
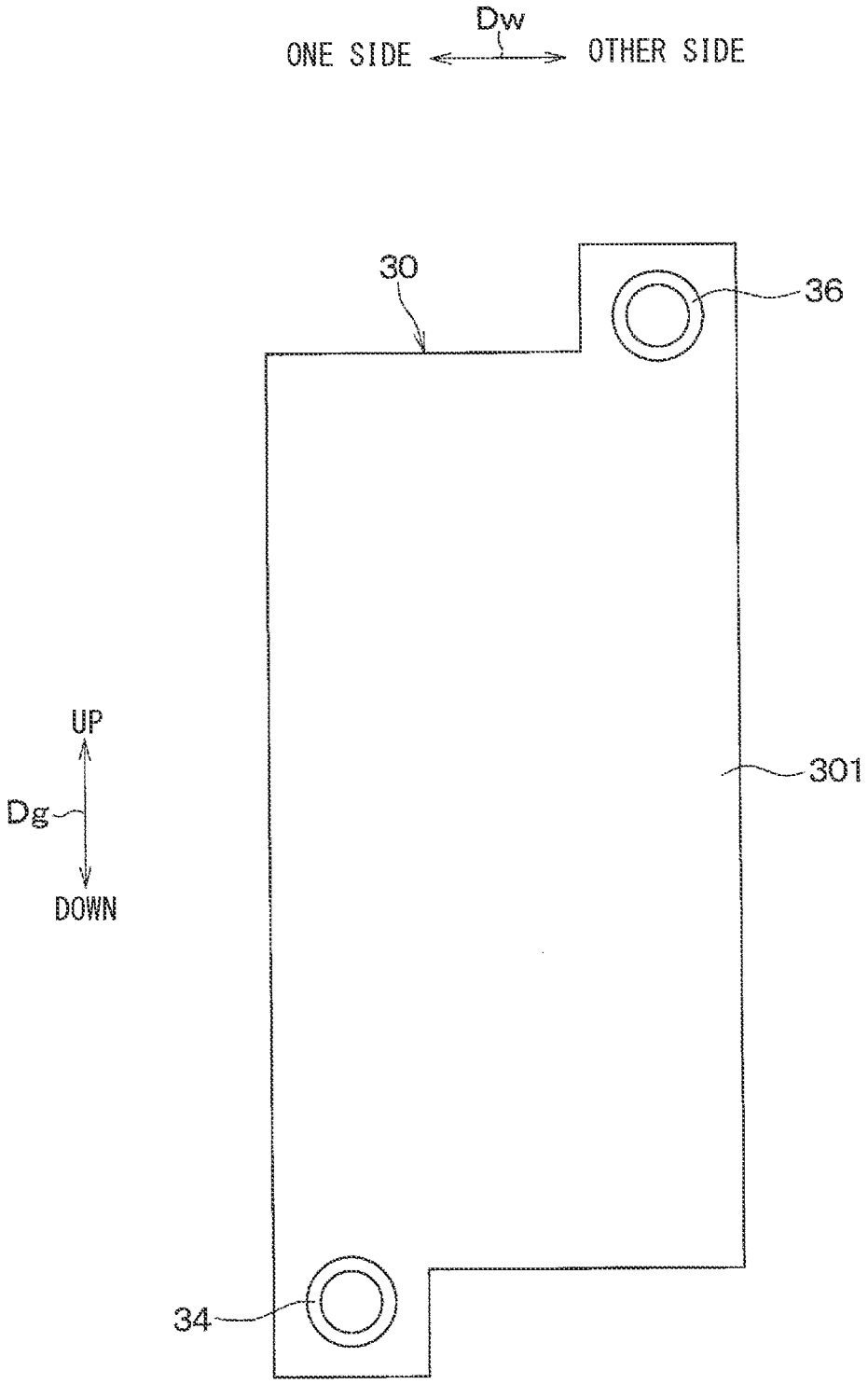
FIG. 16 is a view showing a one-side side plate portion of the second embodiment viewed in a direction of an arrow XVI in FIG. 15.

As shown in FIGS. 15 and 16, in the present embodiment, the one-side side plate portion 30 has a single-layer stack structure rather than a multilayer stack structure in which a plurality of plates are stacked. That is, the one-side side plate portion 30 of the present embodiment is formed by the one-side primary plate 301 and does not include the one-side secondary plate 302 and the one-side tertiary plate 303 (see FIG. 2) of the first embodiment.

The inlet pipe 34 is inserted into a lower-side through hoe 30*b*, which is formed at a lower portion of the one-side side plate portion 30, and the inlet pipe 34 is joined to the one-side side plate portion 30 at the lower-side through hoe 30*b* by brazing. In this way, the inlet pipe 34 is connected to the condensing unit 20 such that the inlet pipe 34 is communicated with an inside of the condensing unit 20.

Furthermore, the outlet pipe 36 is inserted into an upper-side through hoe 30*c*, which is formed at an upper portion of the one-side side plate portion 30, and the outlet pipe 36 is joined to the one-side side plate portion 30 at the upper-side through hoe 30*c* by brazing. In this way, the outlet pipe 36 is connected to the evaporating unit 22 such that the outlet pipe 36 is communicated with an inside of the evaporating unit 22.

Figure 17:
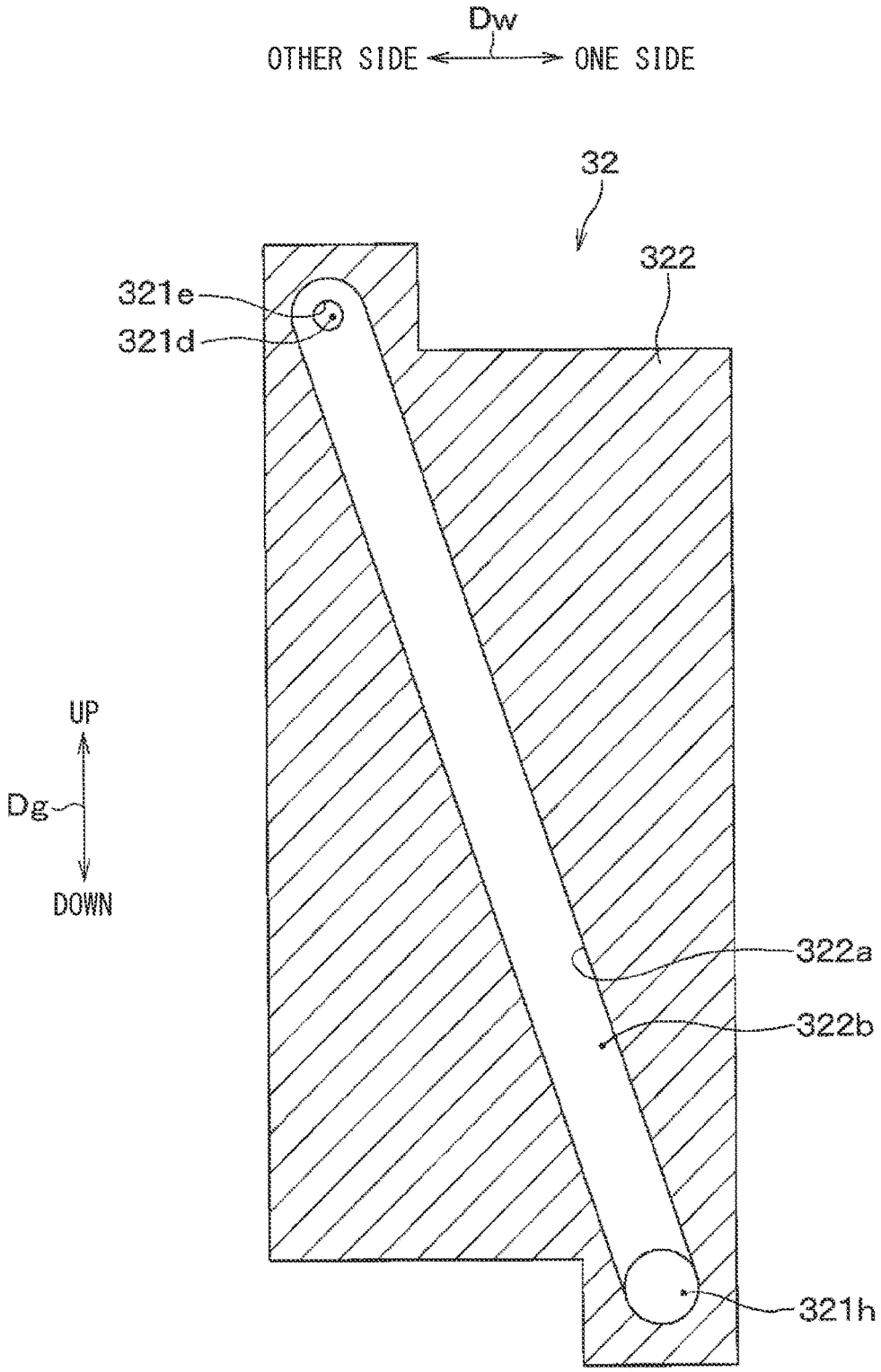
FIG. 17 is a cross-sectional view taken along line XVII-XVII in FIG. 15, showing an other-side side plate portion of the second embodiment.

As shown in FIGS. 15 and 17, the other-side side plate portion 32 includes the other-side primary plate 321 and the other-side secondary plate 322 which are stacked one after another and are joined together.

The other-side primary plate 321 includes the flow restricting portion 321*e* like in the first embodiment. In addition, the other-side primary plate 321 includes a condensing unit outlet hole 321*h* that is a through hole formed at a lower portion of the other-side primary plate 321. The condensing unit outlet hole 321*h* is communicated with the condensing unit outlet 202*a*.

The other-side secondary plate 322 includes a groove 322*a* that is recessed from the one side toward the other side in the stacking direction Ds and extends in the gravity direction Dg. The other-side secondary plate 322 is joined to the other side of the other-side primary plate 321 in the stacking direction Ds by brazing, so that the groove 322*a* of the other-side secondary plate 322 forms a transverse relay flow passage 322*b* between the groove 322*a* of the other-side secondary plate 322 and the other-side primary plate 321.

The transverse relay flow passage 322*b* extends in the gravity direction Dg and is formed between the condensing unit outlet hole 321*h* and the flow restricting hole 321*d* of the other-side primary plate 321 along the refrigerant flow. That is, the transverse relay flow passage 322*b* is a flow passage that connects between the condensing unit outlet 202*a* of the condensing unit 20 and the flow restricting hole 321*d*. With the flow passage structure for the refrigerant described above, the flow restricting portion 321*e* of the other-side side plate portion 32 is located between the condensing unit outlet 202*a* and the evaporating unit inlet 222*a* along the refrigerant flow.

As shown in FIG. 15, even in the present embodiment, like in the first embodiment, the condensing constituent 201 and the evaporating constituent 221, which are arranged one after another in the gravity direction Dg, are formed by stacking the pair of plate members 381, 382 in the stacking direction Ds and joining the pair of plate members 381, 382 together. Among the pair of plate members 381, 382, the primary plate member 381 is located on the one side of the secondary plate member 382 in the stacking direction Ds.

Figure 18:
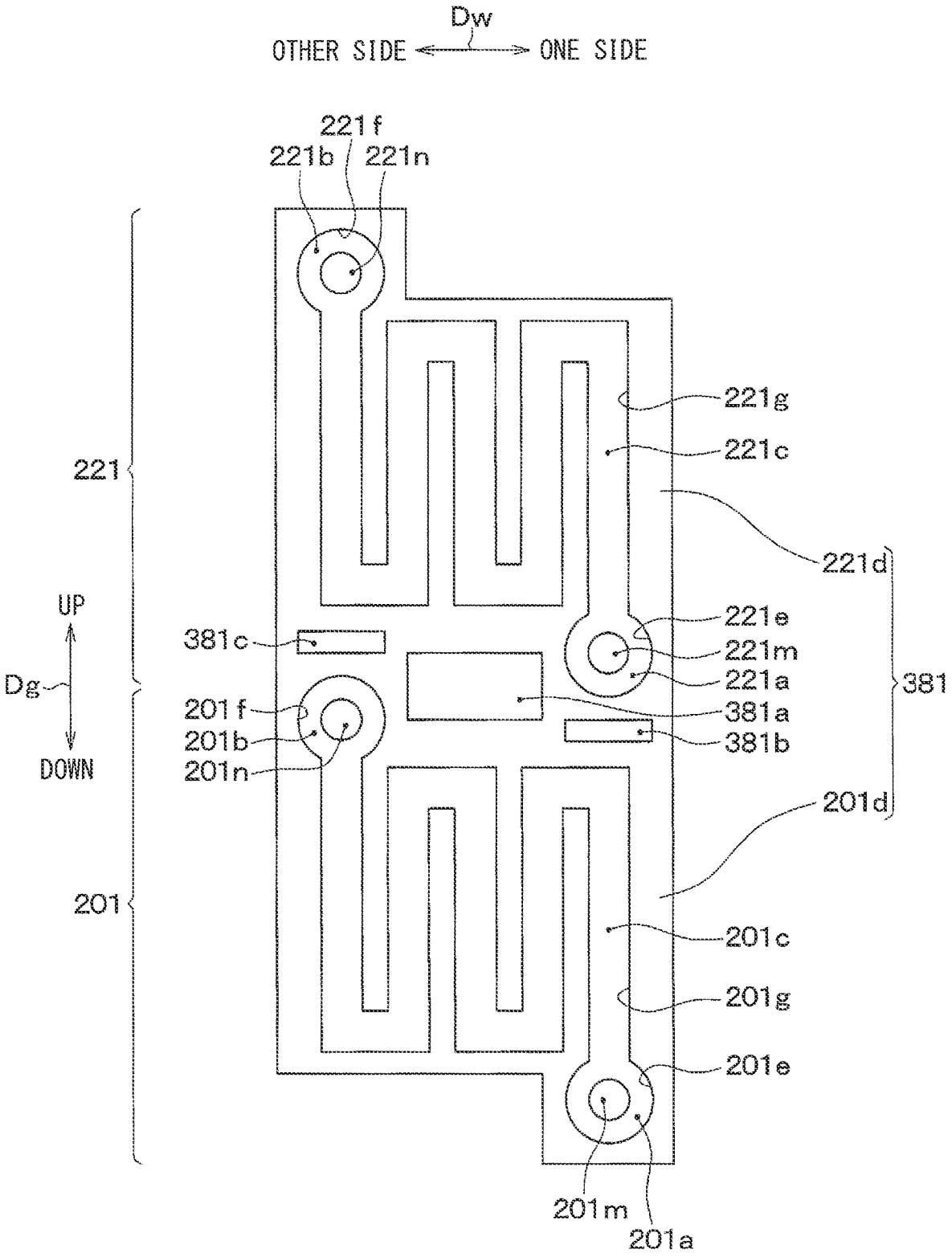
FIG. 18 is a cross-sectional view taken along line XVIII-XVIII in FIG. 15, showing a primary plate member of the second embodiment.
Figure 19:
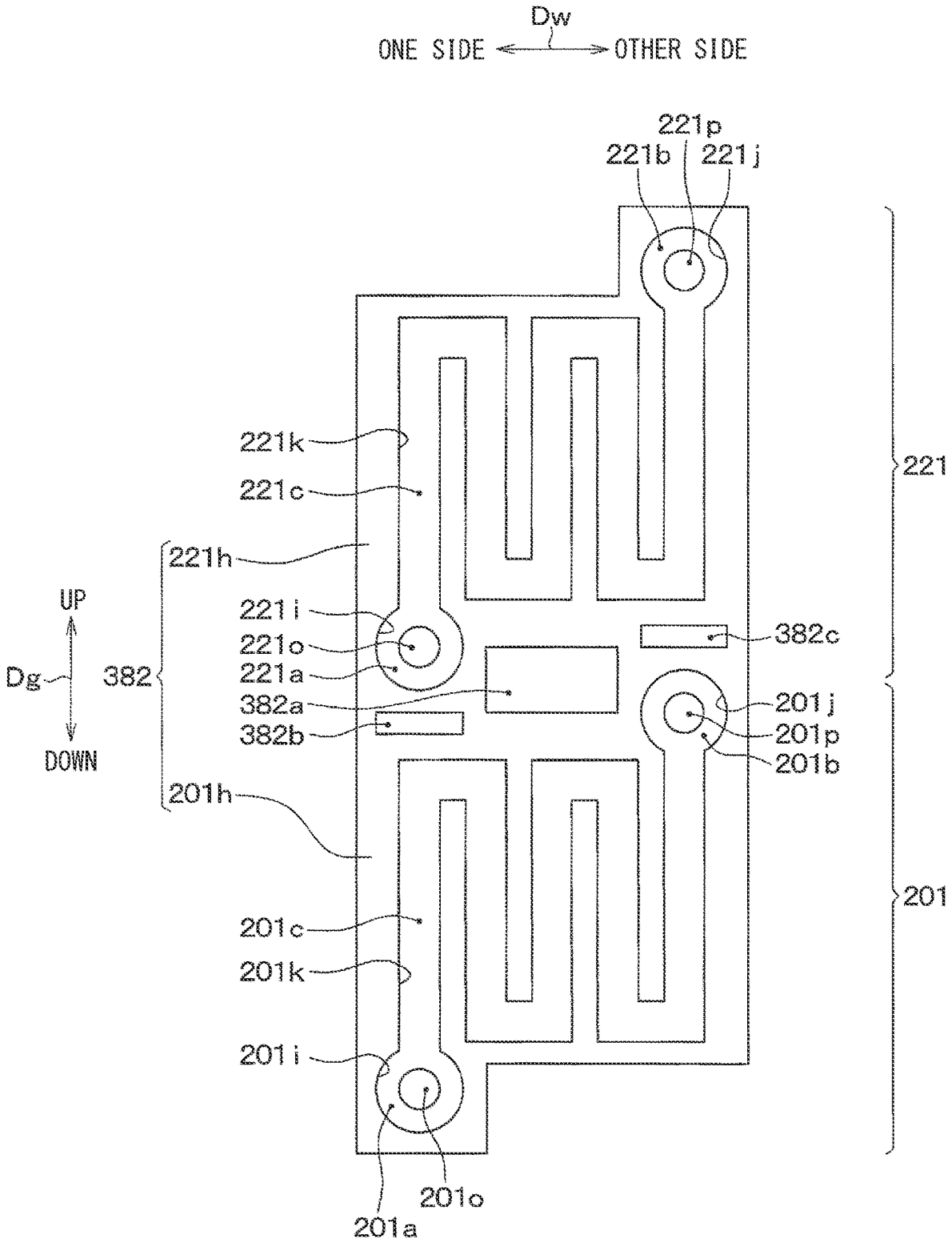
FIG. 19 is a cross-sectional view taken along line XIX-XIX in FIG. 15, showing a secondary plate member of the second embodiment.

However, in the present embodiment, as shown in FIGS. 18 and 19, the one-side condensing tank space 201*a* is located on the lower side of the condensing flow passage 201*c* in the gravity direction Dg, and the other-side condensing tank space 201*b* is located on the upper side of the condensing flow passage 201*c* in the gravity direction Dg. Furthermore, the one-side evaporating tank space 221*a* is located on the lower side of the evaporating flow passage 221*c* in the gravity direction Dg, and the other-side evaporating tank space 221*b* is located on the upper side of the evaporating flow passage 221*c* in the gravity direction Dg.

Furthermore, a plurality of heat insulation holes 381*a*, 381*b*, 381*c*, which are through holes, are formed at the primary plate member 381 to interfere with the transmission of the heat between the refrigerant in the condensing constituent 201 and the refrigerant in the evaporating constituent 221. Likewise, a plurality of heat insulation holes 382*a*, 382*b*, 382*c*, which are through holes, are formed at the secondary plate member 382.

As shown in FIG. 15, the condensing unit 20 of the present embodiment includes the first condensing constituent group 204*a*, the second condensing constituent group 204*b*, the third condensing constituent group 204*c* and the fourth condensing constituent group 204*d*. The first condensing constituent group 204*a*, the second condensing constituent group 204*b*, the third condensing constituent group 204*c* and the fourth condensing constituent group 204*d* are arranged in this order from the one side toward the other side in the stacking direction Ds. The first condensing constituent group 204*a*, the second condensing constituent group 204*b*, the third condensing constituent group 204*c* and the fourth condensing constituent group 204*d* are connected in series in this order from the upstream side toward the downstream side along the refrigerant flow in the condensing unit 20.

Furthermore, in each of the condensing constituent groups 204*a*-204*d*, the plurality of condensing flow passages 201*c* are connected in parallel along the refrigerant flow.

In order to realize such a refrigerant flow path, as shown in a portion C4 of FIG. 15, the primary communication hole 2010 is not formed in the outermost other-side condensing plate portion 201*h* that is located at an end of the first condensing constituent group 204*a* on the other side in the stacking direction Ds. Furthermore, as shown in a portion C5, the secondary communication hole 201*p* is not formed in the outermost other-side condensing plate portion 201*h* that is located at an end of the second condensing constituent group 204*b* on the other side in the stacking direction Ds. Furthermore, as shown in a portion C6, the primary communication hole 2010 is not formed in the outermost other-side condensing plate portion 201*h* that is located at an end of the third condensing constituent group 204*c* on the other side in the stacking direction Ds.

Figure 20:
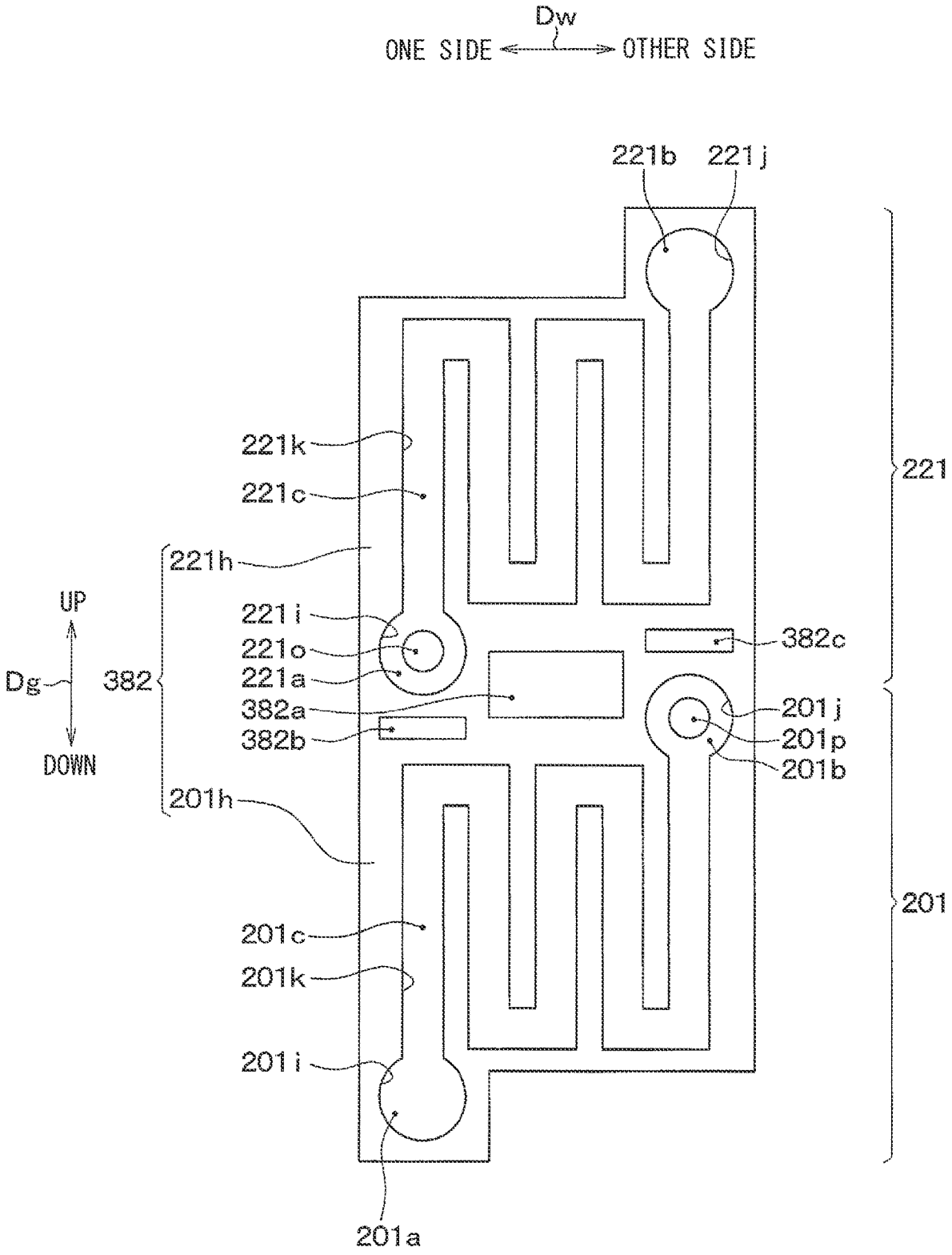
FIG. 20 is a cross-sectional view taken along line XX-XX in FIG. 15 corresponding to FIG. 19 and showing a structure of the secondary plate member of FIG. 19, in which a primary communication hole is not formed in an other-side condensing plate portion, and a secondary communication hole is not formed in an other-side evaporating plate portion.
Figure 21:
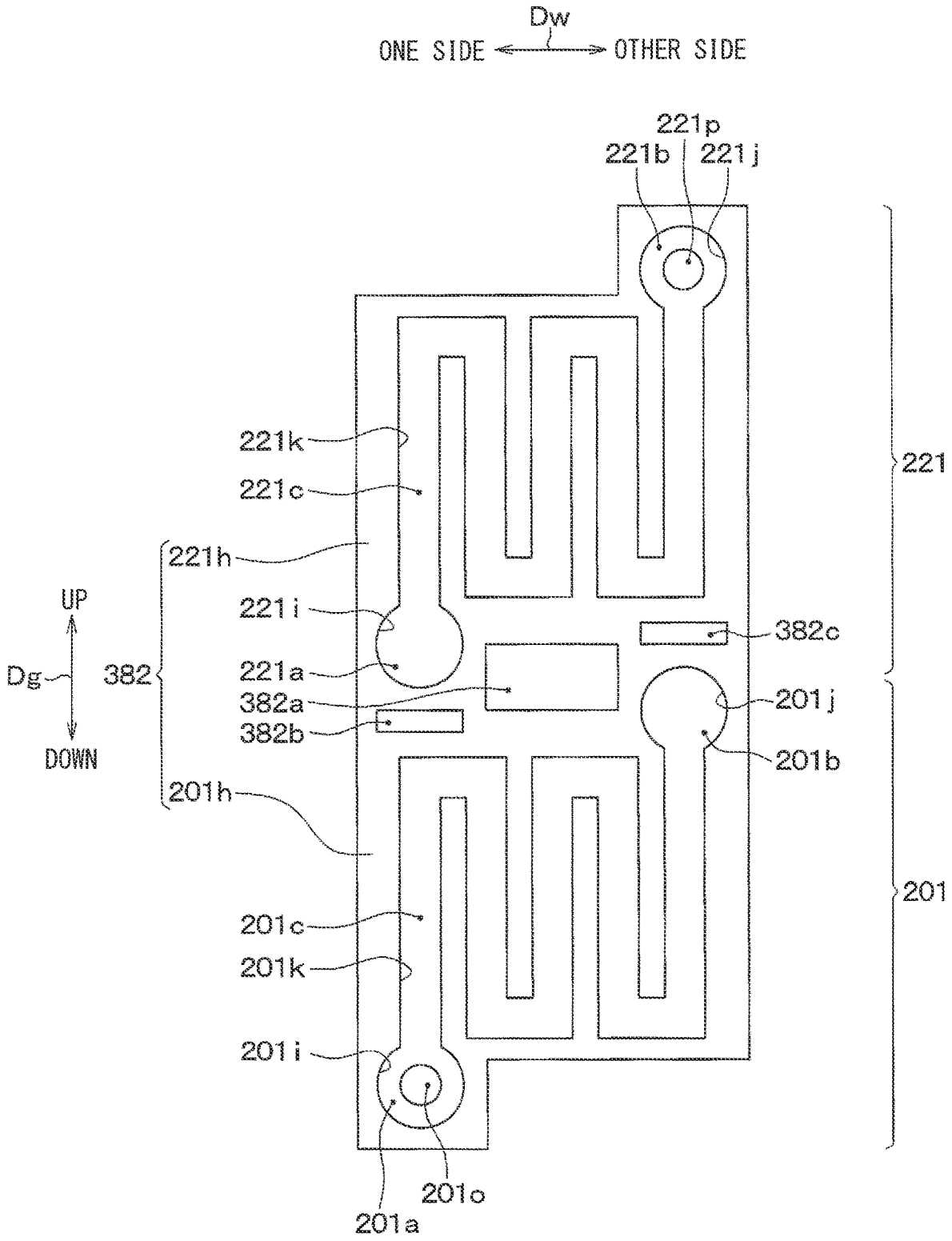
FIG. 21 is a cross-sectional view taken along line XXI-XXI in FIG. 15 corresponding to FIG. 19 and showing a structure of the secondary plate member of FIG. 19, in which a secondary communication hole is not formed in the other-side condensing plate portion, and a primary communication hole is not formed in the other-side evaporating plate portion.

For example, the other-side condensing plate portion 201*h*, in which the secondary communication hole 201*p* is formed but the primary communication hole 2010 is not formed, is shown in FIG. 20. Furthermore, the other-side condensing plate portion 201*h*, in which the primary communication hole 2010 is formed but the secondary communication hole 201*p* is not formed, is shown in FIG. 21.

As shown in FIG. 15, in the present embodiment, the evaporating constituent groups 224*a*-224*d*, which are included in the evaporating unit 22, include a first evaporating constituent group 224*a*, a second evaporating constituent group 224*b*, a third evaporating constituent group 224*c* and a fourth evaporating constituent group 224*d*.

In the evaporating unit 22 of the present embodiment, the first evaporating constituent group 224*a*, the second evaporating constituent group 224*b*, the third evaporating constituent group 224*c* and the fourth evaporating constituent group 224*d* are arranged in this order from the other side toward the one side in the stacking direction Ds. The first evaporating constituent group 224*a*, the second evaporating constituent group 224*b*, the third evaporating constituent group 224*c* and the fourth evaporating constituent group 224*d* are connected in series in this order from the upstream side toward the downstream side along the refrigerant flow in the evaporating unit 22.

In each of the evaporating constituent groups 224*a*-224*d*, the evaporating flow passages 221*c* are connected in parallel along the refrigerant flow.

In order to realize such a refrigerant flow path, as shown in a portion E4 of FIG. 15, the secondary communication hole 221*p* is not formed in the outermost other-side evaporating plate portion 221*h* that is located at an end of the second evaporating constituent group 224*b* on the other side in the stacking direction Ds. Furthermore, as shown in a portion E5, the primary communication hole 2210 is not formed in the outermost other-side evaporating plate portion 221*h* that is located at an end of the third evaporating constituent group 224*c* on the other side in the stacking direction Ds. Furthermore, as shown in a portion E6, the secondary communication hole 221*p* is not formed in the outermost other-side evaporating plate portion 221*h* that is located at an end of the fourth evaporating constituent group 224*d* on the other side in the stacking direction Ds.

For example, the other-side evaporating plate portion 221*h*, in which the primary communication hole 2210 is formed but the secondary communication hole 221*p* is not formed, is shown in FIG. 20. For example, the other-side evaporating plate portion 221*h*, in which the secondary communication hole 221*p* is formed but the primary communication hole 2210 is not formed, is shown in FIG. 21.

The refrigerant flows as follows in the heat exchanger 10 and the refrigeration cycle circuit 12 of the present embodiment. Broken arrows shown in FIG. 15 indicate the refrigerant flow in the heat exchanger 10.

First of all, as shown in FIGS. 14 and 15, the refrigerant discharged from the compressor 14 is inputted into an upstream-side space, which is formed by the one-side condensing tank spaces 201*a* connected one after another in the first condensing constituent group 204*a* of the condensing unit 20, through the inlet pipe 34. The refrigerant, which flows into the upstream-side space of the first condensing constituent group 204*a*, flows toward the other side in the stacking direction Ds in the upstream-side space and at the same time is distributed to the condensing flow passages 201*c*. The refrigerant flows in parallel in the condensing flow passages 201*c* and at the same time exchanges the heat with the air around the condensing constituents 201 to release the heat to the air.

Then, the refrigerant flows from the condensing flow passages 201*c* into a downstream-side space which is formed by the other-side condensing tank spaces 201*b* connected one after another. Furthermore, the refrigerant flows from the downstream-side space of the first condensing constituent group 204*a* into an upstream-side space which is formed by the other-side condensing tank spaces 201*b* connected one after another in the second condensing constituent group 204*b*. The refrigerant, which flows into the upstream-side space of the second condensing constituent group 204*b*, flows toward the other side in the stacking direction Ds in the upstream-side space and at the same time is distributed to the condensing flow passages 201*c*. The refrigerant flows in parallel in the condensing flow passages 201*c* and at the same time exchanges the heat with the air around the condensing constituents 201 to release the heat to the air.

Then, the refrigerant flows from the condensing flow passages 201*c* into a downstream-side space which is formed by the one-side condensing tank spaces 201*a* connected one after another. Furthermore, the refrigerant flows from the downstream-side space of the second condensing constituent group 204*b* into an upstream-side space which is formed by the one-side condensing tank spaces 201*a* connected one after another in the third condensing constituent group 204*c*. The refrigerant, which flows into the upstream-side space of the third condensing constituent group 204*c*, flows toward the other side in the stacking direction Ds in the upstream-side space and at the same time is distributed to the condensing flow passages 201*c*. The refrigerant flows in parallel in the condensing flow passages 201*c* and at the same time exchanges the heat with the air around the condensing constituents 201 to release the heat to the air.

Then, the refrigerant flows from the condensing flow passages 201*c* into a downstream-side space which is formed by the other-side condensing tank spaces 201*b* connected one after another. Furthermore, the refrigerant flows from the downstream-side space of the third condensing constituent group 204*c* into an upstream-side space which is formed by the other-side condensing tank spaces 201*b* connected one after another in the fourth condensing constituent group 204*d*. The refrigerant, which flows into the upstream-side space of the fourth condensing constituent group 204*d*, flows toward the other side in the stacking direction Ds in the upstream-side space and at the same time is distributed to the condensing flow passages 201*c*. The refrigerant flows in parallel in the condensing flow passages 201*c* and at the same time exchanges the heat with the air around the condensing constituents 201 to release the heat to the air.

Then, the refrigerant flows from the condensing flow passages 201*c* into a downstream-side space which is formed by the one-side condensing tank spaces 201*a* connected one after another. The refrigerant, which flows into the downstream-side space of the fourth condensing constituent group 204*d*, flows from the condensing unit outlet 202*a* into the transverse relay flow passage 322*b* through the condensing unit outlet hole 321*h* of the other-side side plate portion 32.

In the transverse relay flow passage 322*b*, the refrigerant flows from the lower side toward the upper side in the gravity direction Dg, and then this refrigerant flows from the transverse relay flow passage 322*b* into the evaporating unit 22 through the flow restricting hole 321*d* of the flow restricting portion 321*e*. At this time, when the refrigerant passes through the flow restricting hole 321*d*, the pressure of the refrigerant is reduced.

The refrigerant, which has passed through the flow restricting hole 321*d* of the flow restricting portion 321*e*, flows into the evaporating unit 22 through the evaporating unit inlet 222*a*. The refrigerant, which is inputted from the evaporating unit inlet 222*a* into the evaporating unit 22, first flows into an upstream-side space which is formed by the other-side evaporating tank spaces 221*b* connected one after another in the first evaporating constituent group 224*a*. The refrigerant, which flows into the upstream-side space of the first evaporating constituent group 224*a*, flows toward the one side in the stacking direction Ds in the upstream-side space and at the same time is distributed to the evaporating flow passages 221*c*. The refrigerant flows in parallel in the evaporating flow passages 221*c* and at the same time exchanges the heat with the air around the evaporating constituents 221 to absorb the heat from the air.

Then, the refrigerant flows from the evaporating flow passages 221*c* into a downstream-side space which is formed by the one-side evaporating tank spaces 221*a* connected one after another. Furthermore, the refrigerant flows from the downstream-side space of the first evaporating constituent group 224*a* into an upstream-side space which is formed by the one-side evaporating tank spaces 221*a* connected one after another in the second evaporating constituent group 224*b*. The refrigerant, which flows into the upstream-side space of the second evaporating constituent group 224*b*, flows toward the one side in the stacking direction Ds in the upstream-side space and at the same time is distributed to the evaporating flow passages 221*c*. The refrigerant flows in parallel in the evaporating flow passages 221*c* and at the same time exchanges the heat with the air around the evaporating constituents 221 to absorb the heat from the air.

Then, the refrigerant flows from the evaporating flow passages 221*c* into a downstream-side space which is formed by the other-side evaporating tank spaces 221*b* connected one after another. Furthermore, the refrigerant flows from the downstream-side space of the second evaporating constituent group 224*b* into an upstream-side space which is formed by the other-side evaporating tank spaces 221*b* connected one after another in the third evaporating constituent group 224*c*. The refrigerant, which flows into the upstream-side space of the third evaporating constituent group 224*c*, flows toward the one side in the stacking direction Ds in the upstream-side space and at the same time is distributed to the evaporating flow passages 221*c*. The refrigerant flows in parallel in the evaporating flow passages 221*c* and at the same time exchanges the heat with the air around the evaporating constituents 221 to absorb the heat from the air.

Then, the refrigerant flows from the evaporating flow passages 221*c* into a downstream-side space which is formed by the one-side evaporating tank spaces 221*a* connected one after another. Furthermore, the refrigerant flows from the downstream-side space of the third evaporating constituent group 224*c* into an upstream-side space which is formed by the one-side evaporating tank spaces 221*a* connected one after another in the fourth evaporating constituent group 224*d*. The refrigerant, which flows into the upstream-side space of the fourth evaporating constituent group 224*d*, flows toward the one side in the stacking direction Ds in the upstream-side space and at the same time is distributed to the evaporating flow passages 221*c*. The refrigerant flows in parallel in the evaporating flow passages 221*c* and at the same time exchanges the heat with the air around the evaporating constituents 221 to absorb the heat from the air.

Then, the refrigerant flows from the evaporating flow passages 221*c* into a downstream-side space which is formed by the other-side evaporating tank spaces 221*b* connected one after another. The refrigerant, which flows into the downstream-side space of the fourth evaporating constituent group 224*d*, flows from the outlet pipe 36 to the outside of the heat exchanger 10. The refrigerant, which flows out from the outlet pipe 36, flows into the gas-liquid separator 40 shown in FIG. 14 and is thereafter suctioned from the gas-liquid separator 40 into the compressor 14. The refrigerant flows in the heat exchanger 10 and the refrigeration cycle circuit 12 of the present embodiment in the above-described manner.

Except the points described above, the present embodiment is the same as the first embodiment. Furthermore, in the present embodiment, the advantages, which can be obtained from the common structure that is common to the first embodiment, can be obtained in the same manner as in the first embodiment.

Third Embodiment

Next, a third embodiment will be described. In the present embodiment, differences with respect to the above-described second embodiment will be mainly described.

Figure 22:
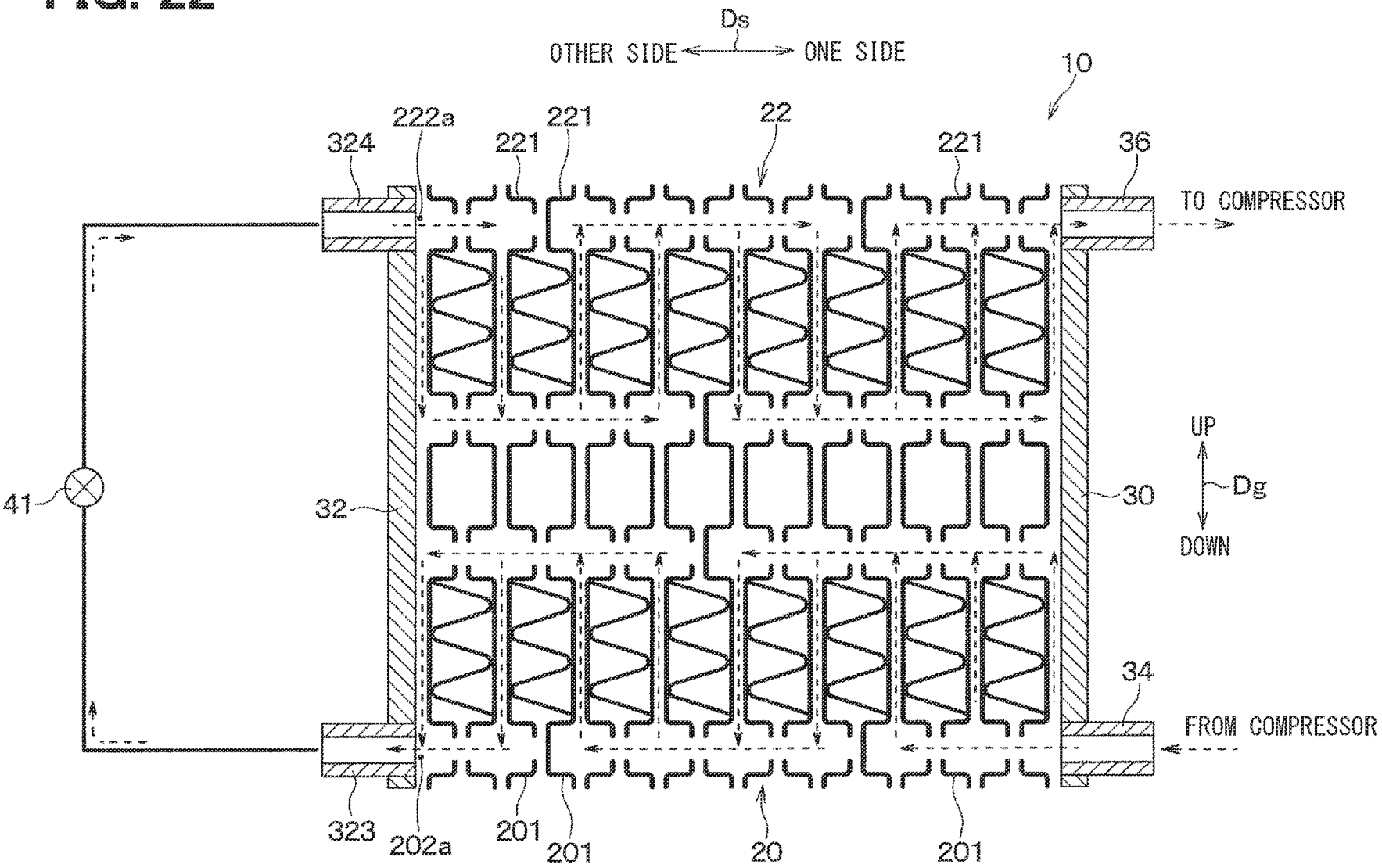
FIG. 22 is a cross-sectional view corresponding to FIG. 15, schematically showing a structure of a heat exchanger of a third embodiment.

As shown in FIG. 22, the heat exchanger 10 of the present embodiment does not include the flow restricting portion 321*e* (see FIG. 15). The refrigeration cycle circuit 12 of the present embodiment includes a pressure reducing device 41, which corresponds to the flow restricting portion 321*e*, as a separate device that is provided separately from the heat exchanger 10. The present embodiment differs from the second embodiment with respect to this point.

Specifically, since the flow restricting portion 321*e* is not provided, the other-side side plate portion 32 has a single-layer structure rather than a multilayer structure in which a plurality of plates are stacked. A condensing unit outlet pipe 323 is provided at a lower portion of the other-side side plate portion 32 and is connected to the condensing unit outlet 202*a*. Furthermore, an evaporating unit inlet pipe 324 is provided at an upper portion of the other-side side plate portion 32 and is connected to the evaporating unit inlet 222*a*.

The pressure reducing device 41 is a device that has the same function as the flow restricting portion 321*e* of the second embodiment. An upstream side portion of the pressure reducing device 41 in the flow direction of the refrigerant is connected to the condensing unit outlet 202*a* through the condensing unit outlet pipe 323, and a downstream side portion of the pressure reducing device 41 in the flow direction of the refrigerant is connected to the evaporating unit inlet 222*a* through the evaporating unit inlet pipe 324. Therefore, the pressure reducing device 41 depressurizes the refrigerant outputted from the condensing unit 20 and supplies the depressurized refrigerant to the evaporating unit 22.

For example, the pressure reducing device 41 may be an orifice like the flow restricting portion 321*e* of the second embodiment or an expansion valve having a variable opening degree that is variable.

Except the points described above, the present embodiment is the same as the second embodiment. Furthermore, in the present embodiment, the advantages, which can be obtained from the common structure that is common to the second embodiment, can be obtained in the same manner as in the second embodiment.

Fourth Embodiment

Next, a fourth embodiment will be described. In the present embodiment, differences with respect to the above-described second embodiment will be mainly described.

Figure 23:
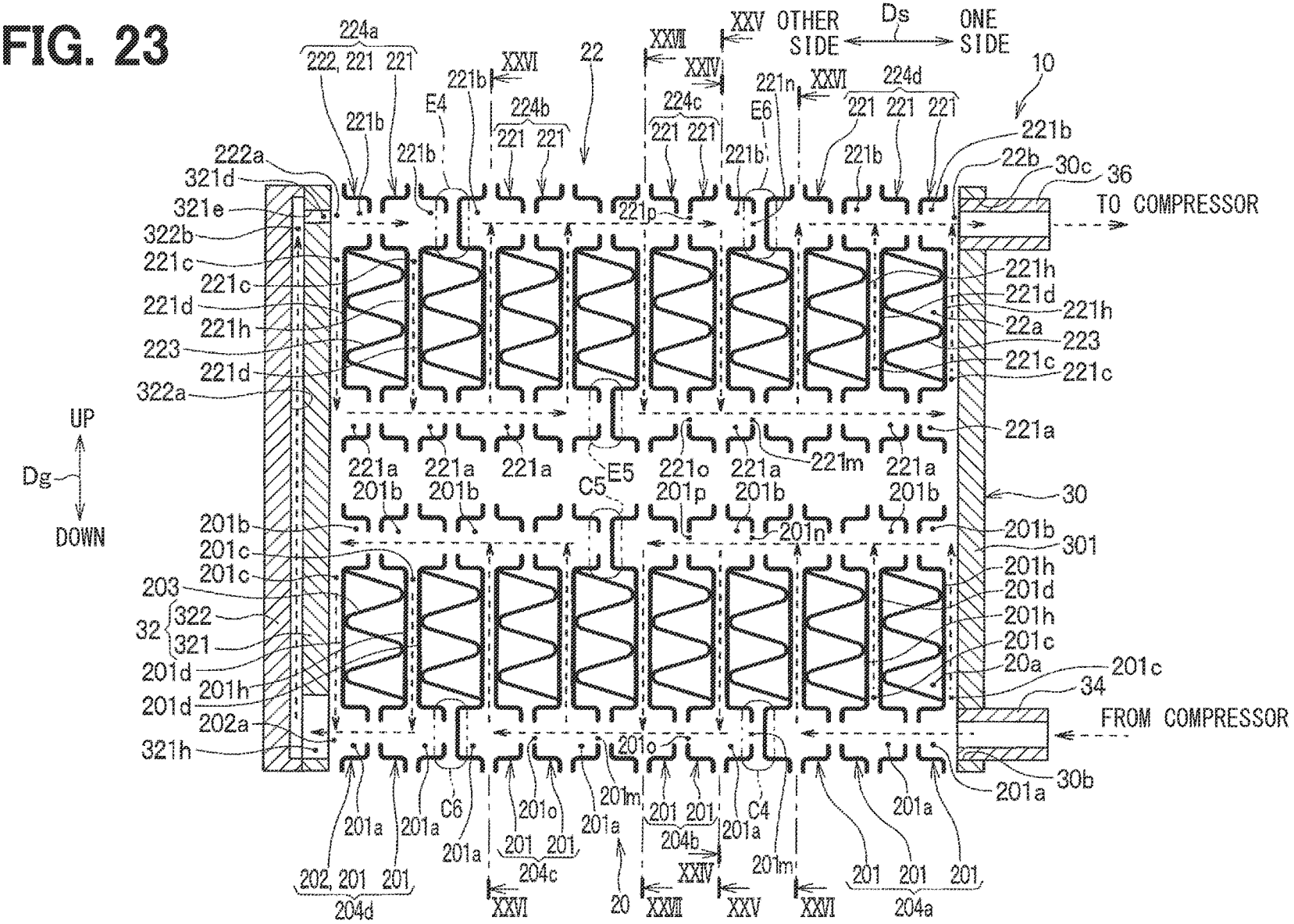
FIG. 23 is a cross-sectional view corresponding to FIG. 15 and schematically showing a structure of a heat exchanger of a fourth embodiment.
Figure 24:
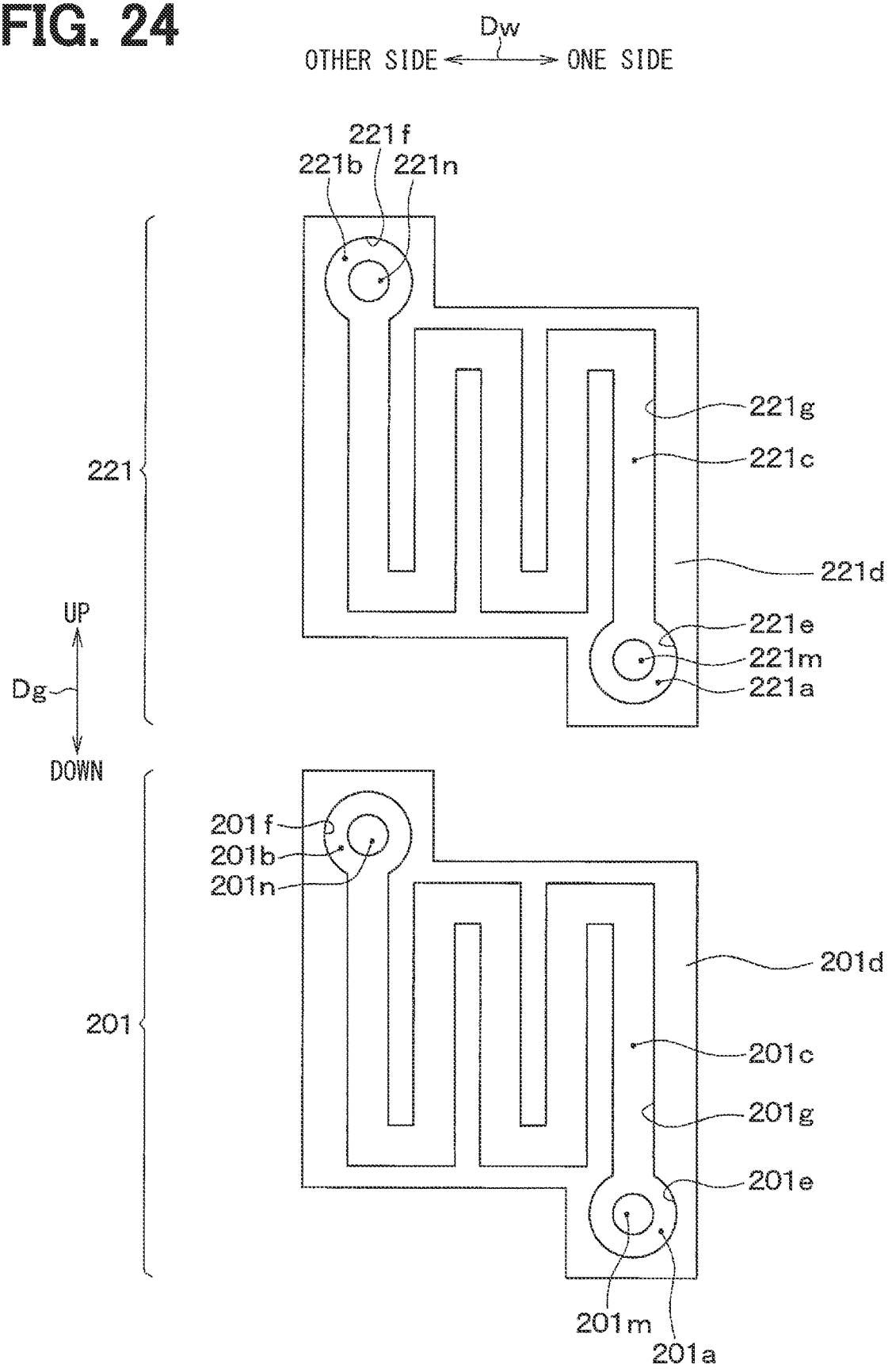
FIG. 24 is a cross-sectional view taken along line XXIV-XXIV in FIG. 23 corresponding to FIG. 18 and showing a one-side condensing plate portion and a one-side evaporating plate portion of the fourth embodiment.
Figure 25:
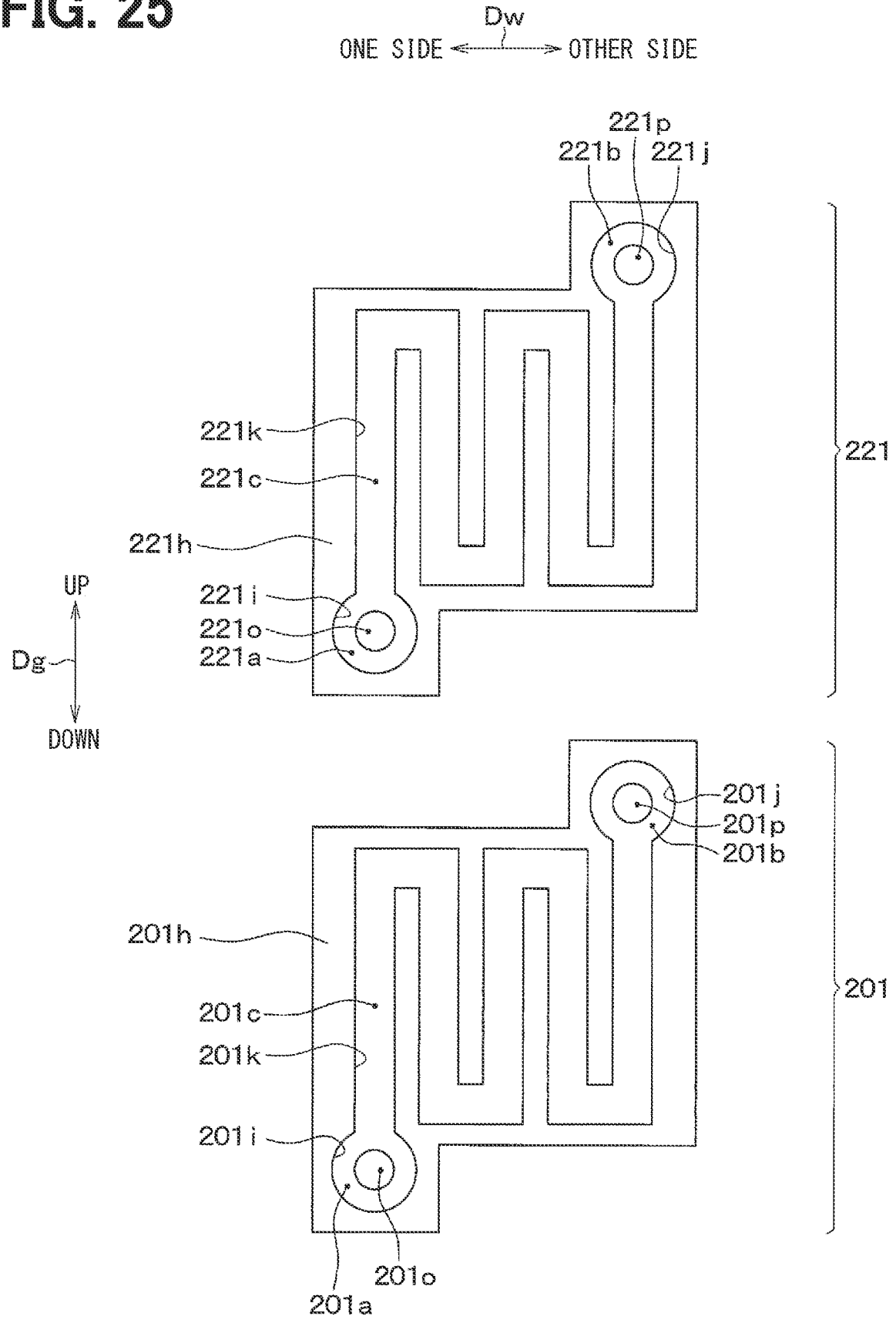
FIG. 25 is a cross-sectional view taken along line XXV-XXV in FIG. 23 corresponding to FIG. 19 and showing an other-side condensing plate portion and an other-side evaporating plate portion of the fourth embodiment.

In the present embodiment, as shown in FIGS. 23 to 25, each of the one-side condensing plate portions 201*d* and the corresponding one of the one-side evaporating plate portions 221*d* are not formed as the single component but are formed as separate components, respectively. Also, each of the other-side condensing plate portions 201*h* and the corresponding one of the other-side evaporating plate portions 221*h* are not formed as the single component but are formed as separate components, respectively. Therefore, in the present embodiment, the primary plate member 381 (see FIG. 15) is not formed, and the secondary plate member 382 is also not formed. The present embodiment differs from the second embodiment with respect to these points.

As described above, each of the one-side condensing plate portions 201*d* and the corresponding one of the one-side evaporating plate portions 221*d* are formed as the separate components, respectively, and each of the other-side condensing plate portions 201*h* and the corresponding one of the other-side evaporating plate portions 221*h* are also formed as the separate components, respectively. Therefore, the condensing unit 20 and the evaporating unit 22 are integrated together by joining the one-side side plate portion 30 and the other-side side plate portion 32 to the two opposite sides of the condensing unit 20 and the evaporating unit 22.

The refrigerant flow path of the present embodiment is the same as that of the second embodiment as indicated by broken arrows in FIG. 23. Therefore, basically, as shown in FIG. 24, the primary communication hole 201*m* and the secondary communication hole 201*n* are formed in the one-side condensing plate portion 201*d*, and the primary communication hole 221*m* and the secondary communication hole 221*n* are formed in the one-side evaporating plate portion 221*d*. Furthermore, as shown in FIG. 25, the primary communication hole 2010 and the secondary communication hole 201*p* are formed in the other-side condensing plate portion 201*h*, and the primary communication hole 2210 and the secondary communication hole 221*p* are formed in the other-side evaporating plate portion 221*h*.

Figure 26:
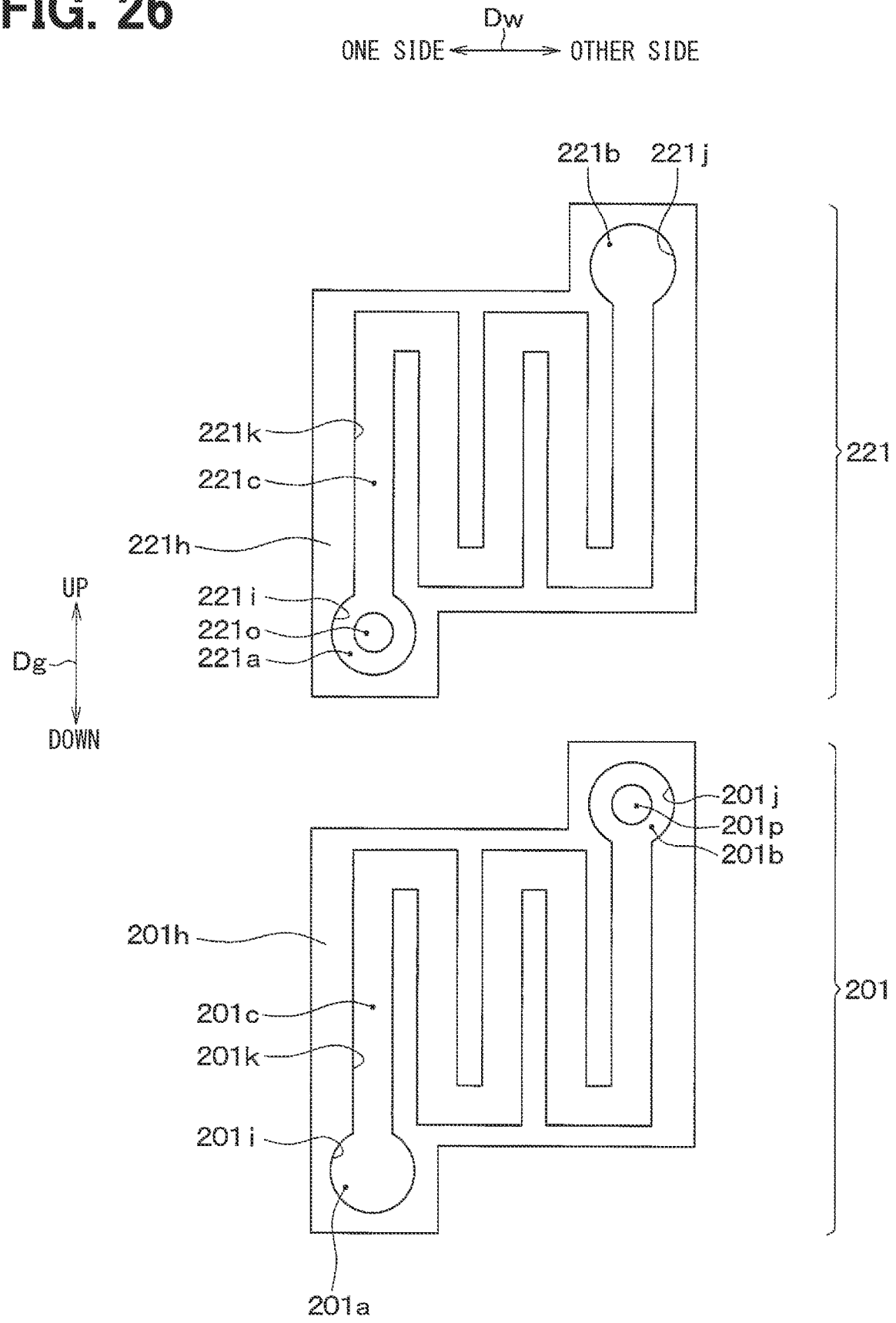
FIG. 26 is a cross-sectional view taken along line XXVI-XXVI in FIG. 23 corresponding to FIG. 20 and showing the other-side condensing plate portion and the other-side evaporating plate portion of the fourth embodiment.
Figure 27:
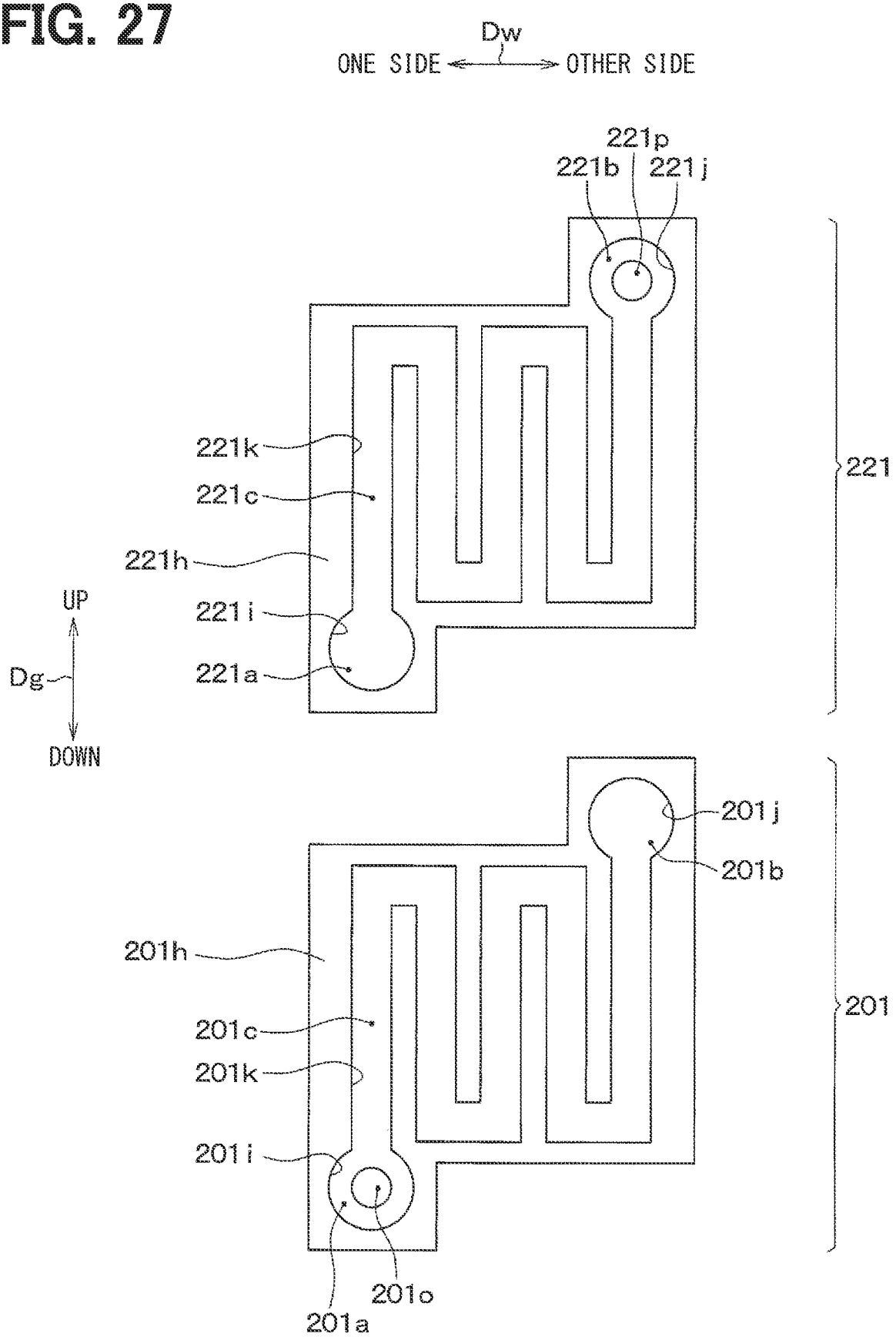
FIG. 27 is a cross-sectional view taken along line XXVII-XXVII in FIG. 23 corresponding to FIG. 21 and showing the other-side condensing plate portion and the other-side evaporating plate portion of the fourth embodiment.

However, as shown in FIGS. 23 and 26, at a portion C4 of FIG. 23, the primary communication hole 2010 is not formed in the outermost other-side condensing plate portion 201*h* that is located at an end of the first condensing constituent group 204*a* on the other side in the stacking direction Ds. Furthermore, as shown in FIGS. 23 and 27, at a portion C5 of FIG. 23, the secondary communication hole 201*p* is not formed in the outermost other-side condensing plate portion 201*h* that is located at an end of the second condensing constituent group 204*b* on the other side in the stacking direction Ds. Furthermore, as shown in FIGS. 23 and 26, at a portion C6 of FIG. 23, the primary communication hole 2010 is not formed in the outermost other-side condensing plate portion 201*h* that is located at an end of the third condensing constituent group 204*c* on the other side in the stacking direction Ds.

Furthermore, as shown in FIGS. 23 and 26, at a portion E4 of FIG. 23, the secondary communication hole 221*p* is not formed in the outermost other-side evaporating plate portion 221*h* that is located at an end of the second evaporating constituent group 224*b* on the other side in the stacking direction Ds. Furthermore, as shown in FIGS. 23 and 27, at a portion E5 of FIG. 23, the primary communication hole 2210 is not formed in the outermost other-side evaporating plate portion 221*h* that is located at an end of the third evaporating constituent group 224*c* on the other side in the stacking direction Ds. Furthermore, as shown in FIGS. 23 and 26, at a portion E6 of FIG. 23, the secondary communication hole 221*p* is not formed in the other-side evaporating plate portion 221*h* that is located at an end of the fourth evaporating constituent group 224*d* on the other side in the stacking direction Ds.

Further, as can be seen from FIGS. 24 to 27, the components are commonized not only among the one-side condensing plate portions 201*d* and among the one-side evaporating plate portions 221*d* but also between the one-side condensing plate portions 201*d* and the one-side evaporating plate portions 221*d*. Likewise, the components are commonized not only among the other-side condensing plate portions 201*h* and among the other-side evaporating plate portions 221*h* but also between the other-side condensing plate portions 201*h* and the other-side evaporating plate portions 221*h*.

Except the points described above, the present embodiment is the same as the second embodiment. Furthermore, in the present embodiment, the advantages, which can be obtained from the common structure that is common to the second embodiment, can be obtained in the same manner as in the second embodiment.

Fifth Embodiment

Next, a fifth embodiment will be described. In the present embodiment, differences with respect to the above-described second embodiment will be mainly described.

Figure 28:
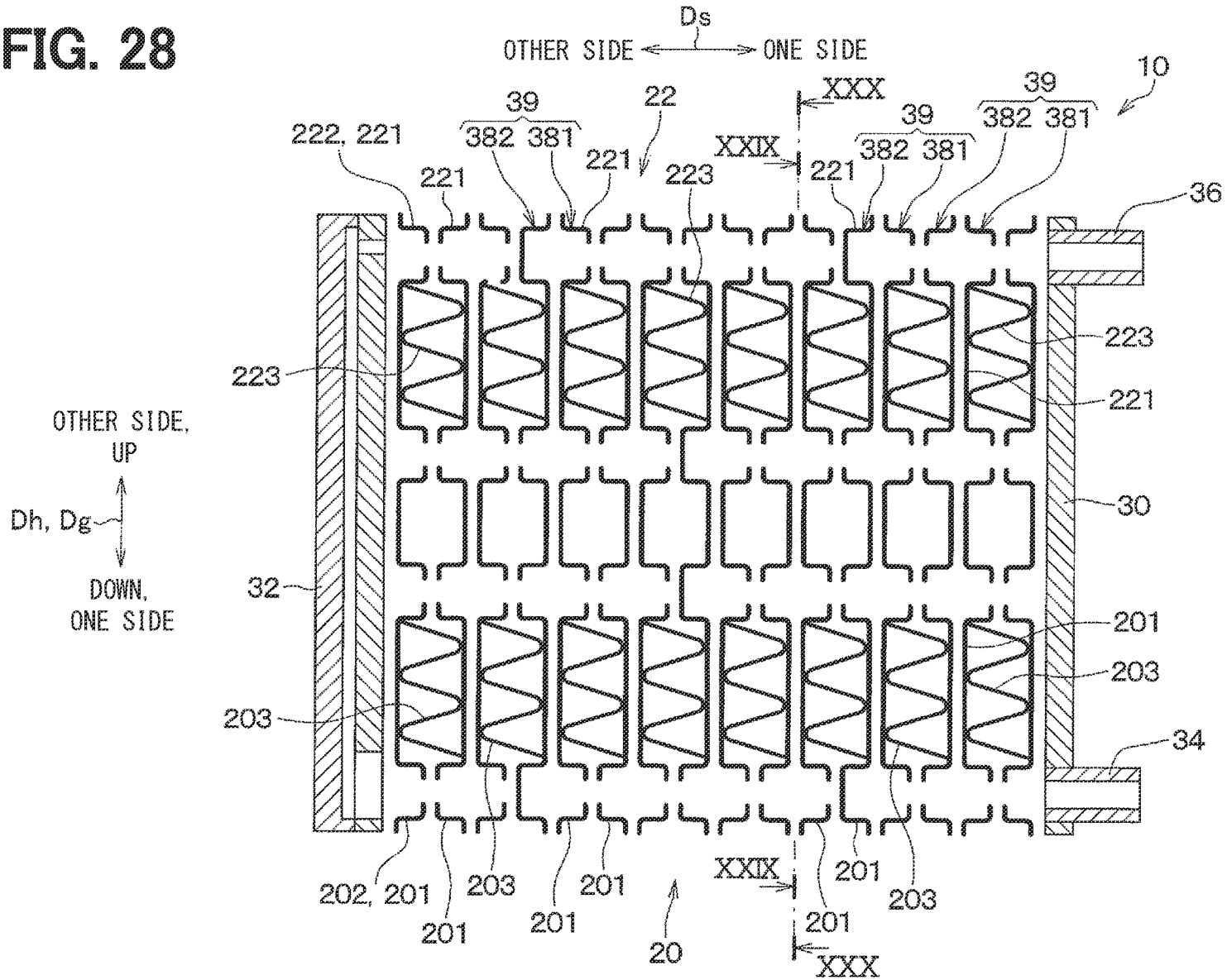
FIG. 28 is a cross-sectional view corresponding to FIG. 15 and schematically showing a structure of a heat exchanger of a fifth embodiment.

As shown in FIG. 28, in the present embodiment, each of the primary plate members 381 and a corresponding one of the secondary plate members 382 are joined together to form a joined plate member assembly 39 that includes a corresponding one the condensing constituents 201 and a corresponding one of the evaporating constituents 221. In each of the joined plate member assemblies 39, the primary plate member 381 is located on the one side of the secondary plate member 382 in the stacking direction Ds. With respect to this point, the present embodiment is the same as the second embodiment.

Figure 29:
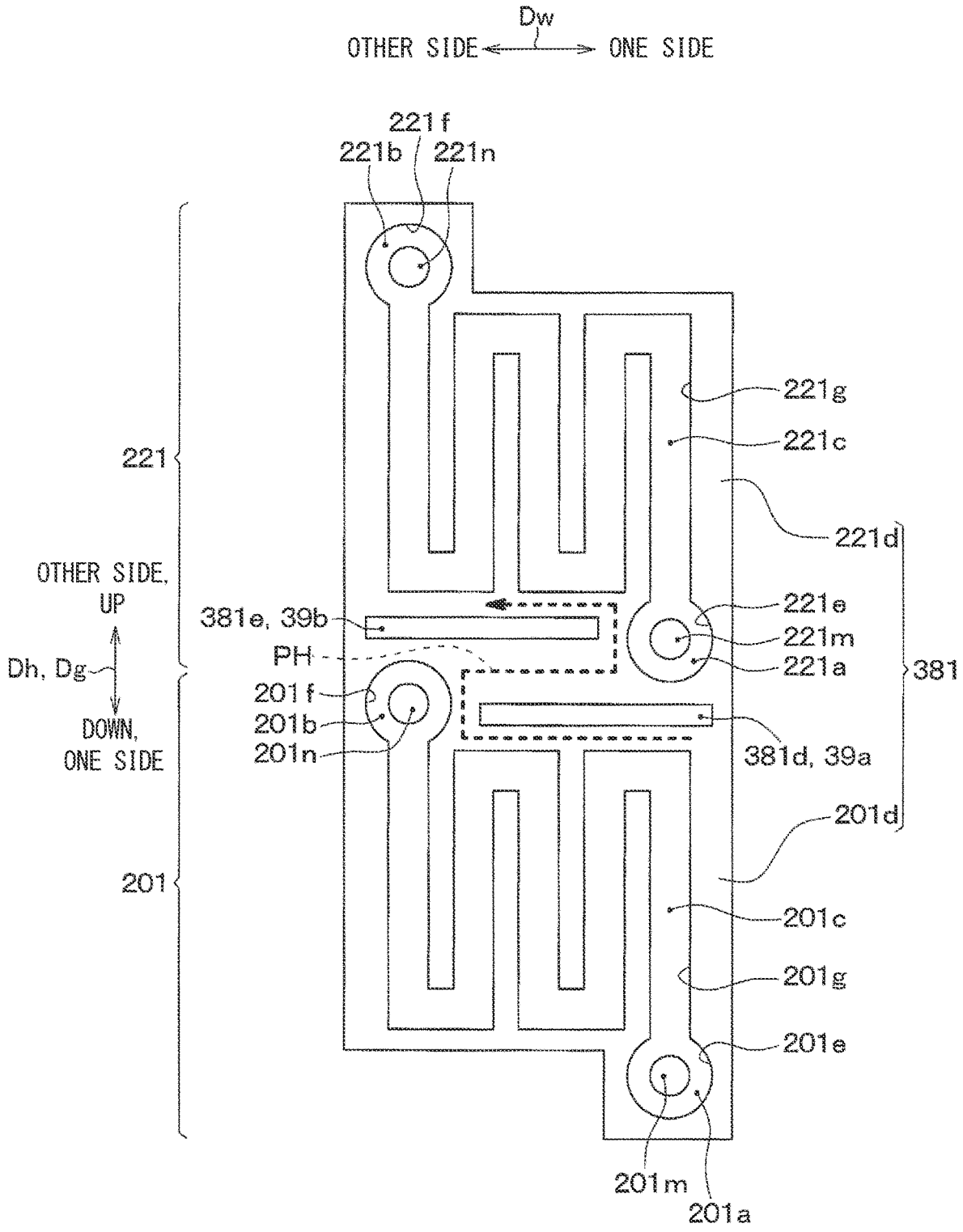
FIG. 29 is a cross-sectional view taken along line XXIX-XXIX in FIG. 28, corresponding to FIG. 18 and showing a primary plate member of the fifth embodiment.
Figure 30:
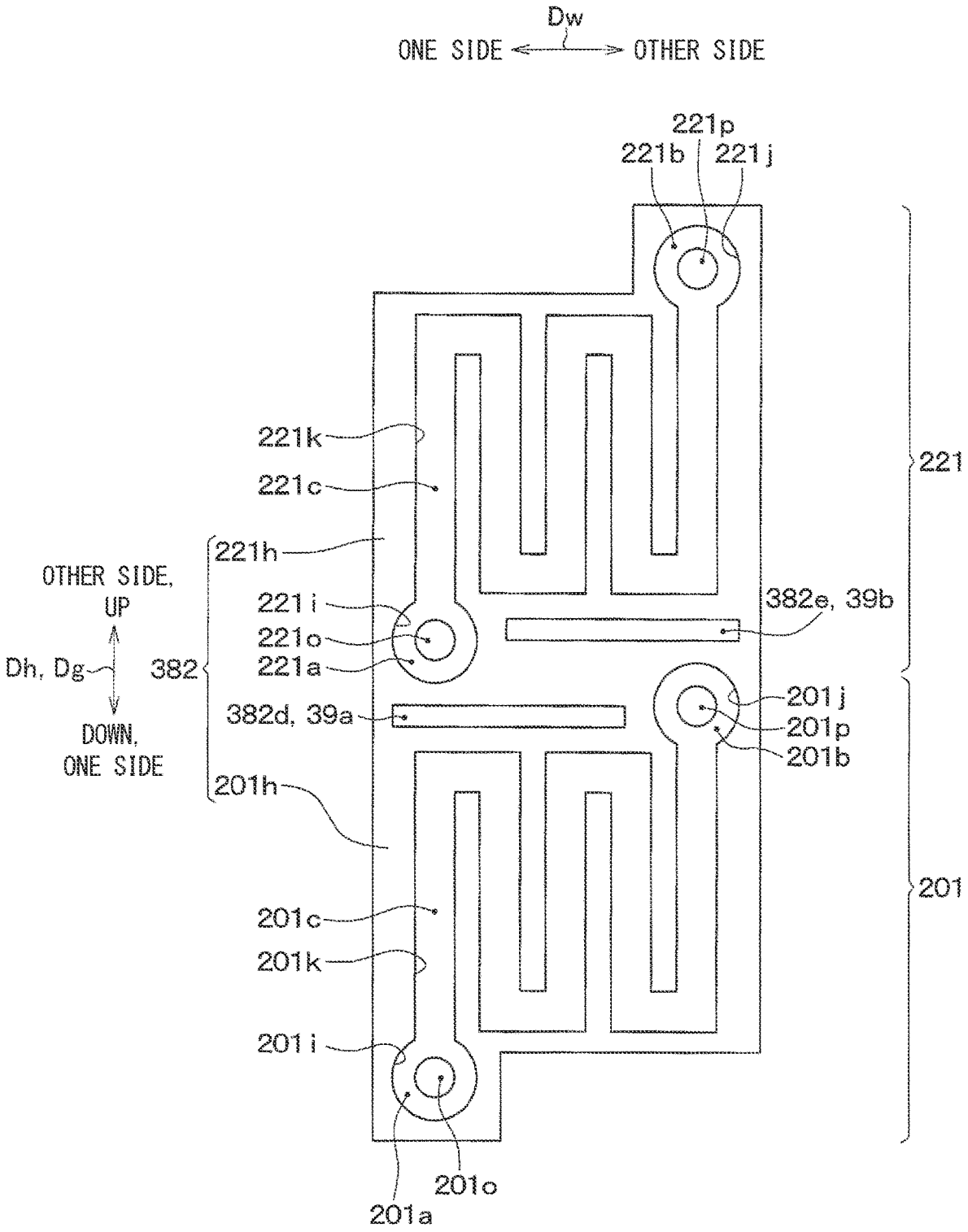
FIG. 30 is a cross-sectional view taken along line XXIX-XXIX in FIG. 28, corresponding to FIG. 19 and showing a secondary plate member of the fifth embodiment.

However, as shown in FIGS. 28-30, unlike the second embodiment, in the present embodiment, a primary intermediate through hole 39*a* and a secondary intermediate through hole 39*b* are formed in the joined plate member assembly 39. The primary intermediate through hole 39*a* and the secondary intermediate through hole 39*b* are located between the condensing constituent 201 and the evaporating constituent 221 of the joined plate member assembly 39 and extend through the joined plate member assembly 39 in a thickness direction of the joined plate member assembly 39 (i.e., the stacking direction Ds). Since FIG. 28 is a diagram for showing reference signs that could not be shown in FIG. 15 because of the limited space in FIG. 15, the illustrated shape of the heat exchanger 10 shown in FIG. 28 is the same as the heat exchanger 10 shown in FIG. 15.

When the discussion is focused on the primary plate member 381 of the joined plate member assembly 39, the primary plate member 381 includes a primary plate member's primary intermediate hole 381*d* that is a portion of the primary intermediate through hole 39*a* which belongs to the primary plate member 381. Furthermore, the primary plate member 381 includes a primary plate member's secondary intermediate hole 381*e* that is a portion of the secondary intermediate through hole 39*b* which belongs to the primary plate member 381.

Similarly, when the discussion is focused on the second plate member 382, the second plate member 382 includes a secondary plate member's primary intermediate hole 382*d* that is a portion of the primary intermediate through hole 39*a* which belongs to the secondary plate member 382. Furthermore, the secondary plate member 382 includes a secondary plate member's secondary intermediate hole 382*e* that is a portion of the secondary intermediate through hole 39*b* which belongs to the secondary plate member 382.

In other words, a size of the primary plate member's primary intermediate hole 381*d* and a size of the secondary plate member's primary intermediate hole 382*d* are equal to each other, and the primary plate member's primary intermediate hole 381*d* and the secondary plate member's primary intermediate hole 382*d* are connected in series in the stacking direction Ds to form the primary intermediate through hole 39*a*. Furthermore, a size of the primary plate member's secondary intermediate hole 381*e* and a size of the secondary plate member's secondary intermediate hole 382*e* are equal to each other, and the primary plate member's secondary intermediate hole 381*e* and the secondary plate member's secondary intermediate hole 382*e* are connected in series in the stacking direction Ds to form the secondary intermediate through hole 39*b*.

The primary plate member's primary intermediate hole 381*d* and the primary plate member's secondary intermediate hole 381*e* of the present embodiment are provided in place of the heat insulation holes 381*a*, 381*b*, 381*c* (see FIG. 18) of the second embodiment. Therefore, in the present embodiment, these heat insulation holes 381*a*, 381*b*, 381*c* are not provided. Furthermore, the secondary plate member's primary intermediate hole 382*d* and the secondary plate member's secondary intermediate hole 382*e* of the present embodiment are provided in place of the heat insulation holes 382*a*, 382*b*, 382*c* (see FIG. 19) of the second embodiment. Therefore, in the present embodiment, these heat insulation holes 382*a*, 382*b*, 382*c* are not provided.

Like, for example, the heat insulation holes 381*a*, 382*a* of the second embodiment, the primary intermediate through hole 39*a* and the secondary intermediate through hole 39*b* of the present embodiment are provided for the purpose of heat insulation for suppressing the heat transmission between the refrigerant in the condensing constituent 201 and the refrigerant in the evaporating constituent 221.

Specifically, the primary intermediate through hole 39*a* and the secondary intermediate through hole 39*b* of the present embodiment extend in the heat exchanger width direction Dw as indicated in FIGS. 29 and 30. For example, each of the primary intermediate through hole 39*a* and the secondary intermediate through hole 39*b* is a slit hole that is in a slit form and is elongated in the heat exchanger width direction Dw. The primary intermediate through hole 39*a* is located on one side of the secondary intermediate through hole 39*b* in a constituent arranging direction Dh (i.e., an arranging direction in which the condensing constituent 201 and the evaporating constituent 221 are arranged) such that the primary intermediate through hole 39*a* partially overlaps with the secondary intermediate through hole 39*b*.

In the present embodiment, the heat exchanger width direction Dw is also an assembly width direction (i.e., a width direction of the joined plate member assembly 39) and is a direction that intersects the constituent arranging direction Dh (more precisely, a direction perpendicular to the constituent arranging direction Dh). Further, although the constituent arranging direction Dh does not have to coincide with the gravity direction Dg, the constituent arranging direction Dh coincides with the gravity direction Dg in the present embodiment. Furthermore, the one side in the constituent arranging direction Dh is the lower side in the gravity direction Dg in the present embodiment.

As described above, in the present embodiment, each of the primary intermediate through hole 39*a* and the secondary intermediate through hole 39*b* extends in the heat exchanger width direction Dw. The primary intermediate through hole 39*a* is located on the one side of the secondary intermediate through hole 39*b* in the constituent arranging direction Dh (i.e., the arranging direction in which the condensing constituent 201 and the evaporating constituent 221 are arranged) such that the primary intermediate through hole 39*a* partially overlaps with the secondary intermediate through hole 39*b*. Therefore, in comparison to a case where the joined plate member assembly 39 does not include the primary and secondary intermediate through holes 39*a*, 39*b*, it is possible to increase a heat transfer path PH along which the heat is conducted between the refrigerant in the condensing constituent 201 and the refrigerant in the evaporating constituent 221 through the joined plate member assembly 39.

Thereby, it is possible to reduce the heat transfer loss at the time of exchanging the heat at the condensing unit 20 between the refrigerant in the condensing constituents 201 and the heat absorbing medium (specifically, the air around the condensing constituents 201) which absorbs the heat from the refrigerant. Also, it is possible to reduce the heat transfer loss at the time of exchanging the heat at the evaporating unit 22 between the refrigerant in the evaporating constituents 221 and the heat releasing medium (specifically, the air around the evaporating constituents 221) which releases the heat to the refrigerant.

Except the points described above, the present embodiment is the same as the second embodiment. Furthermore, in the present embodiment, the advantages, which can be obtained from the common structure that is common to the second embodiment, can be obtained in the same manner as in the second embodiment.

Although the present embodiment is a modification based on the second embodiment, the present embodiment can be combined with the first embodiment or the third embodiment.

Sixth Embodiment

Next, a sixth embodiment will be described. In the present embodiment, differences with respect to the above-described fifth embodiment will be mainly described.

Figure 31:
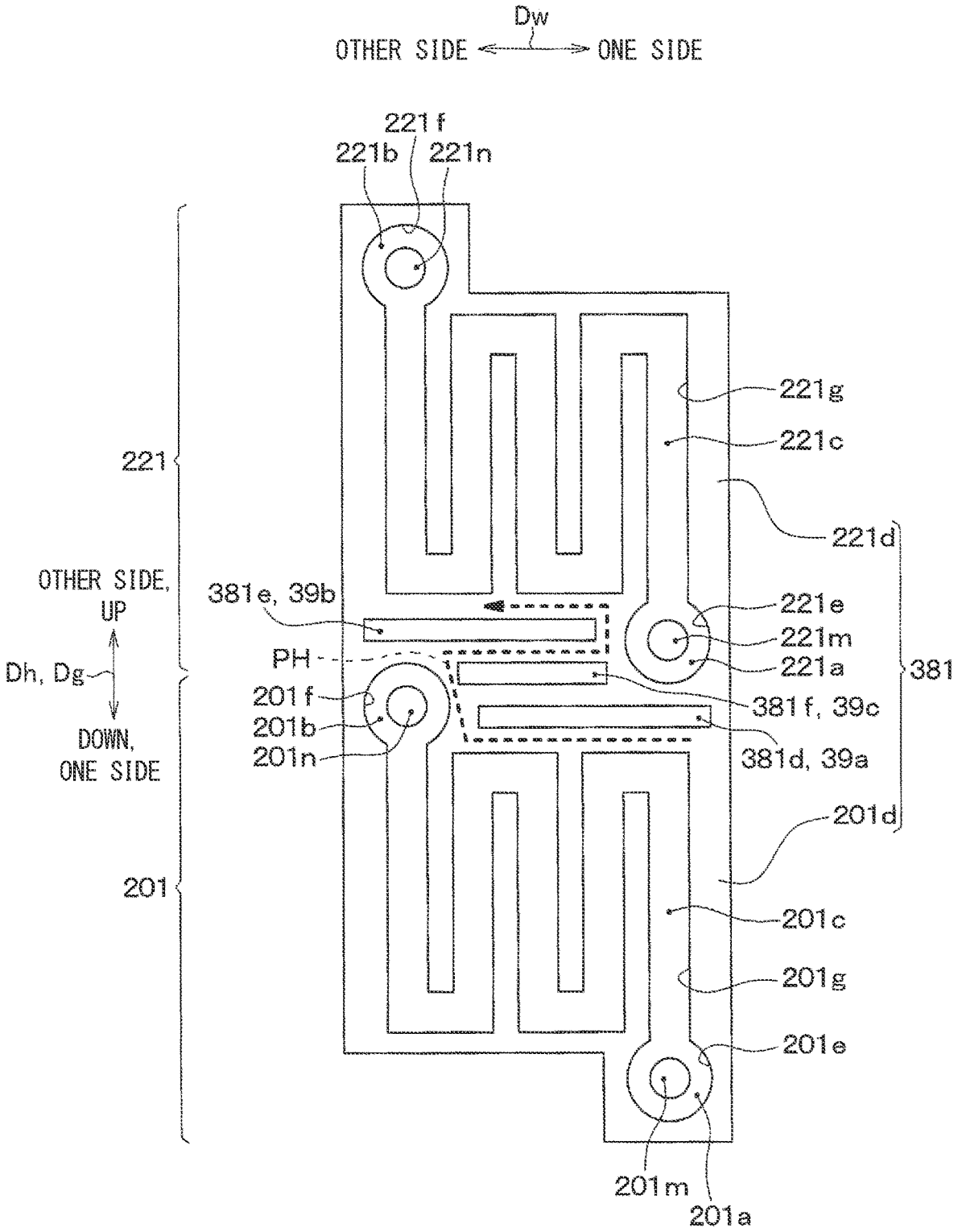
FIG. 31 is a cross-sectional view taken along line XXIX-XXIX in FIG. 28, corresponding to FIG. 29 and showing a primary plate member of a sixth embodiment.
Figure 32:
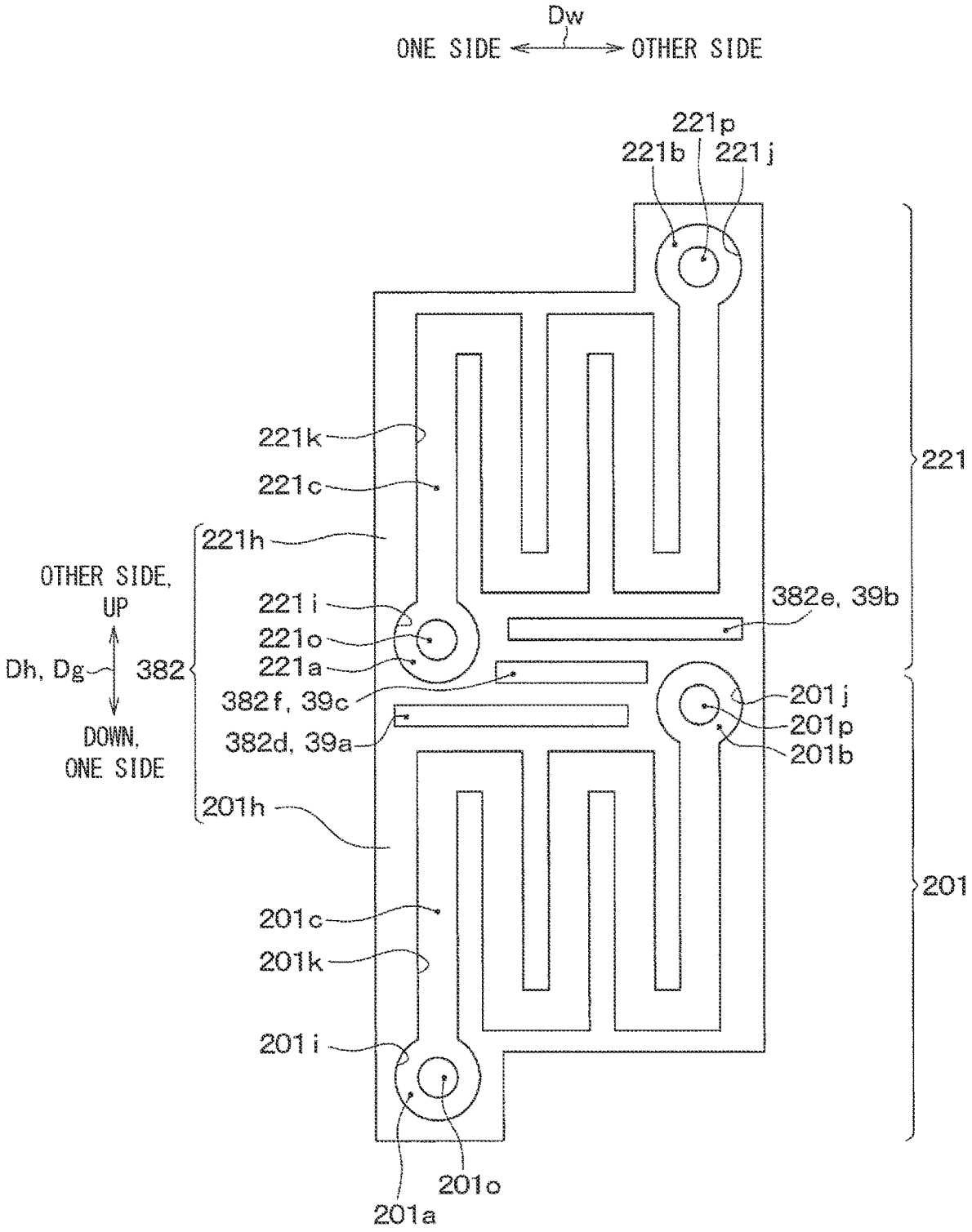
FIG. 32 is a cross-sectional view taken along line XXX-XXX in FIG. 28, corresponding to FIG. 30 and showing a secondary plate member of the sixth embodiment.

As shown in FIGS. 31 and 32, in the present embodiment, in addition to the primary intermediate through hole 39*a* and the secondary intermediate through hole 39*b*, the joined plate member assembly 39 also includes a tertiary intermediate through hole 39*c*. Therefore, in addition to the primary plate member's primary intermediate hole 381*d* and the primary plate member's secondary intermediate hole 381*e*, the primary plate member 381 also includes a primary plate member's tertiary intermediate hole 381*f* that is a portion of the tertiary intermediate through hole 39*c* which belongs to the primary plate member 381. Furthermore, in addition to the secondary plate member's primary intermediate hole 382*d* and the secondary plate member's secondary intermediate hole 382*e*, the secondary plate member 382 also includes a secondary plate member's tertiary intermediate hole 382*f* that is a portion of the tertiary intermediate through hole 39*c* which belongs to the secondary plate member 382. The present embodiment differs from the fifth embodiment with respect to this point.

Specifically, the tertiary intermediate through hole 39*c* of the present embodiment extends in the heat exchanger width direction Dw. The tertiary intermediate through hole 39*c* is located between the primary intermediate through hole 39*a* and the secondary intermediate through hole 39*b* in the constituent arranging direction Dh.

Except the points described above, the present embodiment is the same as the fifth embodiment. Furthermore, in the present embodiment, the advantages, which can be obtained from the common structure that is common to the fifth embodiment, can be obtained in the same manner as in the fifth embodiment.

Seventh Embodiment

Next, a seventh embodiment will be described. In the present embodiment, differences with respect to the above-described fifth embodiment will be mainly described.

Figure 33:
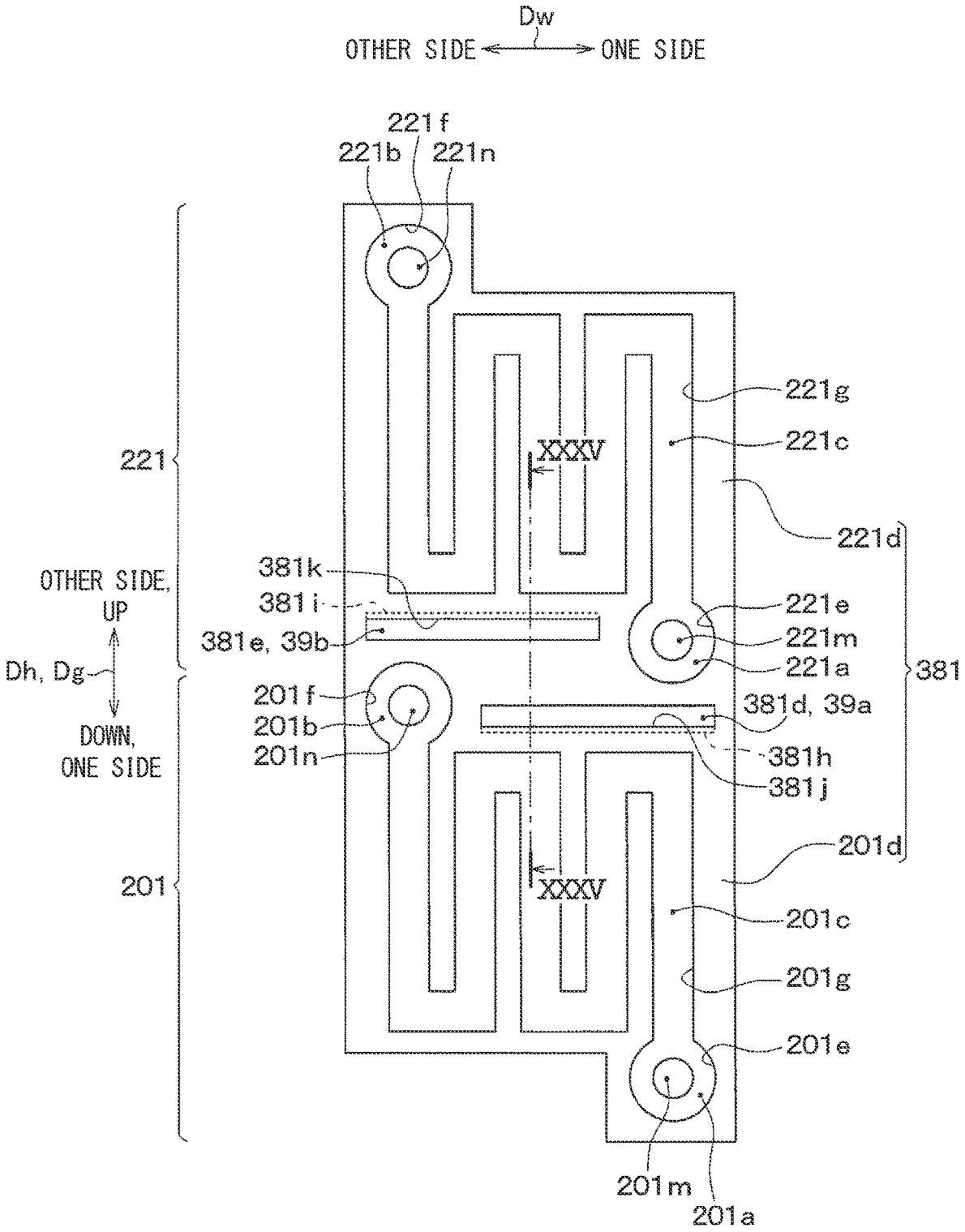
FIG. 33 is a cross-sectional view taken along line XXIX-XXIX in FIG. 28, corresponding to FIG. 29 and showing a primary plate member of a seventh embodiment.
Figure 34:
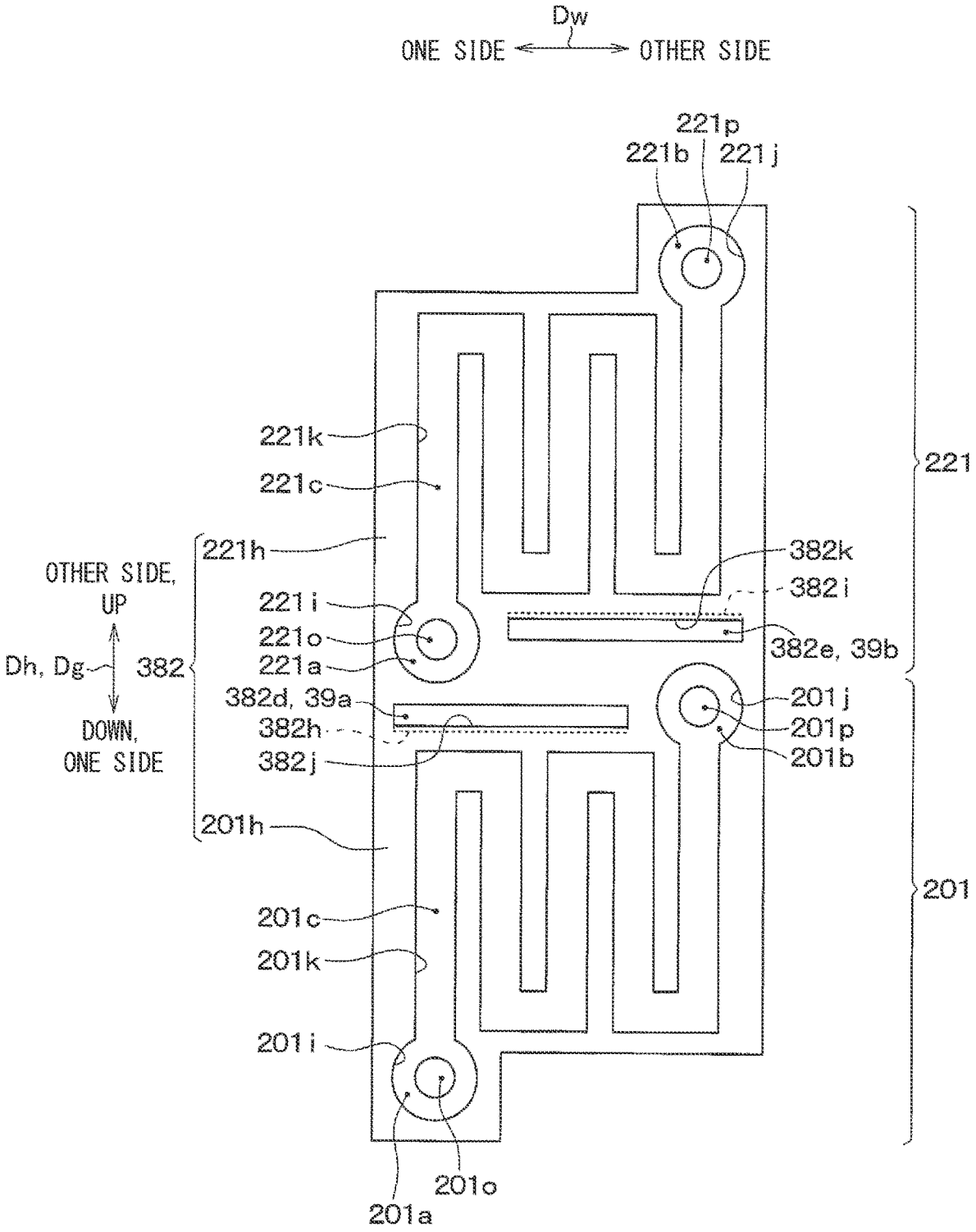
FIG. 34 is a cross-sectional view taken along line XXX-XXX in FIG. 28, corresponding to FIG. 30 and showing a secondary plate member of the seventh embodiment.
Figure 35:
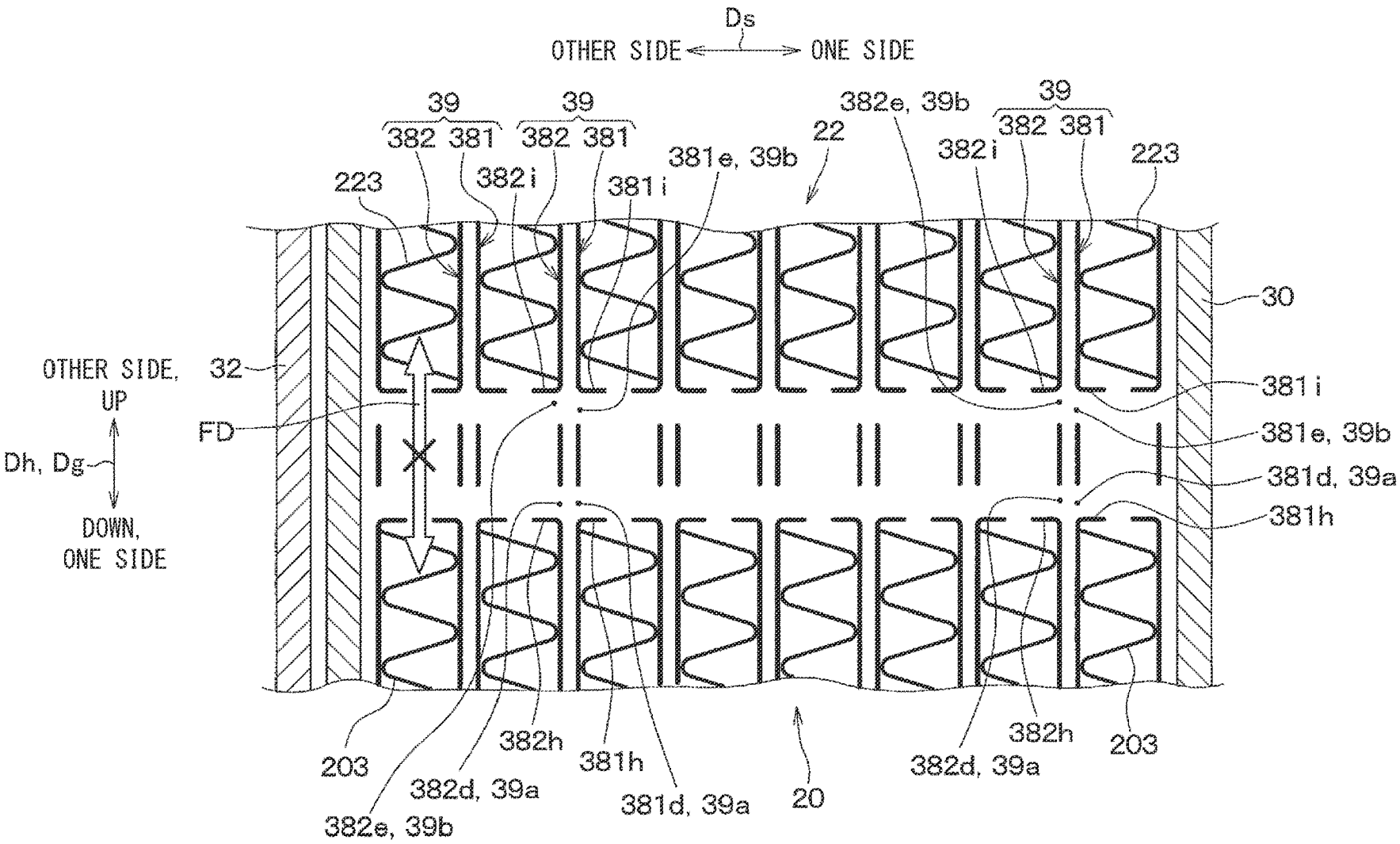
FIG. 35 is a cross-sectional view taken along line XXXV-XXXV in FIG. 33 schematically showing a portion of a heat exchanger of the seventh embodiment in a manner similar to FIG. 15.

As shown in FIGS. 33 to 35, the primary plate member 381 of the present embodiment includes a primary hole peripheral plate portion 381*h* and a secondary hole peripheral plate portion 381*i* which are respectively formed at two different locations of the primary plate member 381. Furthermore, the secondary plate member 382 of the present embodiment also includes a primary hole peripheral plate portion 382*h* and a secondary hole peripheral plate portion 382*i* which are respectively formed at two different locations of the secondary plate member 382. The present embodiment differs from the fifth embodiment with respect to this point.

Specifically, the primary hole peripheral plate portion 381*h* of the primary plate member 381 is shaped such that the primary hole peripheral plate portion 381*h* is bent from a peripheral portion 381*j* of the primary plate member's primary intermediate hole 381*d* and is raised toward the one side in the stacking direction Ds. Furthermore, the secondary hole peripheral plate portion 381*i* of the primary plate member 381 is shaped such that the secondary hole peripheral plate portion 381*i* is bent from the peripheral portion 381*k* of the primary plate member's secondary intermediate hole 381*e* and is raised toward the one side in the stacking direction Ds. In other words, as can be seen from FIG. 35, the one side of the primary plate member 381 in the stacking direction Ds can be said to be an opposite side of the primary plate member 381 that is opposite from the side where the secondary plate member 382, which is joined to the primary plate member 381 to form the joined plate member assembly 39, is placed in the stacking direction Ds.

The primary hole peripheral plate portion 381*h* of the primary plate member 381 extends along the peripheral portion 381*j* of the primary plate member's primary intermediate hole 381*d* in the heat exchanger width direction Dw. Likewise, the secondary hole peripheral plate portion 381*i* of the primary plate member 381 extends along the peripheral portion 381*k* of the primary plate member's secondary intermediate hole 381*e* in the heat exchanger width direction Dw.

Furthermore, the primary hole peripheral plate portion 381*h* of the primary plate member 381 is located on the one side of the secondary hole peripheral plate portion 381*i* of the primary plate member 381 in the constituent arranging direction Dh such that the primary hole peripheral plate portion 381*h* partially overlaps with the secondary hole peripheral plate portion 381*i*.

In contrast to the primary plate member 381 configured in the above-described manner, the secondary plate member 382 is symmetrically shaped in the stacking direction Ds at the joined plate member assembly 39. That is, the primary hole peripheral plate portion 382*h* of the secondary plate member 382 is shaped such that the primary hole peripheral plate portion 382*h* is bent from the peripheral portion 382*j* of the secondary plate member's primary intermediate hole 382*d* and is raised toward the other side in the stacking direction Ds. Furthermore, the secondary hole peripheral plate portion 382*i* of the secondary plate member 382 is shaped such that the secondary hole peripheral plate portion 382*i* is bent from the peripheral portion 382*k* of the secondary plate member's secondary intermediate hole 382*e* and is raised toward the other side in the stacking direction Ds. In other words, as can be seen from FIG. 35, the other side of the secondary plate member 382 in the stacking direction Ds can be said to be an opposite side of the secondary plate member 382 that is opposite from the side where the primary plate member 381, which is joined to the secondary plate member 382 to form the joined plate member assembly 39, is placed in the stacking direction Ds.

The primary hole peripheral plate portion 382*h* of the secondary plate member 382 extends along the peripheral portion 382*j* of the secondary plate member's primary intermediate hole 382*d* in the heat exchanger width direction Dw. Likewise, the secondary hole peripheral plate portion 382*i* of the secondary plate member 382 extends along the peripheral portion 382*k* of the secondary plate member's secondary intermediate hole 382*e* in the heat exchanger width direction Dw.

Furthermore, the primary hole peripheral plate portion 382*h* of the secondary plate member 382 is located on the one side of the secondary hole peripheral plate portion 382*i* of the secondary plate member 382 in the constituent arranging direction Dh such that the primary hole peripheral plate portion 382*h* partially overlaps with the secondary hole peripheral plate portion 382*i*.

As described above, according to the present embodiment, the primary hole peripheral plate portion 381*h* of the primary plate member 381 is shaped such that the primary hole peripheral plate portion 381*h* is bent from the peripheral portion 381*j* of the primary plate member's primary intermediate hole 381*d* and is raised toward the one side in the stacking direction Ds. Likewise, the secondary hole peripheral plate portion 381*i* of the primary plate member 381 is shaped such that the secondary hole peripheral plate portion 381*i* is bent from the peripheral portion 381*k* of the primary plate member's secondary intermediate hole 381*e* and is raised toward the one side in the stacking direction Ds. Each of the primary and secondary hole peripheral plate portions 381*h*, 381*i* of the primary plate member 381 extends in the heat exchanger width direction Dw.

Therefore, it is possible to increase the strength of the primary plate member 381 alone and the strength of the joined plate member assembly 39 by the primary and secondary hole peripheral plate portions 381*h*, 381*i*. In response to the formation of the intermediate through holes 39*a*, 39*b* which reduces the heat transfer loss described above at the time of exchanging the heat between the refrigerant and the air (serving as the heat absorbing medium or the heat releasing medium), the primary and secondary hole peripheral plate portions 381*h*, 381*i* for increasing the strength of intermediate through holes 39*a*, 39*b* can also be formed.

Furthermore, according to the present embodiment, the primary hole peripheral plate portion 381*h* of the primary plate member 381 is located on the one side of the secondary hole peripheral plate portion 381*i* of the primary plate member 381 in the constituent arranging direction Dh such that the primary hole peripheral plate portion 381*h* partially overlaps with the secondary hole peripheral plate portion 381*i*. Therefore, it is possible to increase the strength of the primary plate member 381 alone and the strength of the joined plate member assembly 39 by the hole peripheral plate portions 381*h*, 381*i* through a wide range in the heat exchanger width direction Dw. Furthermore, since the primary and secondary hole peripheral plate portions 382*h*, 382*i* are also formed at the secondary plate member 382, the effect and advantage of increasing the strength described above are further increased.

Figure 36:
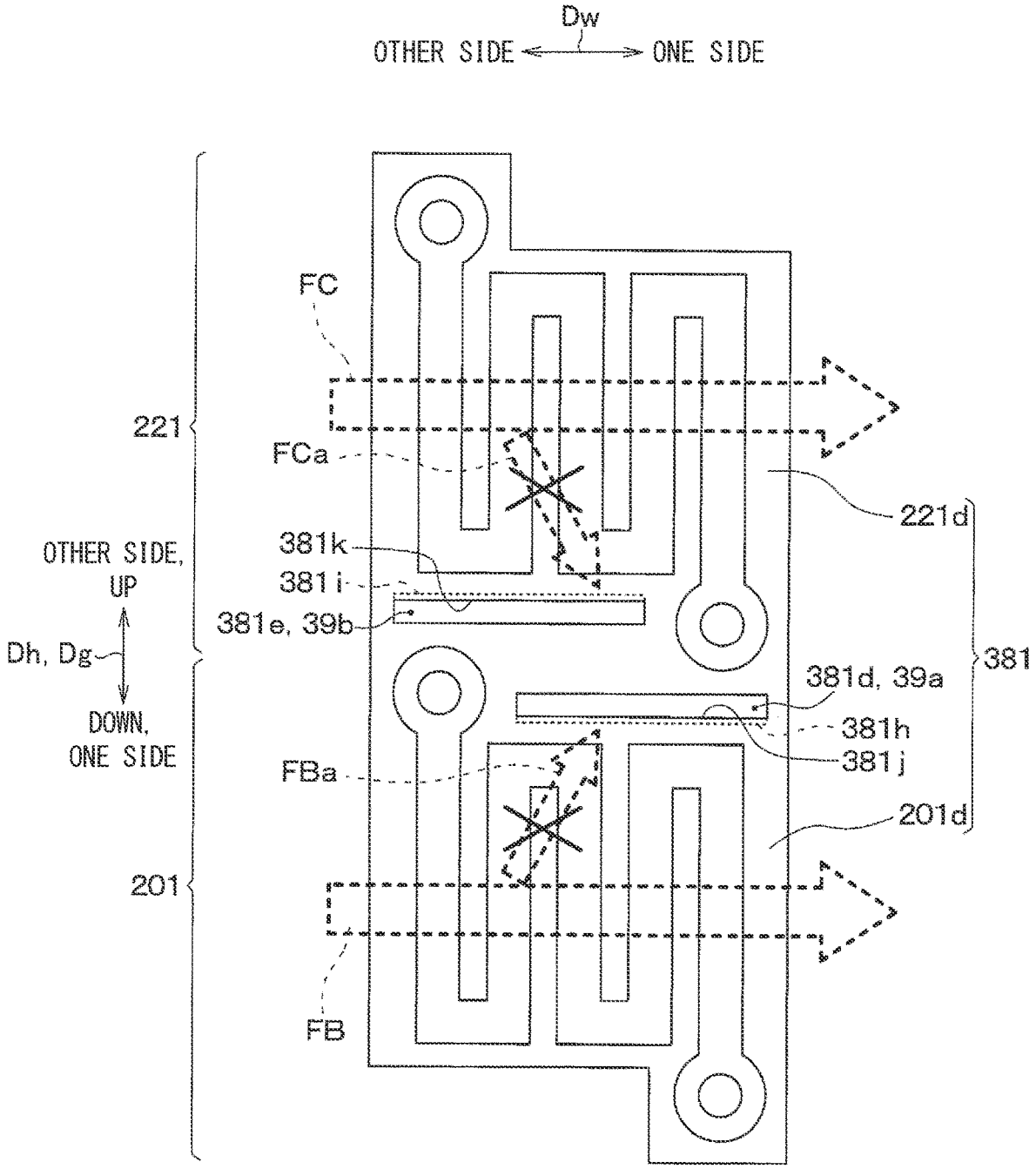
FIG. 36 is a cross-sectional view corresponding to FIG. 33 and schematically showing an air flow passing through a condensing unit and an air flow passing through an evaporating unit with broken arrows in the seventh embodiment.

Furthermore, as shown in FIG. 36, the primary hole peripheral plate portion 381*h* of the primary plate member 381 has a function of guiding the air flow, which passes around the condensing constituent 201 as indicated by an arrow FB, in the heat exchanger width direction Dw, and the primary hole peripheral plate portion 382*h* of the secondary plate member 382 also has the function that is similar to the function of the primary hole peripheral plate portion 381*h* of the primary plate member 381. Therefore, an air flow, which tries to deviate from the air flow indicated by the arrow FB toward the other side in the constituent arranging direction Dh as indicated by an arrow FBa, can be suppressed by the primary hole peripheral plate portions 381*h*, 382*h*. In short, it is possible to reduce air leakage from the location between the condensing constituents 201.

Furthermore, as shown in FIGS. 33 to 35, during the manufacturing process of the heat exchanger 10, the primary hole peripheral plate portion 381*h* of the primary plate member 381 has a function of limiting positional deviation of the condensing unit fin 203 before the time of brazing toward the other side in the constituent arranging direction Dh. The primary hole peripheral plate portion 382*h* of the secondary plate member 382 also has the function that is the same as the function of the primary hole peripheral plate portion 381*h* of the primary plate member 381. Specifically, during the manufacturing process of the heat exchanger 10, each of the primary hole peripheral plate portions 381*h*, 382*h* can function as a fin stopper for positioning the condensing unit fin 203 before the time of brazing.

The advantage of the primary hole peripheral plate portions 381*h*, 382*h* implemented in the condensing unit 20 is likewise implemented by the secondary hole peripheral plate portions 381*i*, 382*i* at the evaporating unit 22. Specifically, as shown in FIG. 36, the secondary hole peripheral plate portion 381*i* of the primary plate member 381 has the function of guiding the air flow, which passes around the evaporating constituent 221 as indicated by an arrow FC, in the heat exchanger width direction Dw, and the secondary hole peripheral plate portion 382*i* of the secondary plate member 382 also has the function that is similar to the function of the secondary hole peripheral plate portion 381*i* of the primary plate member 381. Therefore, an air flow, which tries to deviate from the air flow indicated by the arrow FC toward the one side in the constituent arranging direction Dh as indicated by an arrow FCa, can be suppressed by the secondary hole peripheral plate portions 381*i*, 382*i*. In short, it is possible to reduce air leakage from the location between the evaporating constituents 221.

As described above, the hole peripheral plate portions 381*h*, 381*i*, 382*h*, 382*i* of each of the plate members 381, 382 can limit the flow of the air along the plate members 381, 382 indicated by an arrow FD of FIG. 35 between the condensing unit 20 and the evaporating unit 22.

Furthermore, as shown in FIGS. 33 to 35, during the manufacturing process of the heat exchanger 10, the secondary hole peripheral plate portion 381*i* of the primary plate member 381 has a function of limiting positional deviation of the evaporating unit fin 223 before the time of brazing toward the one side in the constituent arranging direction Dh. The secondary hole peripheral plate portion 382*i* of the secondary plate member 382 also has the function that is the same as the function of the secondary hole peripheral plate portion 381*i* of the primary plate member 381. Specifically, during the manufacturing process of the heat exchanger 10, each of the secondary hole peripheral plate portions 381*i*, 382*i* can function as a fin stopper for positioning the evaporating unit fin 223 before the time of brazing.

Except the points described above, the present embodiment is the same as the fifth embodiment. Furthermore, in the present embodiment, the advantages, which can be obtained from the common structure that is common to the fifth embodiment, can be obtained in the same manner as in the fifth embodiment.

Eighth Embodiment

Next, an eighth embodiment will be described. In the present embodiment, differences with respect to the above-described seventh embodiment will be mainly described.

Figure 37:
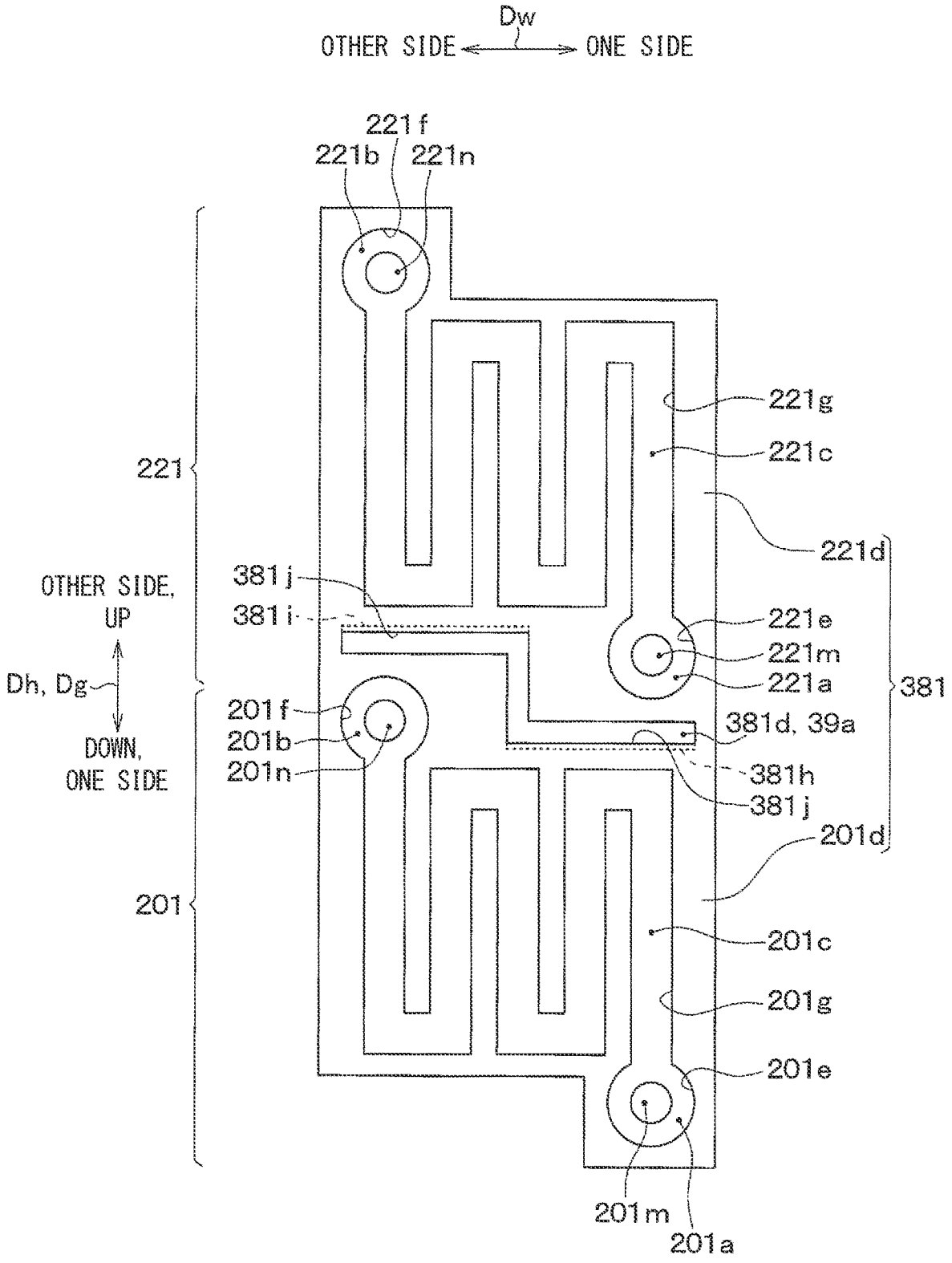
FIG. 37 is a cross-sectional view taken along line XXIX-XXIX in FIG. 28, corresponding to FIG. 29 and showing a primary plate member of an eighth embodiment.
Figure 38:
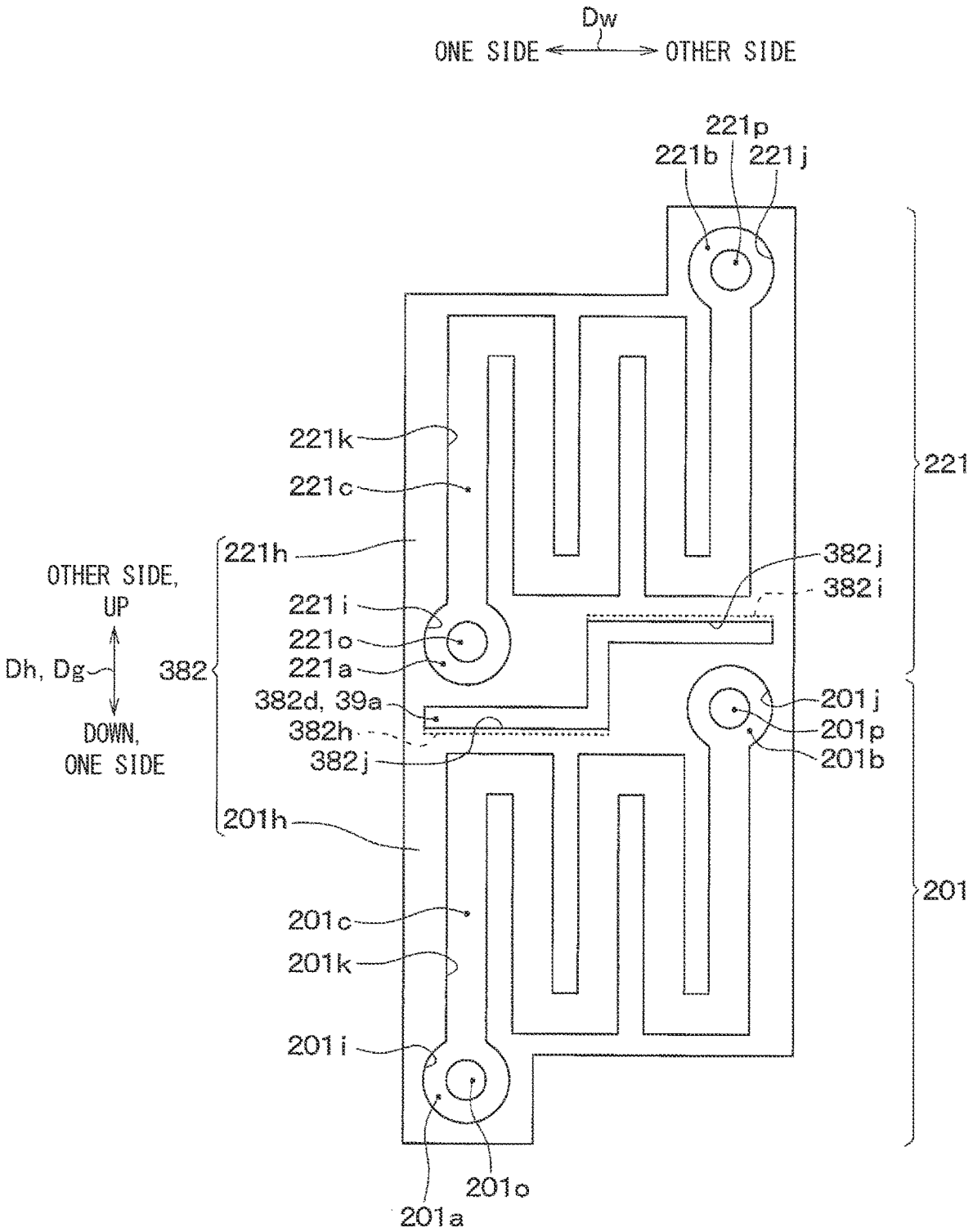
FIG. 38 is a cross-sectional view taken along line XXX-XXX in FIG. 28, corresponding to FIG. 30 and showing a secondary plate member of the eighth embodiment.

In the seventh embodiment, the joined plate member assembly 39 includes the two intermediate through holes 39*a*, 39*b*. However, in the present embodiment, as shown in FIGS. 37 and 38 the joined plate member assembly 39 includes one intermediate through hole 39*a* instead of the two intermediate through holes.

Specifically, the intermediate through hole 39*a* of the present embodiment is shaped as if the two intermediate through holes 39*a*, 39*b* of the seventh embodiment are connected to each other. For example, the intermediate through hole 39*a* of the present embodiment is formed in the joined plate member assembly 39 such that the opening of the intermediate through hole 39*a* is bent at a plurality of locations.

Since the number of the intermediate through hole 39*a* in the joined plate member assembly 39 is the one, the number of the primary plate member's intermediate hole 381*d* of the primary plate member 381 is also one, and the number of the secondary plate member's intermediate hole 382*d* of the secondary plate member 382 is also one.

Furthermore, each of the primary and secondary hole peripheral plate portions 381*h*, 381*i* of the primary plate member 381 is bent from the peripheral portion 381*j* of the primary plate member's intermediate hole 381*d* and is raised toward the one side in the stacking direction Ds. Furthermore, each of the primary and secondary hole peripheral plate portions 382*h*, 382*i* of the secondary plate member 382 is bent from the peripheral portion 382*j* of the secondary plate member's intermediate hole 382*d* and is raised toward the other side in the stacking direction Ds.

Except the points described above, the present embodiment is the same as the seventh embodiment. Furthermore, in the present embodiment, the advantages, which can be obtained from the common structure that is common to the seventh embodiment, can be obtained in the same manner as in the seventh embodiment.

Ninth Embodiment

Next, a ninth embodiment will be described. In the present embodiment, differences with respect to the above-described seventh embodiment will be mainly described.

Figure 39:
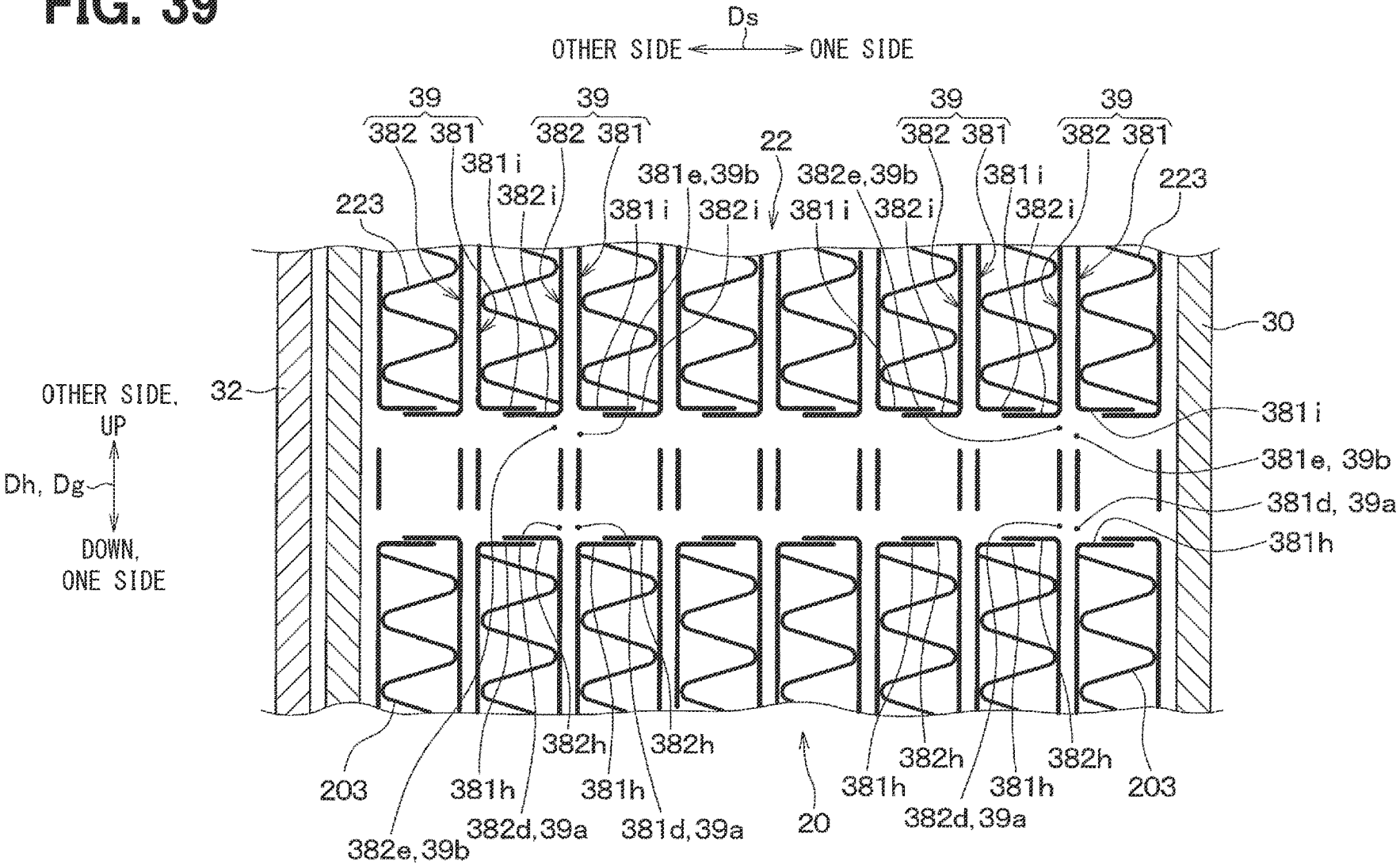
FIG. 39 is a cross-sectional view corresponding to FIG. 35 taken along line XXXV-XXXV in FIG. 33 and schematically showing a portion of a heat exchanger of a ninth embodiment.

As shown in FIG. 39, in the present embodiment, the hole peripheral plate portions 381*h*, 381*i*, 382*h*, 382*i* differ from those of the seventh embodiment.

Like in the seventh embodiment, in the present embodiment, the joined plate member assemblies 39 are stacked in the stacking direction Ds. However, in the present embodiment, one of each adjacent two of the joined plate member assemblies 39 is referred to as "one joined plate member assembly 39", and the other one of each adjacent two of the joined plate member assemblies 39 is referred to as "other joined plate member assembly 39." Furthermore, the one joined plate member assembly 39 is located on the one side of the other joined plate member assembly 39 in the stacking direction Ds. This also applies to the description of the embodiments described later.

Specifically, the primary hole peripheral plate portion 382*h* of the secondary plate member 382, which is included in the one joined plate member assembly 39, is located on the other side of the primary hole peripheral plate portion 381*h* of the primary plate member 381, which is included in the other joined plate member assembly 39, in the constituent arranging direction Dh, such that the primary hole peripheral plate portion 382*h* partially overlaps with the primary hole peripheral plate portion 381*h* of the primary plate member 381. For example, the primary hole peripheral plate portion 382*h* of the secondary plate member 382 is in contact with the primary hole peripheral plate portion 381*h* of the primary plate member 381.

Furthermore, the secondary hole peripheral plate portion 382*i* of the secondary plate member 382, which is included in the one joined plate member assembly 39, is located on the one side of the secondary hole peripheral plate portion 381*i* of the primary plate member 381, which is included in the other joined plate member assembly 39, in the constituent arranging direction Dh such that the secondary hole peripheral plate portion 382*i* partially overlaps with the secondary hole peripheral plate portion 381*i* of the primary plate member 381. For example, the secondary hole peripheral plate portion 382*i* of the secondary plate member 382 is in contact with the secondary hole peripheral plate portion 381*i* of the primary plate member 381.

In this way, it is possible to further increase the advantage of limiting the leakage of the air along the plate members 381, 382 indicated by the arrow FD (see FIG. 35) at the location between the condensing unit 20 and the evaporating unit 22 in comparison to the seventh embodiment.

Furthermore, at the time before the brazing in the manufacturing process of the heat exchanger 10, it is possible to limit the positional deviation of the secondary plate member 382 included in the one joined plate member assembly 39 relative to the primary plate member 381 included in the other joined plate member assembly 39 in the constituent arranging direction Dh.

Except the points described above, the present embodiment is the same as the seventh embodiment. Furthermore, in the present embodiment, the advantages, which can be obtained from the common structure that is common to the seventh embodiment, can be obtained in the same manner as in the seventh embodiment.

Although the present embodiment is a modification based on the second embodiment, the present embodiment can be combined with the eighth embodiment described above.

Tenth Embodiment

Next, a tenth embodiment will be described. In the present embodiment, differences with respect to the above-described fifth embodiment will be mainly described.

Figure 40:
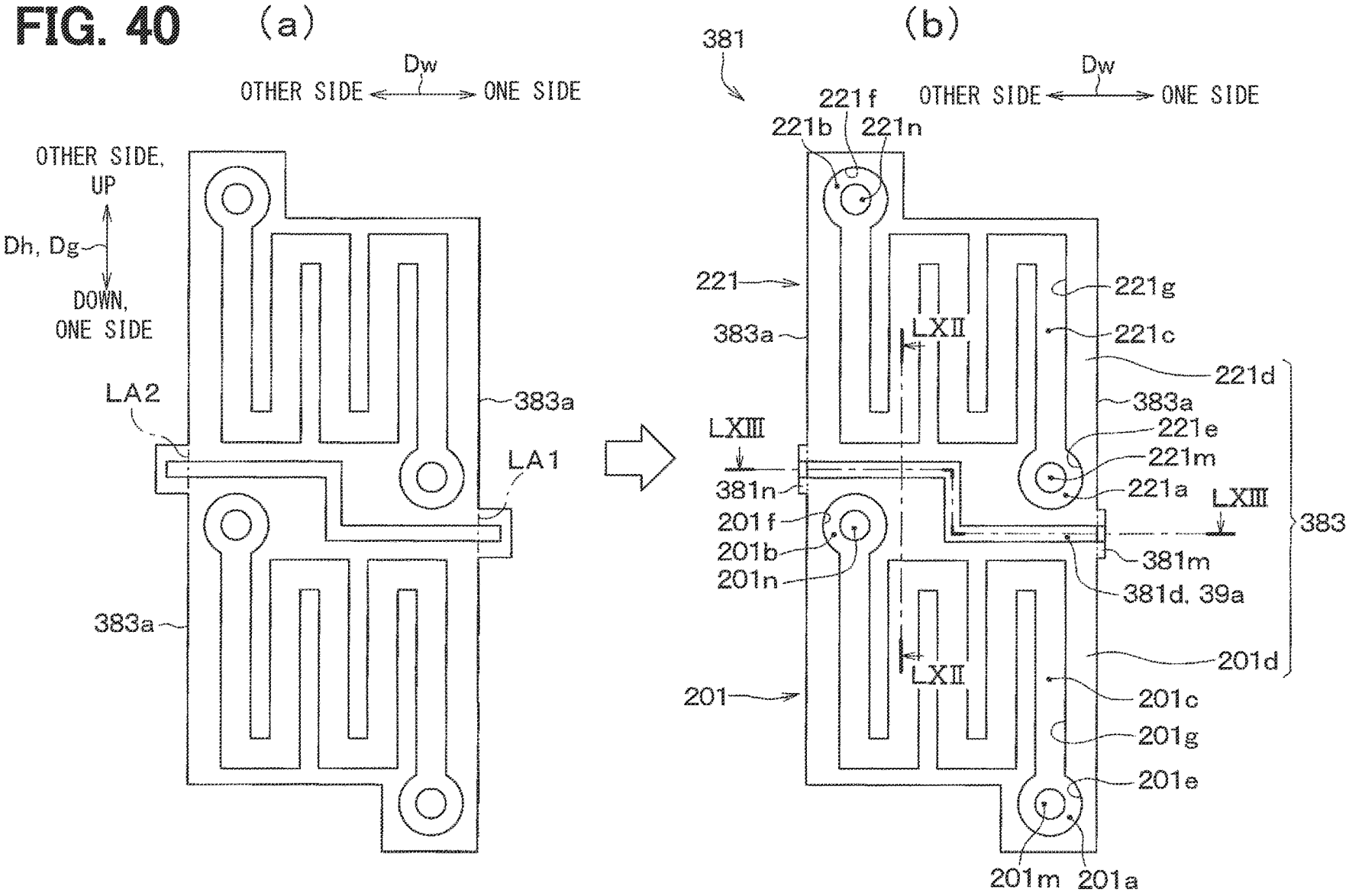
FIG. 40 is a cross-sectional view corresponding to FIG. 29 showing a primary plate member of a tenth embodiment while (a) indicates a state before bending and raising two primary outer peripheral plate portions relative to a primary plate member main body in a manufacturing process of the primary plate member, and (b) indicates the finished primary plate member.
Figure 41:
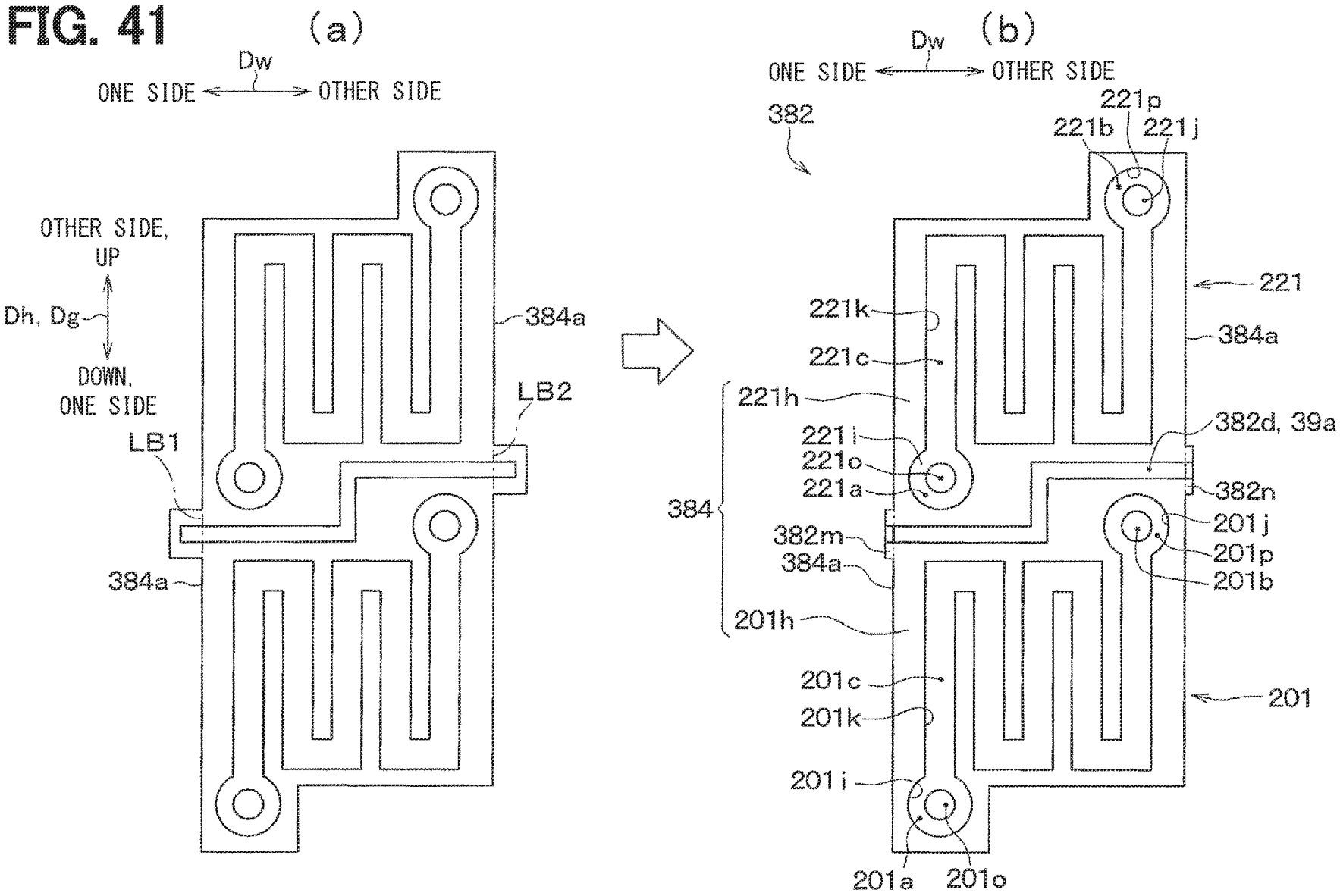
FIG. 41 is a cross-sectional view corresponding to FIG. 30 showing a secondary plate member of the tenth embodiment while (a) indicates a state before bending and raising two secondary outer peripheral plate portions relative to a secondary plate member main body in a manufacturing process of the secondary plate member, and (b) indicates the finished secondary plate member.
Figure 42:
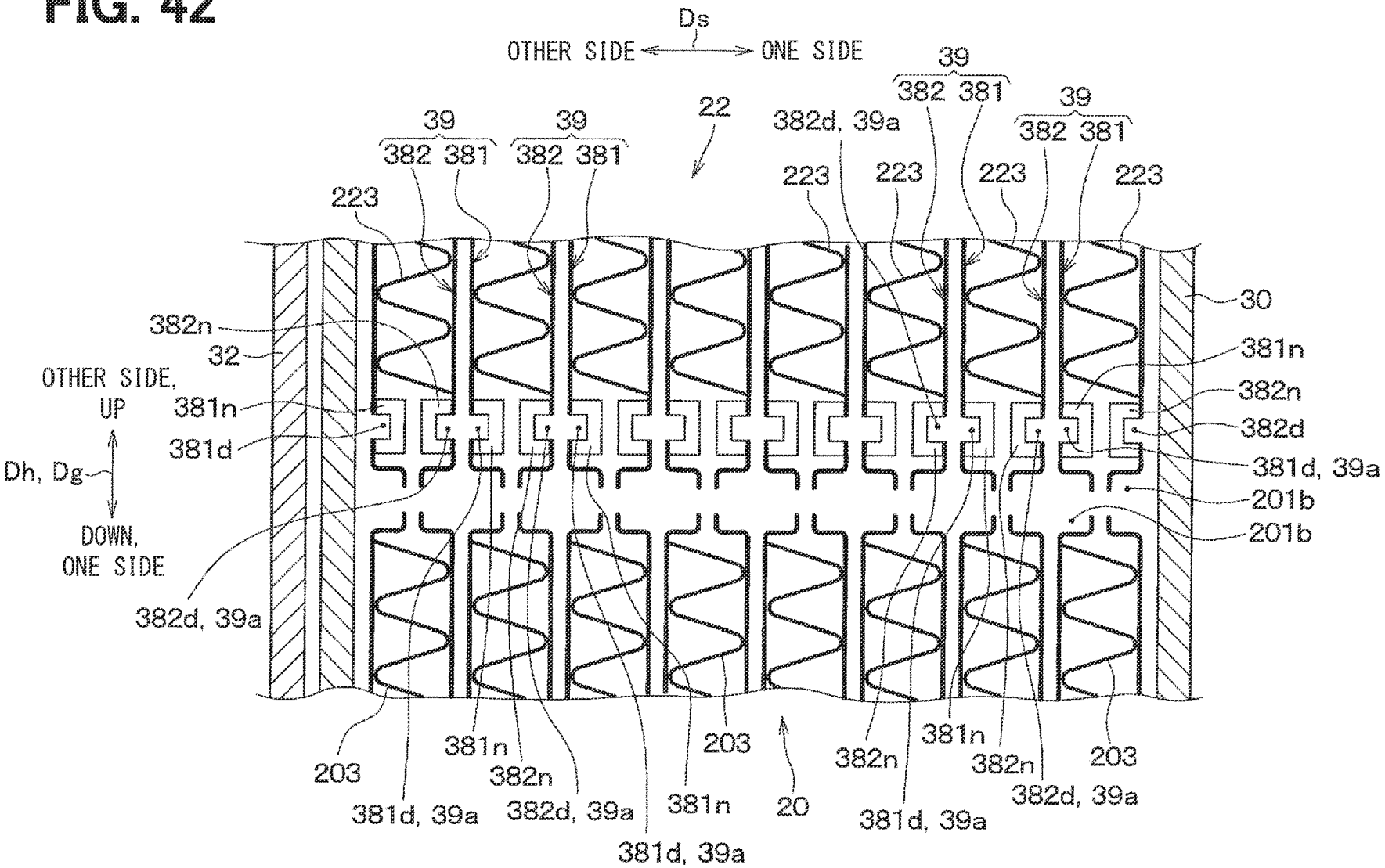
FIG. 42 is a cross-sectional view taken along line LXII-LXII in FIG. 40 schematically showing a portion of a heat exchanger of the tenth embodiment in a manner similar to FIG. 15.

As shown in FIGS. 40 to 42, in the present embodiment, the joined plate member assembly 39 includes one intermediate through hole 39*a* instead of the two intermediate through holes 39*a* like in the eighth embodiment. Furthermore, the primary plate member 381 includes a primary plate member main body 383 and two primary outer peripheral plate portions 381*m*, 381*n*. Also, the secondary plate member 382 includes a secondary plate member main body 384 and two secondary outer peripheral plate portions 382*m*, 382*n*. The present embodiment differs from the fifth embodiment with respect to this point.

Here, the primary plate member main body 383 of the present embodiment includes the one-side condensing plate portion 201*d* and the one-side evaporating plate portion 221*d*, which form the primary plate member 381 and extends in the constituent arranging direction Dh and the heat exchanger width direction Dw. Therefore, the primary plate member main body 383 of the present embodiment corresponds to the primary plate member 381 of the fifth embodiment.

Furthermore, the secondary plate member main body 384 of the present embodiment includes the other-side condensing plate portion 201*h* and the other-side evaporating plate portion 221*h*, which form the secondary plate member 382 and extends in the constituent arranging direction Dh and the heat exchanger width direction Dw. Therefore, the secondary plate member main body 384 of the present embodiment corresponds to the secondary plate member 382 of the fifth embodiment.

Here, it should be noted that (a) of FIG. 40 indicates a state before the two primary outer peripheral plate portions 381*m*, 381*n* are bent and raised relative to the primary plate member main body 383 during the manufacturing process of the primary plate member 381, and (b) of FIG. 40 indicates the finished primary plate member 381 alone. Likewise, (a) of FIG. 41 indicates a state before the secondary outer peripheral plate portions 382*m*, 381*n* are bent and raised relative to the secondary plate member main body 384 during the manufacturing process of the secondary plate member 382, and (b) of FIG. 41 indicates the finished secondary plate member 382 alone.

Figure 43:
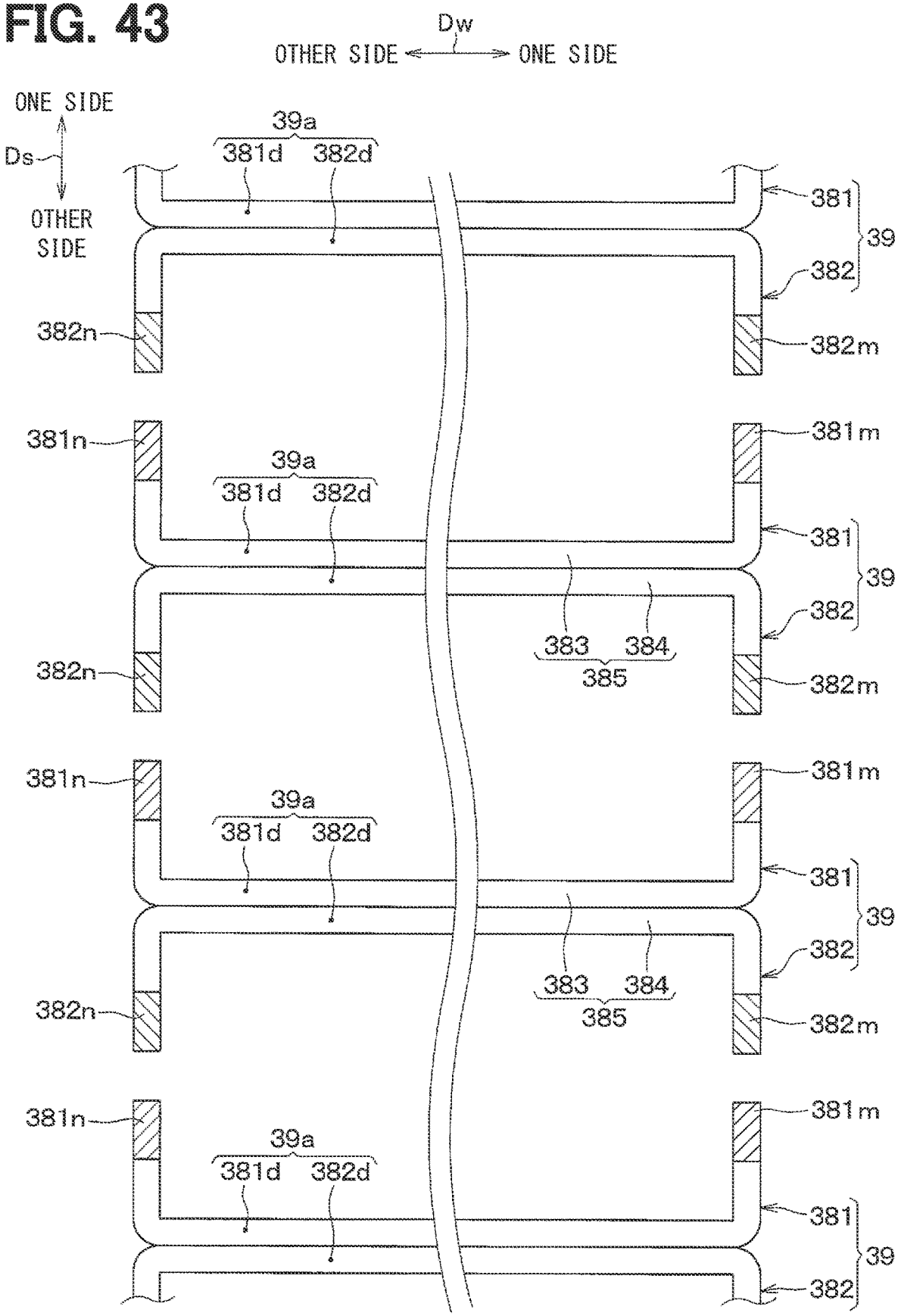
FIG. 43 is a cross-sectional view taken along line LXIII-LXIII in FIG. 40 in the tenth embodiment.

Specifically, in the present embodiment, as shown in (b) of FIG. 40 and FIG. 43, each of the two primary outer peripheral plate portions 381*m*, 381*n* of the primary plate member 381 is bent from the outer peripheral portion 383*a* of the primary plate member main body 383 and is raised toward the one side in the stacking direction Ds.

Specifically, a one-side primary outer peripheral plate portion 381*m*, which is the one of the two primary outer peripheral plate portions 381*m*, 381*n*, is located on the one side of the primary plate member main body 383 in the heat exchanger width direction Dw. In contrast, an other-side primary outer peripheral plate portion 381*n*, which is the other one of the two primary outer peripheral plate portions 381*m*, 381*n*, is located on the other side of the primary plate member main body 383 in the heat exchanger width direction Dw.

The one-side primary outer peripheral plate portion 381*m* and the other-side primary outer peripheral plate portion 381*n* are bent at the two different locations, respectively, of the outer peripheral portion 383*a* of the primary plate member main body 383 and are raised toward one side in the stacking direction Ds. In (a) of FIG. 40, a bending location of the one-side primary outer peripheral plate portion 381*m*, at which the one-side primary outer peripheral plate portion 381*m* is bent and is raised from the outer peripheral portion 383*a* of the primary plate member main body 383, is indicated by a dot-dash line LA1. Furthermore, a bending location of the other-side primary outer peripheral plate portion 381*n*, at which the other-side primary outer peripheral plate portion 381*n* is bent and is raised from the outer peripheral portion 383*a* of the primary plate member main body 383, is indicated by a dot-dash line LA2.

As shown in (b) of FIG. 41 and FIG. 43, each of the two secondary outer peripheral plate portions 382*m*, 382*n* of the secondary plate member 382 is bent from the outer peripheral portion 384*a* of the secondary plate member main body 384 and is raised toward the other side in the stacking direction Ds.

Specifically, the one-side secondary outer peripheral plate portion 382*m*, which is the one of the two secondary outer peripheral plate portions 382*m*, 382*n*, is located on the one side of the secondary plate member main body 384 in the heat exchanger width direction Dw. In contrast, the other-side secondary outer peripheral plate portion 382*n*, which is the other one of the two secondary outer peripheral plate portions 382*m*, 382*n*, is located on the other side of the secondary plate member main body 384 in the heat exchanger width direction Dw.

The one-side secondary outer peripheral plate portion 382*m* and the other-side secondary outer peripheral plate portion 382*n* are bent at the two different locations, respectively, of the outer peripheral portion 384*a* of the secondary plate member main body 384 and are raised toward the other side in the stacking direction Ds. In (a) of FIG. 41, a bending location of the one-side secondary outer peripheral plate portion 382*m*, at which the one-side secondary outer peripheral plate portion 382*m* is bent and is raised from the outer peripheral portion 384*a* of the secondary plate member main body 384, is indicated by a dot-dash line LB1. Furthermore, a bending location of the other-side secondary outer peripheral plate portion 382*n*, at which the other-side secondary outer peripheral plate portion 382*n* is bent and is raised from the outer peripheral portion 384*a* of the secondary plate member main body 384, is indicated by a dot-dash line LB2.

As shown in (b) of FIG. 40, FIG. 42 and FIG. 43, the intermediate through hole 39*a* extends from the primary plate member main body 383 to each of the one-side primary outer peripheral plate portion 381*m* and the other-side primary outer peripheral plate portion 381*n* in the primary plate member 381. Furthermore, as shown in (b) of FIG. 41, FIG. 42 and FIG. 43, the intermediate through hole 39*a* extends from the secondary plate member main body 384 to each of the one-side secondary outer peripheral plate portion 382*m* and the other-side secondary outer peripheral plate portion 382*n* in the secondary plate member 382.

Therefore, as shown in (b) of FIG. 40 and (b) of FIG. 41, the intermediate through hole 39*a* extends in the heat exchanger width direction Dw along the entire width of a main body lamination 385 (see FIG. 43), which is formed by the primary plate member main body 383 and the secondary plate member main body 384 of the joined plate member assembly 39. The intermediate through hole 39*a* extends through the main body lamination 385, the one-side primary outer peripheral plate portion 381*m*, the other-side primary outer peripheral plate portion 381*n*, the one-side secondary outer peripheral plate portion 382*m* and the other-side secondary outer peripheral plate portion 382*n*. In short, the intermediate through hole 39*a* extends through the joined plate member assembly 39.

Because of the above-described configuration, the intermediate through hole 39*a* separates the condensing constituent 201 from the evaporating constituent 221 at the primary plate member main body 383 and the secondary plate member main body 384. In other words, the intermediate through hole 39*a* separates the condensing constituent 201 from the evaporating constituent 221 at the main body lamination 385.

at the joined plate member assembly 39, the condensing constituent 201 and the corresponding evaporating constituent 221 are connected with each other through each of the one-side primary outer peripheral plate portion 381*m*, the other-side primary outer peripheral plate portion 381*n*, the one-side secondary outer peripheral plate portion 382*m* and the other-side secondary outer peripheral plate portion 382*n*.

As described above, in the present embodiment, the intermediate through hole 39*a* extends from the primary plate member main body 383 to each of the two primary outer peripheral plate portions 381*m*, 381*n* at the primary plate member 381. Also, the intermediate through hole 39*a* extends from the secondary plate member main body 384 to each of the two secondary outer peripheral plate portions 382*m*, 382*n* at the secondary plate member 382.

Therefore, the heat transfer path, along which the heat is conducted between the refrigerant in the condensing constituent 201 and the refrigerant in the evaporating constituent 221 through the joined plate member assembly 39, i.e., the heat transfer path between the condensing constituent 201 and the evaporating constituent 221 always passes through one of the outer peripheral plate portions 381*m*, 381*n*, 382*m*, 382*n*. Therefore, in comparison to a case where the outer peripheral plate portions 381*m*, 381*n*, 382*m*, 382*n* are not provided, the heat transfer path can be increased. Therefore, it is possible to reduce the heat transfer loss at the time of exchanging the heat at each of the condensing unit 20 and the evaporating unit 22.

Furthermore, each of the outer peripheral plate portions 381*m*, 381*n*, 382*m*, 382*n* is shaped in the raised form described above, so that the width of the joined plate member assembly 39 measured in the heat exchanger width direction Dw is not substantially increased, and there is no substantial influence on the size of the heat exchanger 10.

The two primary outer peripheral plate portions 381*m*, 381*n* can increase the flexural rigidity of the primary plate member 381 before the time of joining by the brazing in the manufacturing process of the heat exchanger 10, i.e., the primary plate member 381 alone as follows. Specifically, in the primary plate member 381 alone, it is possible to increase the flexural rigidity against the bending that displaces the one end of the primary plate member 381, which is located on the one side in the constituent arranging direction Dh, relative to the other end of the primary plate member 381, which is located on the other side, in the thickness direction of the primary plate member 381. This is also true for the secondary plate member 382.

Figure 44:
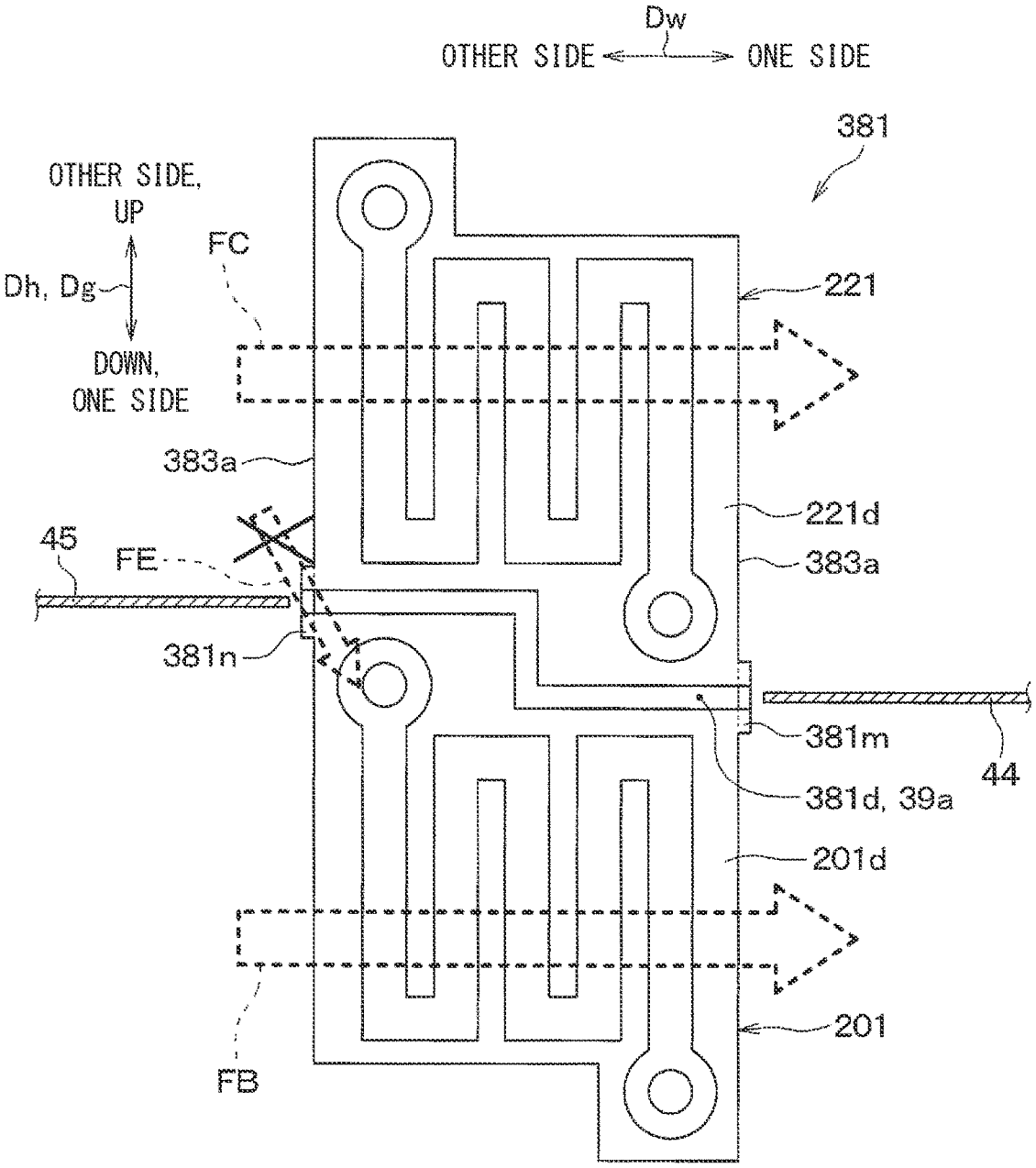
FIG. 44 is a cross-sectional view corresponding to (b) of FIG. 40 and schematically showing an air flow passing through a condensing unit and an air flow passing through an evaporating unit with broken arrows in the tenth embodiment.

Furthermore, as shown in (b) of FIG. 40 and (b) of FIG. 41, each of the outer peripheral plate portions 381*m*, 381*n*, 382*m*, 382*n* of the joined plate member assembly 39 is located at an intermediate location between the condensing constituent 201 and the evaporating constituent 221 in the constituent arranging direction Dh. Therefore, as shown in FIG. 44, the outer peripheral plate portions 381*m*, 381*n*, 382*m*, 382*n* can have the function of separating between the air flow, which passes around the condensing constituent 201 as indicated by the arrow FB, and the air flow, which passes around the evaporating constituent 221 as indicated by the arrow FC. For example, the air flow, which tries to flow from the evaporating unit 22 toward the condensing unit 20 as indicated by an arrow FE, can be limited by the other-side primary outer peripheral plate portion 381*n* and the other-side secondary outer peripheral plate portion 382*n*.

Here, it should be noted that FIG. 44 indicates a one-side partition plate 44, which is located on the one side of the heat exchanger 10 in the heat exchanger width direction Dw, and an other-side partition plate 45, which is located on the other side of the heat exchanger 10 in the heat exchanger width direction Dw. The other-side partition plate 45 partitions between the air flow, which flows toward the condensing unit 20 as indicated by the arrow FB, and the air flow, which flows toward the evaporating unit 22 as indicated by the arrow FC, at the location that is on the upstream side of the heat exchanger 10 in the flow direction of the air flow. Furthermore, the one-side partition plate 44 partitions between the air flow, which flows out from the condensing unit 20 as indicated by the arrow FB, and the air flow, which flows out from the evaporating unit 22 as indicated by the arrow FC, at the location that is on the downstream side of the heat exchanger 10 in the flow direction of the air flow.

Furthermore, according to the present embodiment, each of the one-side primary outer peripheral plate portion 381*m* and the other-side primary outer peripheral plate portion 381*n* is bent from the outer peripheral portion 383*a* of the primary plate member main body 383 and is raised. Therefore, the higher strength can be obtained as compared with, for example, a case where the primary outer peripheral plate portions 381*m*, 381*n* are joined to the primary plate member main body 383 by brazing. This is also true for the secondary outer peripheral plate portions 382*m*, 382*n* of the secondary plate member 382.

Furthermore, according to the present embodiment, the intermediate through hole 39*a* separates the condensing constituent 201 from the evaporating constituent 221 in the main body lamination 385 (see FIG. 43) which is formed by the primary plate member main body 383 and the secondary plate member main body 384 of the joined plate member assembly 39. At the joined plate member assembly 39, the condensing constituent 201 and the corresponding evaporating constituent 221 are connected with each other through each of the one-side primary outer peripheral plate portion 381*m*, the other-side primary outer peripheral plate portion 381*n*, the one-side secondary outer peripheral plate portion 382*m* and the other-side secondary outer peripheral plate portion 382*n*. Therefore, the heat transfer between the condensing constituent 201 and the evaporating constituent 221 at the primary plate member main body 383 and the secondary plate member main body 384 can be largely suppressed while the condensing constituent 201 and the evaporating constituent 221 are formed as the integrated body.

Except the points described above, the present embodiment is the same as the fifth embodiment. Furthermore, in the present embodiment, the advantages, which can be obtained from the common structure that is common to the fifth embodiment, can be obtained in the same manner as in the fifth embodiment.

Eleventh Embodiment

Next, an eleventh embodiment will be described. In the present embodiment, differences with respect to the above-described tenth embodiment will be mainly described.

Figure 45:
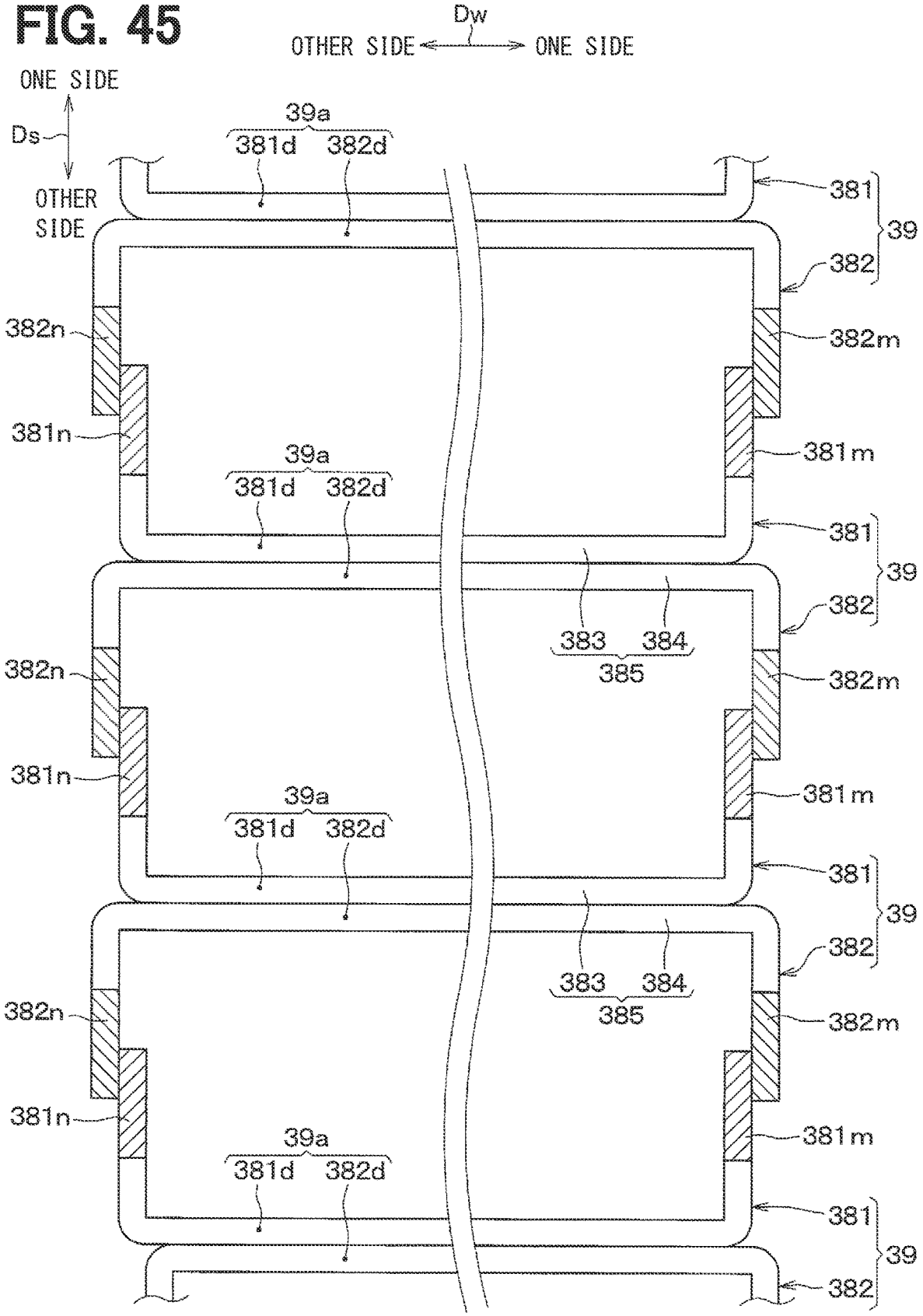
FIG. 45 is a cross-sectional view of an eleventh embodiment indicating a cross-sectional view taken along line LXIII-LXIII in FIG. 40 and corresponding to FIG. 43.

As shown in FIG. 45, in the present embodiment, the primary outer peripheral plate portions 381*m*, 381*n* and the secondary outer peripheral plate portions 382*m*, 382*n* are different from those of the tenth embodiment.

Specifically, the one-side secondary outer peripheral plate portion 382*m* of the secondary plate member 382, which is included in the one joined plate member assembly 39, is located on the one side of the one-side primary outer peripheral plate portion 381*m* of the primary plate member 381, which is included in the other joined plate member assembly 39, in the heat exchanger width direction Dw such that the one-side secondary outer peripheral plate portion 382*m* partially overlaps with the one-side primary outer peripheral plate portion 381*m* of the primary plate member 381. For example, the one-side secondary outer peripheral plate portion 382*m* is in contact with the one-side primary outer peripheral plate portion 381*m*.

Furthermore, the other-side secondary outer peripheral plate portion 382*n* of the secondary plate member 382, which is included in the one joined plate member assembly 39, is located on the other side of the other-side primary outer peripheral plate portion 381*n* of the primary plate member 381, which is included in the other joined plate member assembly 39, in the heat exchanger width direction Dw such that the other-side secondary outer peripheral plate portion 382*n* partially overlaps with the other-side primary outer peripheral plate portion 381*n* of the primary plate member 381. For example, the other-side secondary outer peripheral plate portion 382*n* is in contact with the other-side primary outer peripheral plate portion 381*n*.

Therefore, in comparison to the tenth embodiment, it is possible to further improve the function of separating between the air flow, which passes around the condensing constituent 201 as indicated by the arrow FB (see FIG. 44), and the air flow, which passes around the evaporating constituent 221 as indicated by the arrow FC (see FIG. 44).

Furthermore, at the time before the brazing in the manufacturing process of the heat exchanger 10, it is possible to limit the positional deviation of the secondary plate member 382 included in the one joined plate member assembly 39 relative to the primary plate member 381 included in the other joined plate member assembly 39 in the heat exchanger width direction Dw.

Except the points described above, the present embodiment is the same as the tenth embodiment. Furthermore, in the present embodiment, the advantages, which can be obtained from the common structure that is common to the tenth embodiment, can be obtained in the same manner as in the tenth embodiment.

Other Embodiments (1) In the first embodiment described above, as shown in FIGS. 1 and 2, heat exchanger 10 includes the gas-liquid separating device 26 which serves as the accumulator. However, this is only one example. For example, as shown in FIG. 46, the heat exchanger 10 may include a receiver 42, which functions as the gas-liquid separator, in place of the gas-liquid separating device 26.

Figure 46:
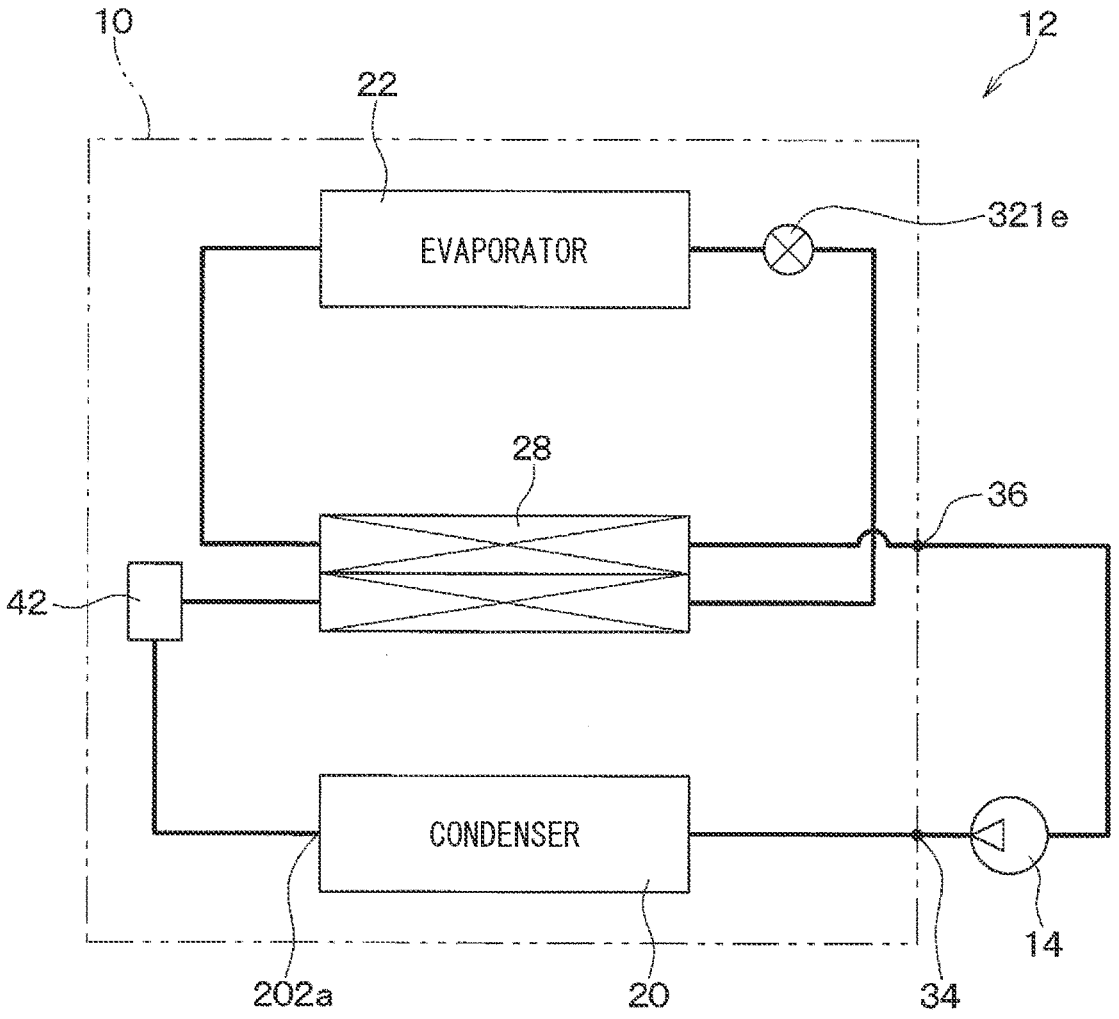
FIG. 46 is a refrigerant circuit diagram corresponding to FIG. 1 and showing a refrigeration cycle circuit in a first modification, which is a modification of the first embodiment.

As shown in FIG. 46, the receiver 42 is placed between the condensing unit outlet 202*a* and the inner flow passage 28*b* (see FIG. 2) of the internal heat exchanging unit 28 along the refrigerant flow. The receiver 42 stores the refrigerant (specifically, the two-phase refrigerant of a gas and liquid refrigerant mixture, or the liquid phase refrigerant alone) inputted from the condensing unit 20 into the receiver 42 and outputs the separated liquid phase refrigerant separated at the receiver 42 to the inner flow passage 28*b* of the internal heat exchanging unit 28.

For example, the receiver 42 of FIG. 46 may be provided to the one-side side plate portion 30 by stacking a plurality of plates like the gas-liquid separating device 26 of FIG. 2 or may be fixed to the one side of the one-side side plate portion 30 in the stacking direction Ds.

(2) In the first embodiment described above, as shown in FIG. 7, the outlet-side condensing constituent 202, which includes the condensing unit outlet 202*a*, is located at the one end of the stack of the condensing constituents 201 on the one side in the stacking direction Ds. However, this is only one example. Depending on the arrangement of the refrigerant flow in the heat exchanger 10, the outlet-side condensing constituent 202 may be located at the other end of the stack of the condensing constituents 201 on the other side in the stacking direction Ds. In short, it is only required that the outlet-side condensing constituent 202 is located at the end of the stack of the condensing constituents 201.

(3) In the first embodiment described above, as shown in FIG. 8, the inlet-side evaporating constituent 222, which includes the evaporating unit inlet 222*a*, is located at the other end of the stack of the evaporating constituents 221 on the other side in the stacking direction Ds. However, this is only one example. Depending on the arrangement of the refrigerant flow in the heat exchanger 10, the inlet-side evaporating constituent 222 may be located at the one end of the stack of the evaporating constituents 221 on the one side in the stacking direction Ds. In short, it is only required that the inlet-side evaporating constituent 222 is located at the end of the stack of the evaporating constituent 221.

(4) In the first embodiment described above, as shown in FIGS. 2, 5 and 6, the one-side condensing plate portion 201*d*, the one-side evaporating plate portion 221*d* and the primary outer tube constituent 281*a* form the primary plate member 381. Furthermore, the other-side condensing plate portion 201*h*, the other-side evaporating plate portion 221*h* and the secondary outer tube constituent 281*b* form the secondary plate member 382. However, this is merely one example. For example, one of the combination of the one-side condensing plate portion 201*d*, the one-side evaporating plate portion 221*d* and the primary outer tube constituent 281*a*, and the combination of the other-side condensing plate portion 201*h*, the other-side evaporating plate portion 221*h* and the secondary outer tube constituent 281*b* may be formed as a combination of a plurality of components which are separately formed.

(5) In the first embodiment described above, as shown in FIGS. 2 and 7, in each of the condensing constituents 201, the pair of condensing plate portions 201*d*, 201*h* are stacked in the stacking direction Ds. However, this is merely one example. For example, in one or more of the condensing constituents 201 included in the condensing unit 20, the pair of condensing plate portions 201*d*, 201*h* may be formed such that the pair of condensing plate portions 201*d*, 201*h* are not stacked in the stacking direction Ds. In short, it is only required that at least one of the condensing constituents 201 included in the condensing unit 20 includes the pair of condensing plate portions 201*d*, 201*h*.

(6) In the first embodiment described above, as shown in FIGS. 2 and 8, each of the evaporating constituents 221 includes the pair of evaporating plate portions 221*d*, 221*h*. However, this is merely one example. For example, in one or more of the evaporating constituents 221 included in the evaporating unit 22, the pair of evaporating plate portions 221*d*, 221*h* may be formed such that the pair of evaporating plate portions 221*d*, 221*h* are not stacked in the stacking direction Ds. In short, it is only required that at least one of the evaporating constituents 221 included in the evaporating unit 22 includes the pair of evaporating plate portions 221*d*, 221*h*.

(7) In the first embodiment described above, as shown in FIGS. 2, 5 and 6, the internal space of the condensing constituent 201 is formed by the recess, which is produced by recessing the one-side condensing plate portion 201*d* toward the one side in the stacking direction Ds, and the recess, which is produced by recessing the other-side condensing plate portion 201*h* toward the other side in the stacking direction Ds. However, this is merely one example. For example, one of the one-side condensing plate portion 201*d* and the other-side condensing plate portion 201*h* may be in a form of a planar plate without having the recess that is recessed in the stacking direction Ds. This is also true with respect to the shape of the one-side evaporating plate portion 221*d* and the shape of the other-side evaporating plate portion 221*h*.

(8) In the second embodiment described above, as shown in FIGS. 15 and 17, the groove 322*a* of the other-side secondary plate 322 does not have the function of reducing the pressure of the refrigerant by restricting the refrigerant flow. However, this is only one example. For example, the groove 322*a* may be formed as a capillary for restricting the refrigerant flow to have the function of reducing the pressure of the refrigerant.

(9) In the first embodiment described above, as shown in FIG. 2, the evaporating unit 22, the internal heat exchanging unit 28 and the condensing unit 20 are arranged in this order from the upper side in the gravity direction Dg. However, the present disclosure should not be limited to this arranging order and the arranging direction. For example, the evaporating unit 22, the internal heat exchanging unit 28 and the condensing unit 20 may be arranged in a horizontal direction. Also, the condensing unit 20 may be located on the upper side of the evaporating unit 22 in the gravity direction Dg.

(10) In the first embodiment described above, as shown in FIG. 2, the heat exchanger 10 includes the gas-liquid separating device 26, the internal heat exchanging unit 28 and the flow restricting portion 321*e* in addition to the evaporating unit 22 and the condensing unit 20. However, this is only one example. For example, it is conceivable that the heat exchanger 10 does not include one or more or all of the gas-liquid separating device 26, the internal heat exchanging unit 28 and the flow restricting portion 321*e*.

Figure 47:
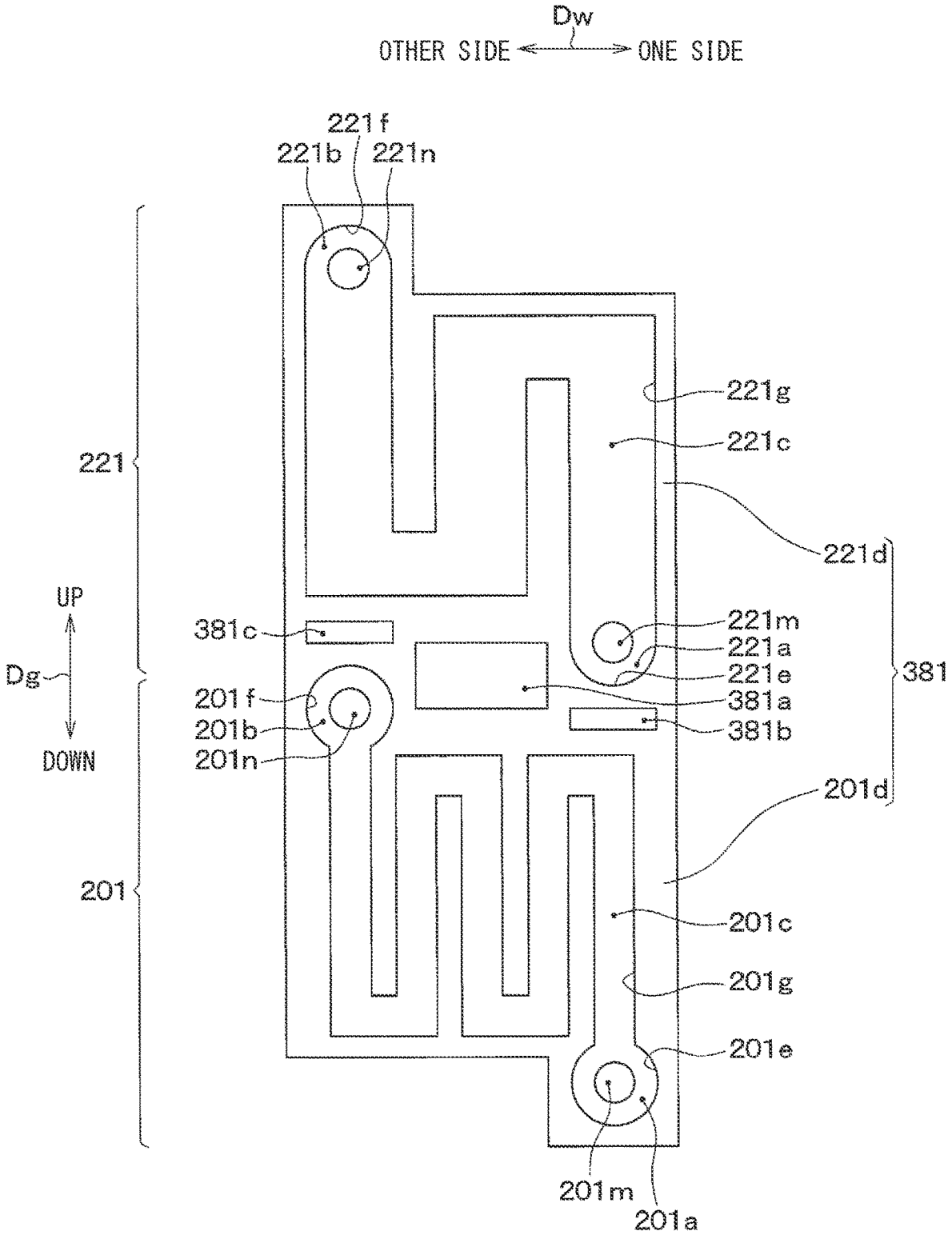
FIG. 47 is a cross-sectional view corresponding to FIG. 18 and showing shapes and locations of a one-side condensing tank space, an other-side condensing tank space, a condensing flow passage, a one-side evaporating tank space, an other-side evaporating tank space and an evaporating flow passage in a second modification which is a modification of the second embodiment.
Figure 48:
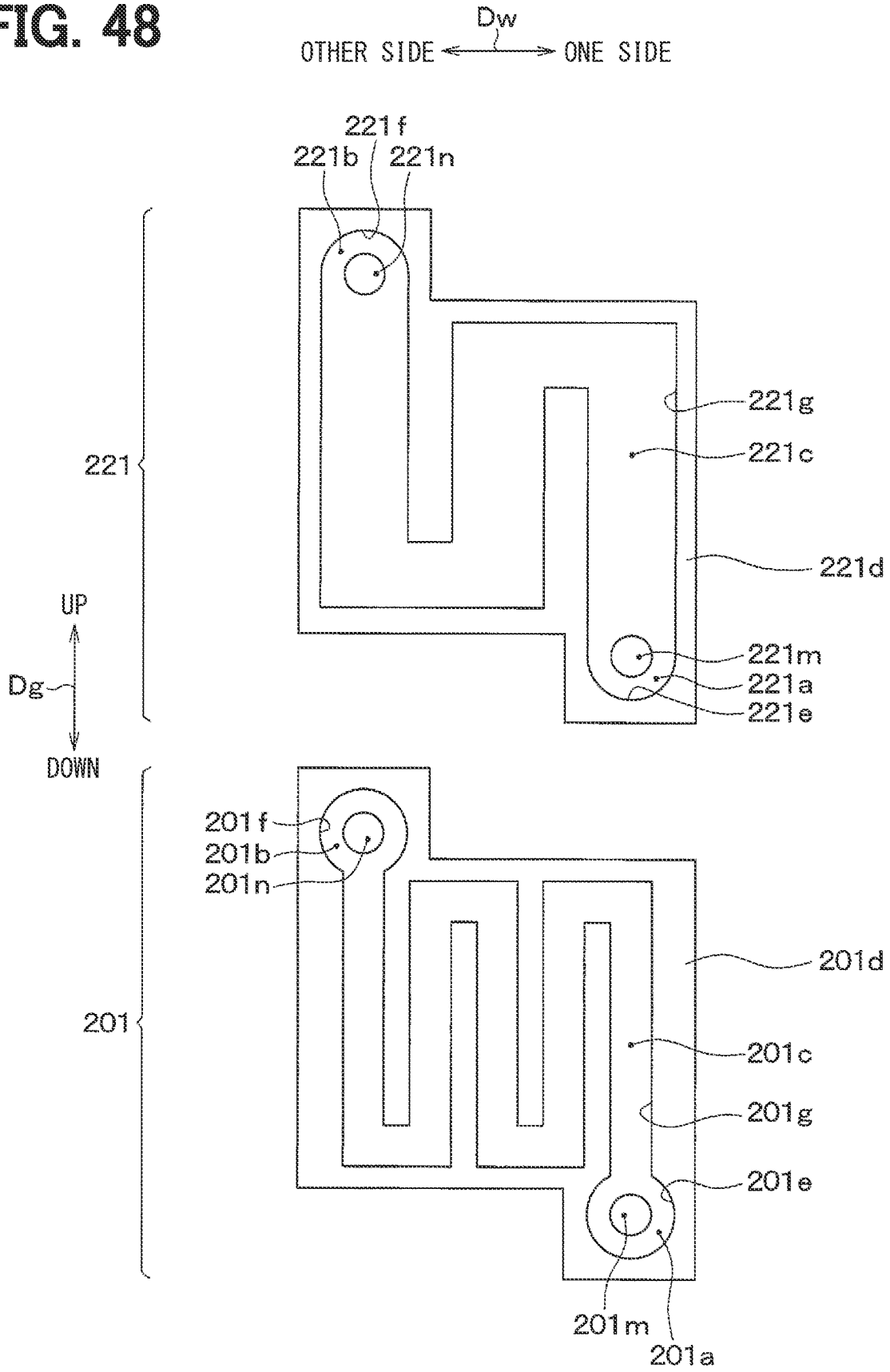
FIG. 48 is a cross-sectional view corresponding to FIG. 24 and showing shapes and locations of a one-side condensing tank space, an other-side condensing tank space, a condensing flow passage, a one-side evaporating tank space, an other-side evaporating tank space and an evaporating flow passage in a third modification which is a modification of the fourth embodiment.

(11) In the second embodiment described above, as shown in FIGS. 18 and 19, the shape of the condensing flow passage 201*c* and the shape of the evaporating flow passage 221*c* are identical to each other. However, this is only one example. For example, as shown in FIG. 47, the shape of the condensing flow passage 201*c* and the shape of the evaporating flow passage 221*c* may be different from each other. This is also true in the fourth embodiment in which the condensing plate portion 201*d*, 201*h* and the evaporating plate portion 221*d*, 221*h* are formed as separate components as shown in, for example, FIG. 48.

Figure 49:
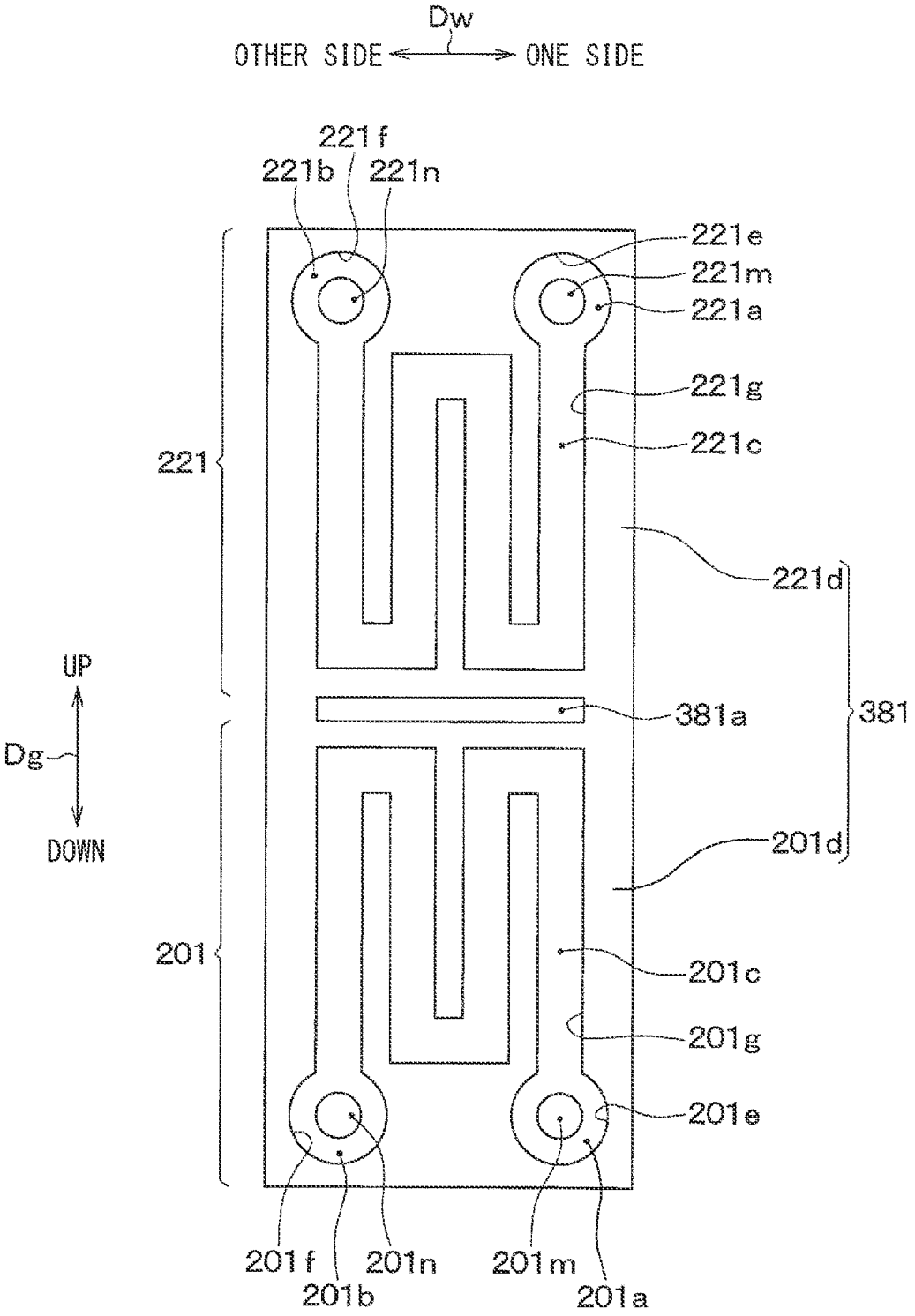
FIG. 49 is a cross-sectional view corresponding to FIG. 18 and showing shapes and locations of a one-side condensing tank space, an other-side condensing tank space, a condensing flow passage, a one-side evaporating tank space, an other-side evaporating tank space and an evaporating flow passage in a fourth modification which is a modification of the second embodiment.
Figure 50:
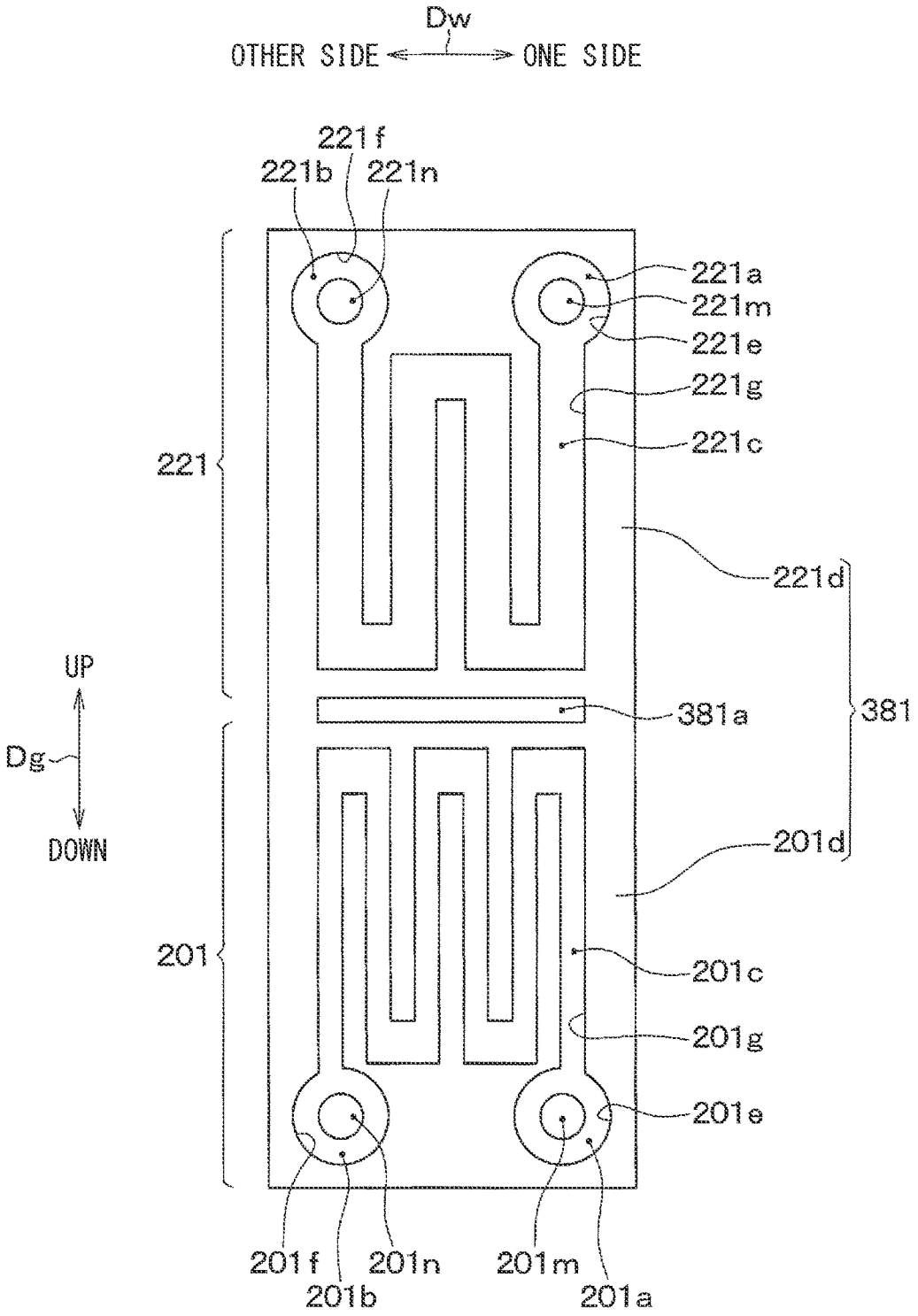
FIG. 50 is a cross-sectional view corresponding to FIG. 18 and showing shapes and locations of a one-side condensing tank space, an other-side condensing tank space, a condensing flow passage, a one-side evaporating tank space, an other-side evaporating tank space and an evaporating flow passage in a fifth modification which is a modification of the second embodiment.

(12) In the second embodiment described above, as shown in FIGS. 18 and 19, the one of the one-side condensing tank space 201*a* and the other-side condensing tank space 201*b* is located on the upper side of the condensing flow passage 201*c* in the gravity direction Dg. Furthermore, the other one of the one-side condensing tank space 201*a* and the other-side condensing tank space 201*b* is located on the lower side of the condensing flow passage 201*c* in the gravity direction Dg. However, this is merely one example. For example, as shown in FIGS. 49 and 50, both of the one-side condensing tank space 201*a* and the other-side condensing tank space 201*b* may be located only on one of the upper side and the lower side of the condensing flow passage 201*c* in the gravity direction Dg. FIGS. 49 and 50 indicate an example in which both of the one-side condensing tank space 201*a* and the other-side condensing tank space 201*b* are located on the lower side of the condensing flow passage 201*c* in the gravity direction Dg.

This is also true for the structure of the evaporating unit 22. Specifically, as shown in FIGS. 49 and 50, both of the one-side evaporating tank space 221*a* and the other-side evaporating tank space 221*b* may be located only on one of the upper side and the lower side of the evaporating flow passage 221*c* in the gravity direction Dg. FIGS. 49 and 50 indicate an example in which both of the one-side evaporating tank space 221*a* and the other-side evaporating tank space 221*b* are located on the upper side of the evaporating flow passage 221*c* in the gravity direction Dg.

Figure 51:
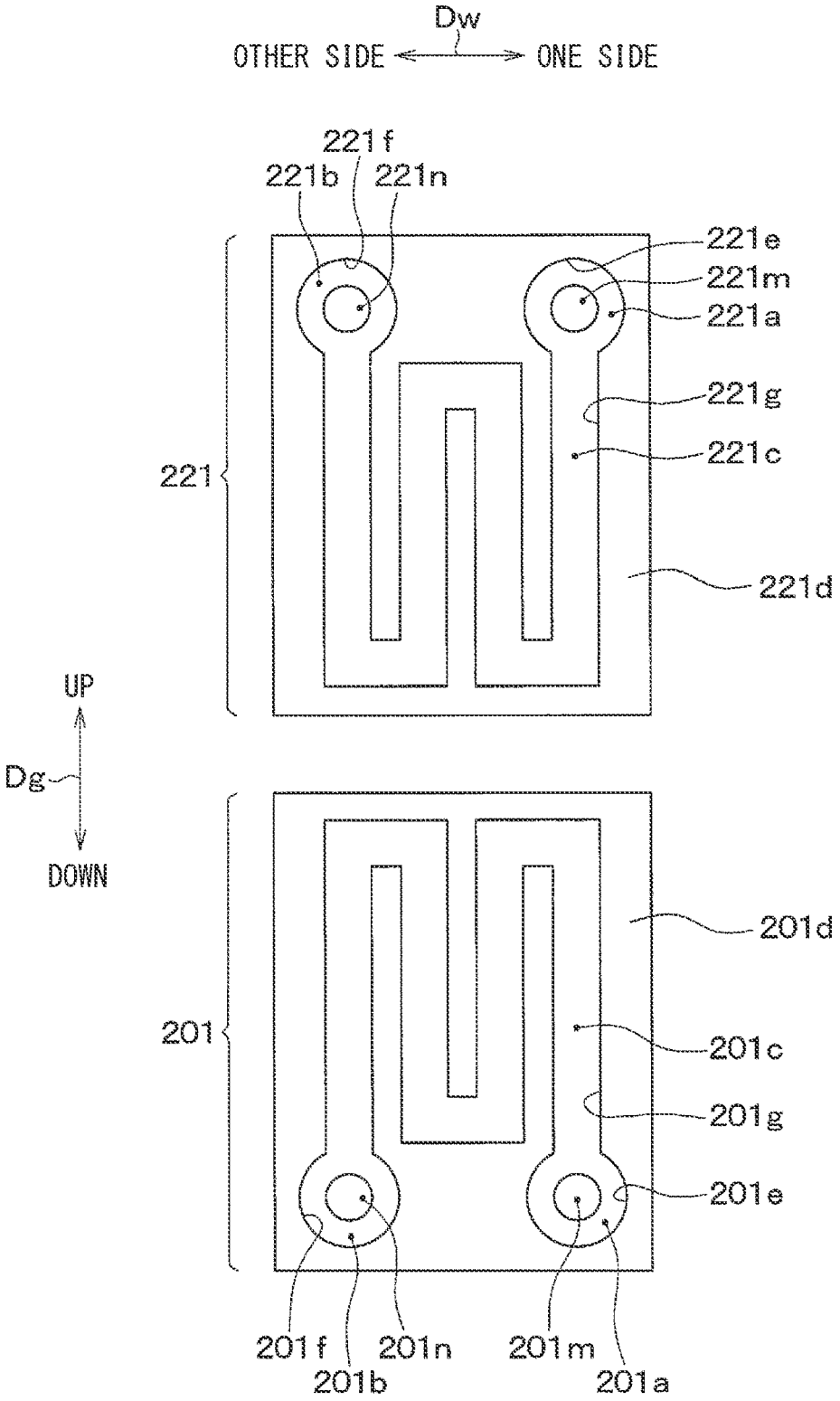
FIG. 51 is a cross-sectional view corresponding to FIG. 24 and showing shapes and locations of a one-side condensing tank space, an other-side condensing tank space, a condensing flow passage, a one-side evaporating tank space, an other-side evaporating tank space and an evaporating flow passage in a sixth modification which is a modification of the fourth embodiment.
Figure 52:
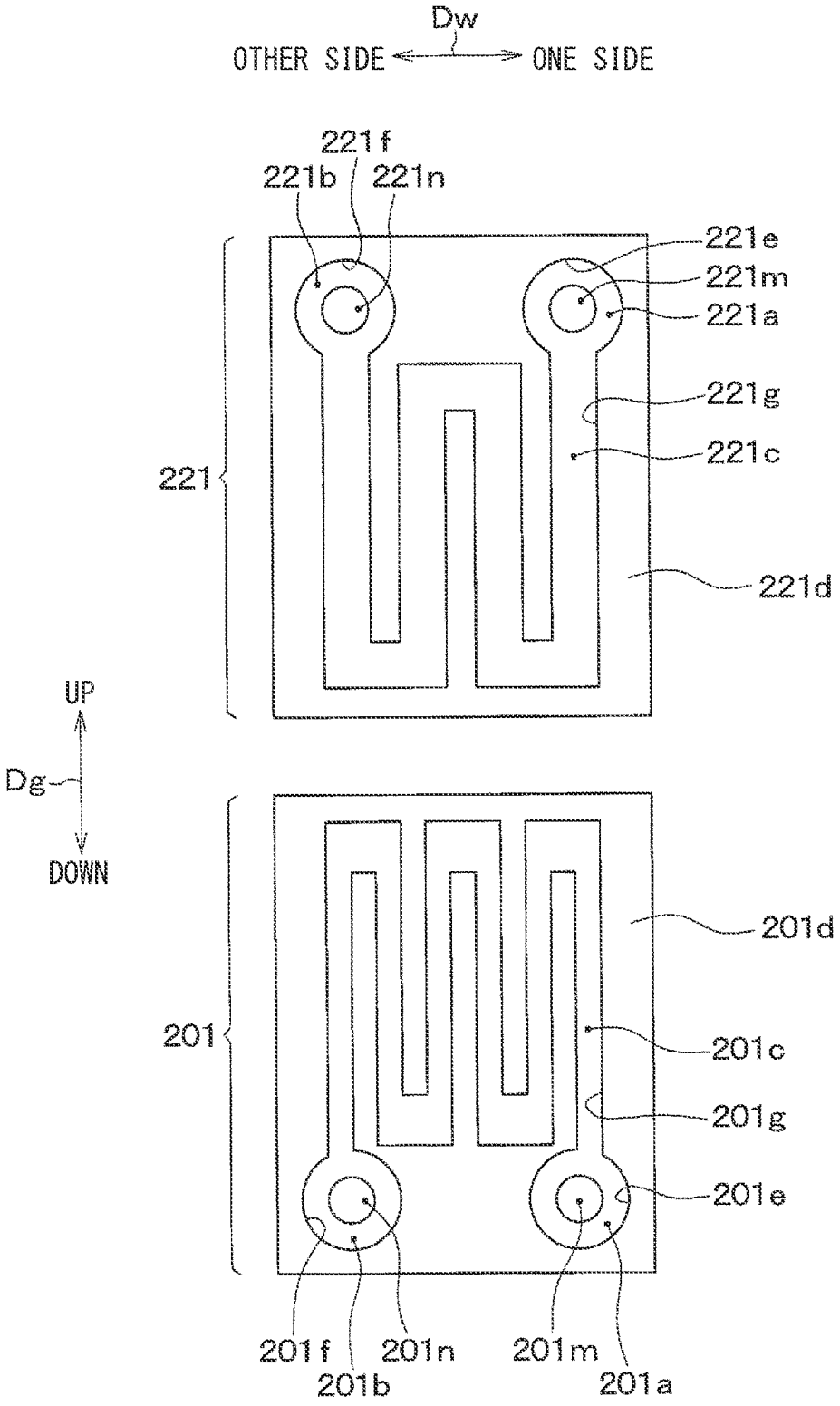
FIG. 52 is a cross-sectional view corresponding to FIG. 24 and showing shapes and locations of a one-side condensing tank space, an other-side condensing tank space, a condensing flow passage, a one-side evaporating tank space, an other-side evaporating tank space and an evaporating flow passage in a seventh modification which is a modification of the fourth embodiment.

Furthermore, this is also true in the fourth embodiment in which the condensing plate portion 201*d*, 201*h* and the evaporating plate portions 221*d*, 221*h* are formed as separate components as shown in, for example, FIGS. 51 and 52.

Figure 53:
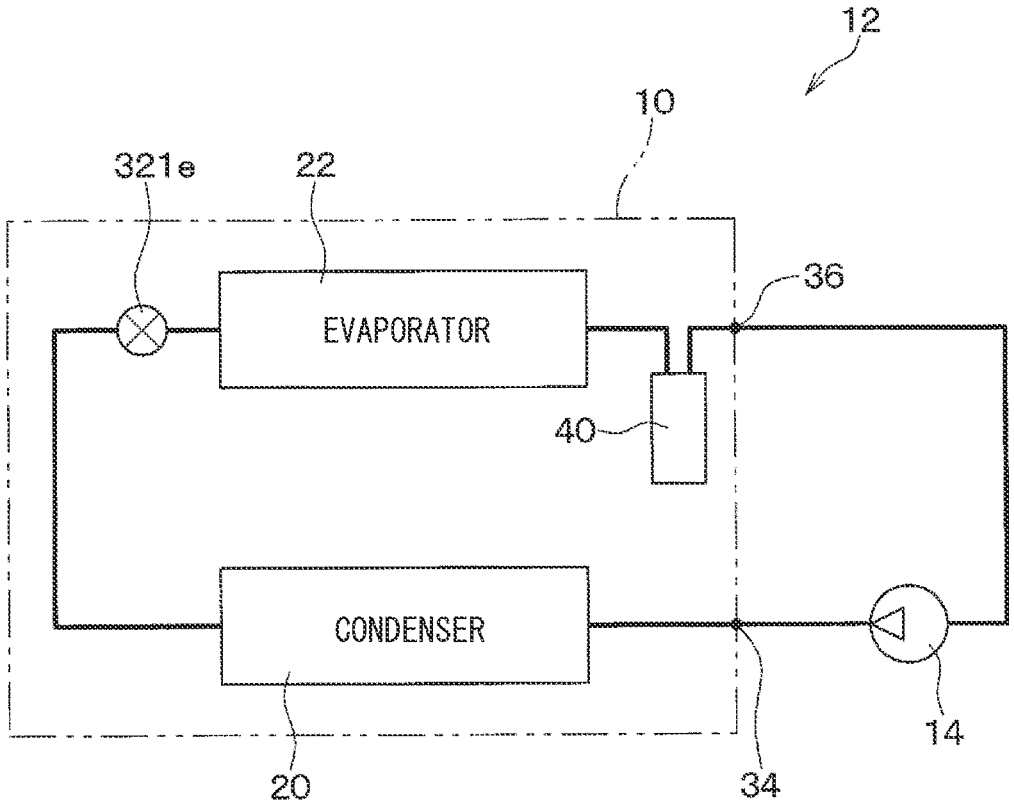
FIG. 53 is a refrigerant circuit diagram corresponding to FIG. 14 and showing a refrigeration cycle circuit in an eighth modification, which is a modification of the second embodiment.

(13) In the second embodiment described above, as shown in FIG. 14, the gas-liquid separator 40, which serves as the accumulator, is provided separately from the heat exchanger 10. However, this is only one example. For example, as shown in FIG. 53, the gas-liquid separator 40 may be formed as a portion of the heat exchanger 10, and the condensing unit 20, the evaporating unit 22 and the flow restricting portion 321*e* may be formed integrally.

(14) In the first embodiment described above, for example, as shown in FIGS. 2 and 8, the flow restricting portion 321*e*, which is formed at the other-side side plate portion 32, is the orifice. However, this is only one example. The flow restricting portion 321*e* may be a capillary or a combination of the capillary and the orifice connected with each other or a block in which the flow restricting hole 321*d* is formed as shown in FIG. 54.

Figure 54:
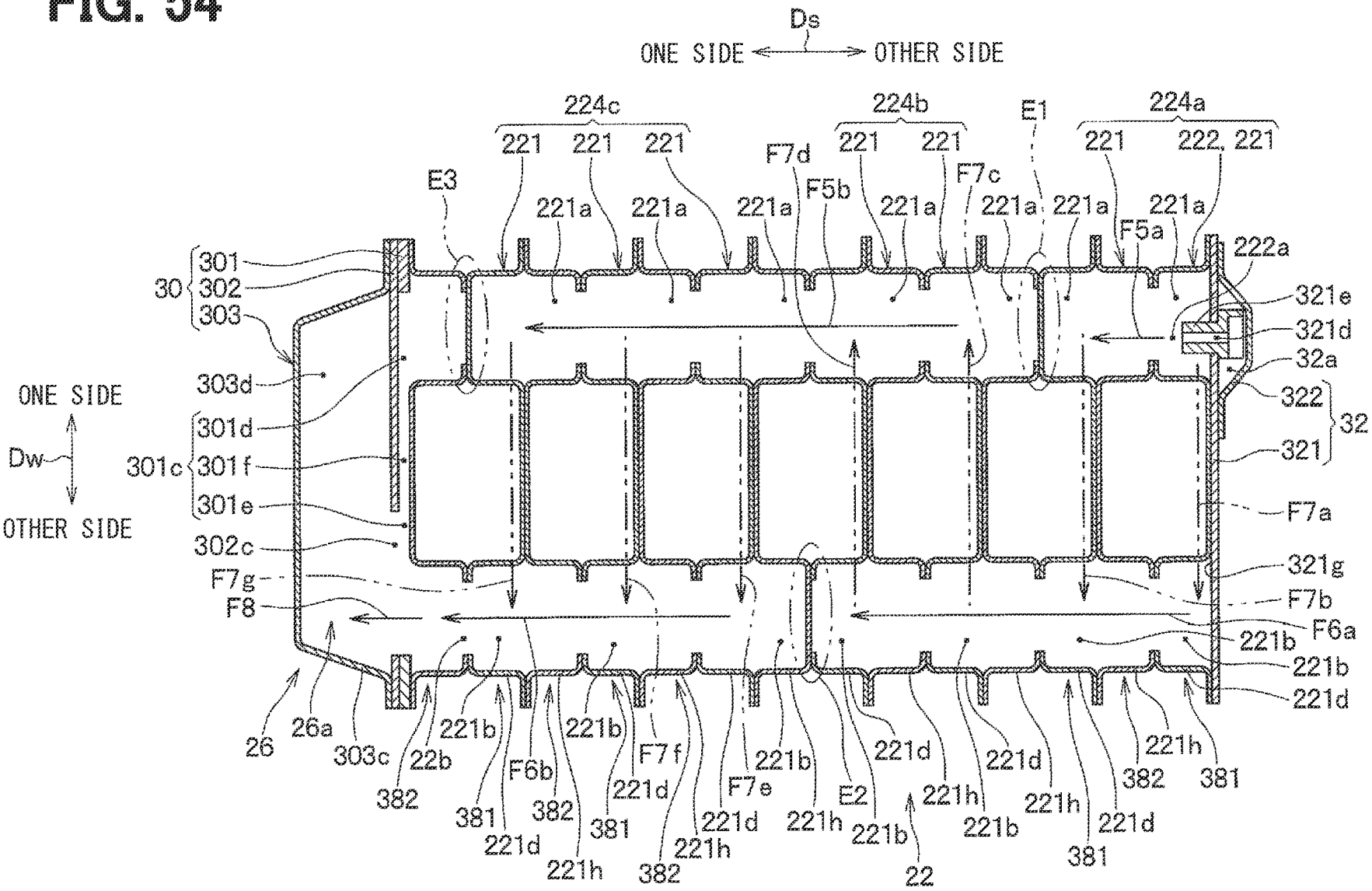
FIG. 54 is a cross-sectional view corresponding to FIG. 8 taken along line VIII-VIII in FIG. 2 in a ninth modification, which is a modification of the first embodiment.

In an example shown in FIG. 54, the flow restricting portion 321*e* is formed as a member shaped in a block form, and the flow restricting portion 321*e* is inserted into a hole formed in the other-side primary plate 321 and is fixed to the other-side primary plate 321.

(15) In the seventh embodiment, as shown in FIG. 35, the primary hole peripheral plate portion 381*h* of the primary plate member 381 is shaped such that the primary hole peripheral plate portion 381*h* is bent from the peripheral portion 381*j* of the primary plate member's primary intermediate hole 381*d* and is raised toward the one side in the stacking direction Ds. However, this is only one example. Alternatively, the primary hole peripheral plate portion 381*h* of the primary plate member 381 may be shaped such that the primary hole peripheral plate portion 381*h* is bent from the peripheral portion 381*j* of the primary plate member's primary intermediate hole 381*d* and is raised toward the other side on the stacking direction Ds. In this case, in order to avoid an interference with the secondary plate member 382, the primary hole peripheral plate portion 381*h* is bent and is raised toward the other side in the stacking direction Ds at, for example, a location where the primary hole peripheral plate portion 381*h* is inserted into the secondary plate member's primary intermediate hole 382*d*. This is also true for the secondary hole peripheral plate portion 381*i* of the primary plate member 381 and the primary and secondary hole peripheral plate portions 382*h*, 382*i* of the secondary plate member 382.

(16) In the ninth embodiment described above, as shown in FIG. 39, the primary hole peripheral plate portion 382*h* of the secondary plate member 382 is located on the other side of the primary hole peripheral plate portion 381*h* in the constituent arranging direction Dh such that the primary hole peripheral plate portion 382*h* overlaps with the primary hole peripheral plate portion 381*h* of the primary plate member 381. Specifically, the primary hole peripheral plate portion 382*h* of the secondary plate member 382, which is included in the one joined plate member assembly 39, is located on the one side of the primary hole peripheral plate portion 381*h* of the primary plate member 381, which is included in the other joined plate member assembly 39, in the constituent arranging direction Dh such that the primary hole peripheral plate portion 382*h* partially overlaps with the primary hole peripheral plate portion 381*h* of the primary plate member 381.

This is also true with respect the way of overlapping the secondary hole peripheral plate portion 382*i* of the secondary plate member 382 and the secondary hole peripheral plate portion 381*i* of the primary plate member 381 with each other. That is, contrary to FIG. 39, the secondary hole peripheral plate portion 382*i* of the secondary plate member 382, which is included in the one joined plate member assembly 39, is located on the other side of the secondary hole peripheral plate portion 381*i* of the primary plate member 381, which is included in the other joined plate member assembly 39, in the constituent arranging direction Dh such that the secondary hole peripheral plate portion 382*i* partially overlaps with the secondary hole peripheral plate portion 381*i* of the primary plate member 381.

(17) In the tenth embodiment described above, as shown in (b) of FIG. 40 and (b) of FIG. 41, the number of the intermediate through hole 39*a* formed in the joined plate member assembly 39 is one. However, this is only one example. For example, as shown in FIGS. 29 and 30, the intermediate through hole 39*a* may be divided into a plurality of intermediate through holes formed in the joined plate member assembly 39.

(18) In the eleventh embodiment described above, as shown in FIG. 45, the one-side secondary outer peripheral plate portion 382*m*, which is included in the one joined plate member assembly 39, is located on the one side of the one-side primary outer peripheral plate portion 381*m*, which is included in the other joined plate member assembly 39, in the heat exchanger width direction Dw such that the one-side secondary outer peripheral plate portion 382*m* overlaps with the one-side primary outer peripheral plate portion 381*m*. For example, this way of overlapping may be reversed. Specifically, the one-side secondary outer peripheral plate portion 382*m* included in the one joined plate member assembly 39 may be located on the other side of the one-side primary outer peripheral plate portion 381*m* included in the other joined plate member assembly 39 in the heat exchanger width direction Dw and overlaps with the one-side primary outer peripheral plate portion 381*m*.

Furthermore, this is also true with respect to the way of overlapping between the other-side secondary outer peripheral plate portion 382*n* of the secondary plate member 382 and the other-side primary outer peripheral plate portion 381*n* of the primary plate member 381. Specifically, contrary to FIG. 45, the other-side secondary outer peripheral plate portion 382*n* of the secondary plate member 382, which is included in the one joined plate member assembly 39, may be located on the one side of the other-side primary outer peripheral plate portion 381*n* of the primary plate member 381, which is included in the other joined plate member assembly 39, in the heat exchanger width direction Dw such that the other-side secondary outer peripheral plate portion 382*n* overlaps with the other-side primary outer peripheral plate portion 381*n* of the primary plate member 381.

(19) In the seventh embodiment, as shown in FIG. 33, the primary hole peripheral plate portion 381*h* of the primary plate member 381 is formed at the portion of the peripheral portion 381*j* of the primary plate member's primary intermediate hole 381*d*. However, this is only one example. For example, the primary hole peripheral plate portion 381*h* may be formed along the entire peripheral portion 381*j* of the primary plate member's primary intermediate hole 381*d*. This is also true for the hole peripheral plate portions 381*i*, 382*h*, 382*i* which are other than the primary hole peripheral plate portion 381*h* of the primary plate member 381.

(20) The present disclosure should not be limited to the above-described embodiments and can be modified into various other forms. In each of the above embodiments, it is needless to say that the elements constituting the embodiment are not necessarily essential, unless otherwise clearly indicated as essential or in principle considered to be clearly essential. The above embodiments are not unrelated to each other, and can be combined as appropriate, unless the combination is clearly impossible.

In each of the above embodiments, when a numerical value such as the number, numerical value, amount, range or the like of the constituent elements of the embodiment is mentioned, the present disclosure should not be limited to such a numerical value unless it is clearly stated that it is essential and/or it is required in principle. In each of the above embodiments, when referring to the material, the shape, the positional relationship or the like of the components, the present disclosure should not be limited to such a material, shape, positional relationship or the like unless it is clearly stated that it is essential and/or it is required in principle.

CONCLUSION

According to a first aspect indicated in a portion of a whole of each of the above embodiments, a heat releasing unit includes a plurality of heat releasing constituents which are stacked on one side of a side plate portion in a stacking direction and are joined together, and the heat releasing unit is configured to release heat from the refrigerant flowing in a plurality of heat releasing flow passages formed in the plurality of heat releasing constituents, respectively. An evaporating unit includes a plurality of evaporating constituents which are stacked on the one side of the side plate portion in the stacking direction and are joined together, and the evaporating unit is configured to evaporate the refrigerant by let the refrigerant flowing in a plurality of evaporating flow passages formed in the plurality of evaporating constituents absorb heat. The evaporating unit and the heat releasing unit are arranged one after another in a direction along the side plate portion and are both fixed to the side plate portion. A heat releasing unit outlet is formed at an outlet-side heat releasing constituent that is one of the plurality of heat releasing constituents placed at an end of the plurality of heat releasing constituents, and an evaporating unit inlet is formed at an inlet-side evaporating constituent that is one of the plurality of evaporating constituents placed at an end of the plurality of evaporating constituents. All of the plurality of heat releasing flow passages, which are respectively formed in the plurality of heat releasing constituents, are connected to the plurality of evaporating flow passages through the heat releasing unit outlet and the evaporating unit inlet.

Furthermore, according to a second aspect, the side plate portion includes a pressure reducing portion that is located between the heat releasing unit outlet and the evaporating unit inlet along a flow of the refrigerant and is configured to reduce a pressure of the refrigerant. Therefore, it is possible to limit an increase in the size of the heat exchanger including the pressure reducing portion. Furthermore, in comparison to, for example, the previously proposed heat exchanger described above, in which a large number of flow passage units are stacked, the pressure reducing portion can be easily constructed.

Furthermore, according to a third aspect, the stacking direction is a direction that intersects a gravity direction. The heat releasing unit is placed on a lower side of the evaporating unit such that the heat releasing unit overlaps with the evaporating unit. Therefore, the heat releasing performance of the heat releasing unit can be improved by a watering effect that applies condensed water generated at the evaporating unit to the heat releasing unit by the action of gravity. Furthermore, since an evaporation process of evaporating the condensed water generated at the evaporating unit by the heat of the heat releasing unit can be performed, it is possible to eliminate or reduce the drain water which is the discharged condensed water.

Furthermore, according to a fourth aspect, at least one of the plurality of heat releasing constituents includes a pair of heat releasing plate portions each of which is in a form of a plate, and the pair of heat releasing plate portions are stacked in the stacking direction and are joined together such that a corresponding one of the plurality of heat releasing flow passages is formed between the pair of heat releasing plate portions. Therefore, the structure of the heat releasing constituent can be simplified, and depending on the shape of the internal space of the heat releasing constituent, such as the shape of the heat releasing flow passage, there is a merit that it is easy to make each of the pair of heat releasing plate portions as the common component.

Furthermore, according to a fifth aspect, at least one of the plurality of evaporating constituents includes a pair of evaporating plate portions each of which is in a form of a plate, and the pair of evaporating plate portions are stacked in the stacking direction and are joined together such that a corresponding one of the plurality of evaporating flow passages is formed between the pair of evaporating plate portions. Therefore, the structure of the evaporating constituent can be simplified, and depending on the shape of the internal space of the evaporating constituent, such as the shape of the evaporating flow passage, there is a merit that it is easy to make each of the pair of evaporating plate portions as the common component.

Furthermore, according to a sixth aspect, at least one of the plurality of heat releasing constituents includes a pair of heat releasing plate portions each of which is in a form of a plate, and the pair of heat releasing plate portions are stacked in the stacking direction and are joined together such that a corresponding one of the plurality of heat releasing flow passages is formed between the pair of heat releasing plate portions.

Also, at least one of the plurality of evaporating constituents includes a pair of evaporating plate portions each of which is in a form of a plate, and the pair of evaporating plate portions are stacked in the stacking direction and are joined together such that a corresponding one of the plurality of evaporating flow passages is formed between the pair of evaporating plate portions. Additionally, one of the pair of heat releasing plate portions and one of the pair of evaporating plate portions are integrated together to form a plate member. Therefore, since the heat releasing unit and the evaporating unit support each other not only by the side plate portion but also by the plate member, the heat exchanger can be made more robust in comparison to the structure where the heat releasing unit and the evaporating unit are coupled together only by the side plate portion.

Furthermore, according to a seventh aspect, the plate member is a primary plate member. Another one of the pair of heat releasing plate portions and another one of the pair of evaporating plate portions are integrated together to form a secondary plate member. The primary plate member and the secondary plate member are joined together to form a joined plate member assembly that includes a corresponding heat releasing constituent among the plurality of heat releasing constituents and a corresponding evaporating constituent among the plurality of evaporating constituents. A primary intermediate through hole and a secondary intermediate through hole extend through the joined plate member assembly at a location that is between the corresponding heat releasing constituent and the corresponding evaporating constituent of the joined plate member assembly. The primary intermediate through hole and the secondary intermediate through hole extend in an assembly width direction that intersects an arranging direction in which the heat releasing constituent and the evaporating constituent are arranged one after another, and the primary intermediate through hole is located on one side of the secondary intermediate through hole in the arranging direction such that the primary intermediate through hole partially overlaps with the secondary intermediate through hole.

Therefore, in comparison to a case where the joined plate member assembly does not include the primary and secondary intermediate through holes, it is possible to increase the heat transfer path, along which the heat is conducted between the refrigerant in the heat releasing constituent and the refrigerant in the evaporating constituent through the joined plate member assembly. Thereby, it is possible to reduce the heat transfer loss at the time of exchanging the heat at the heat releasing unit between the refrigerant in the heat releasing constituents and the heat absorbing medium which absorbs the heat from the refrigerant, and also it is possible to reduce the heat transfer loss at the time of exchanging the heat at the evaporating unit between the refrigerant in the evaporating constituents and the heat releasing medium which releases the heat to the refrigerant.

Furthermore, according to an eighth aspect, an intermediate through hole extends through the joined plate member assembly at a location that is between the corresponding heat releasing constituent and the corresponding evaporating constituent of the joined plate member assembly. The primary plate member includes a primary plate member's intermediate hole that is a portion of the intermediate through hole which belongs to the primary plate member. The primary plate member includes a hole peripheral plate portion that is bent from a peripheral portion around the primary plate member's intermediate hole and is raised in the stacking direction. The hole peripheral plate portion extends in an assembly width direction that intersects an arranging direction in which the corresponding heat releasing constituent and the corresponding evaporating constituent are arranged one after another. Therefore, it is possible to increase the strength of the primary plate member alone and the strength of the joined plate member assembly by the hole peripheral plate portions. Furthermore, in response to formation of the intermediate through hole, which reduces the heat transfer loss, the hole peripheral plate portions for increasing the strength of intermediate through hole can also be formed.

Furthermore, according to a ninth aspect, the hole peripheral plate portion is one of a plurality of hole peripheral plate portions that include a primary hole peripheral plate portion and a secondary hole peripheral plate portion which are respectively formed at two different locations of the primary plate member. The primary hole peripheral plate portion is located on one side of the secondary hole peripheral plate portion in the arranging direction such that the primary hole peripheral plate portion partially overlaps with the secondary hole peripheral plate portion. Therefore, it is possible to increase the strength of the primary plate member alone and the strength of the joined plate member assembly by the two hole peripheral plate portions through a wide range in the assembly width direction.

Furthermore, according to a tenth aspect, the primary plate member includes: a primary plate member main body that has the heat releasing plate portion and the evaporating plate portion which form the primary plate member; and a primary outer peripheral plate portion that is raised from an outer peripheral portion of the primary plate member main body. The secondary plate member includes: a secondary plate member main body that has the heat releasing plate portion and the evaporating plate portion which form the secondary plate member; and a secondary outer peripheral plate portion that is raised from an outer peripheral portion of the secondary plate member main body. The intermediate through hole extends from the primary plate member main body to the primary outer peripheral plate portion at the primary plate member and extends from the secondary plate member main body to the secondary outer peripheral plate portion at the secondary plate member.

Therefore, the heat transfer path, along which the heat is conducted between the refrigerant in the heat releasing constituent and the refrigerant in the evaporating constituent through the joined plate member assembly, i.e., the heat transfer path between the heat releasing constituent and the evaporating constituent passes through the primary outer peripheral plate portion or the secondary outer peripheral plate portion. Therefore, in comparison to a case where the primary and secondary outer peripheral plate portions are not provided, the heat transfer path can be increased. Therefore, it is possible to reduce the heat transfer loss at the time of exchanging the heat at each of the heat releasing unit and the evaporating unit. Furthermore, each of the primary outer peripheral plate portion and the secondary outer peripheral plate portion is shaped in the raised form described above, so that the width of the joined plate member assembly is not substantially increased, and there is no substantial influence on the size of the heat exchanger 10.

Furthermore, according to an eleventh aspect, the primary outer peripheral plate portion is bent and raised from the outer peripheral portion of the primary plate member main body. Therefore, the higher strength can be obtained as compared with, for example, a case where the primary outer peripheral plate portion is joined to the primary plate member main body by brazing.

Furthermore, according to a twelfth aspect, the primary outer peripheral plate portion is one of a plurality of primary outer peripheral plate portions of the primary plate member that include: a one-side primary outer peripheral plate portion that is located at one side of the primary plate member main body in the assembly width direction; and an other-side primary outer peripheral plate portion that is located at another side of the primary plate member main body in the assembly width direction. The secondary outer peripheral plate portion is one of a plurality of secondary outer peripheral plate portions of the secondary plate member that include: a one-side secondary outer peripheral plate portion that is located at one side of the secondary plate member main body in the assembly width direction; and an other-side secondary outer peripheral plate portion that is located at another side of the secondary plate member main body in the assembly width direction. The intermediate through hole extends from the primary plate member main body to each of the one-side primary outer peripheral plate portion and the other-side primary outer peripheral plate portion at the primary plate member and extends from the secondary plate member main body to each of the one-side secondary outer peripheral plate portion and the other-side secondary outer peripheral plate portion at the secondary plate member. Furthermore, the intermediate through hole separates the corresponding heat releasing constituent from the corresponding evaporating constituent at the primary plate member main body and the secondary plate member main body. At the joined plate member assembly, the corresponding heat releasing constituent and the corresponding evaporating constituent are connected with each other through each of the one-side primary outer peripheral plate portion, the other-side primary outer peripheral plate portion, the one-side secondary outer peripheral plate portion and the other-side secondary outer peripheral plate portion. Therefore, the heat transfer between the corresponding condensing constituent and the corresponding constituent at the primary plate member main body and the secondary plate member main body can be largely suppressed while the corresponding heat releasing constituent and the corresponding evaporating constituent are formed as the integrated body.

Furthermore, according to a thirteenth aspect, the outlet-side heat releasing constituent is the one of the plurality of heat releasing constituents located at the end of the plurality of heat releasing constituents at one side or another side the plurality of heat releasing constituents in the stacking direction. Also, the inlet-side evaporating constituent is the one of the plurality of evaporating constituents located at the end of the plurality of evaporating constituents at one side or another side of the plurality of evaporating constituents in the stacking direction. Therefore, as compared with the case where the outlet-side heat releasing constituent and the inlet-side evaporating constituent are not arranged in this way, it is easy to provide the refrigerant flow path from the heat releasing unit outlet to the evaporating unit inlet. Thus, the refrigerant flow path can be easily simplified. For example, it is possible to provide the refrigerant flow path from the heat releasing unit outlet to the evaporating unit inlet by using the side plate portions.

What is claimed is:

1. A heat exchanger configured to conduct refrigerant through the heat exchanger, comprising:

a side plate portion, wherein a thickness direction of the side plate portion serves as a stacking direction that is predetermined;

a heat releasing unit that includes a plurality of heat releasing constituents which are joined together, wherein:

a plurality of heat releasing flow passages are formed in the plurality of heat releasing constituents, respectively; and the heat releasing unit is configured to release heat from the refrigerant flowing in the plurality of heat releasing flow passages by exchanging the heat between the refrigerant flowing in the plurality of heat releasing flow passages and air; and an evaporating unit that includes a plurality of evaporating constituents which are joined together, wherein:

a plurality of evaporating flow passages are formed in the plurality of evaporating constituents, respectively;

the evaporating unit and the heat releasing unit are arranged one after another in a direction along the side plate portion;

the evaporating unit is configured to evaporate the refrigerant by let the refrigerant flowing in the plurality of evaporating flow passages absorb heat by exchanging the heat between the refrigerant flowing in the plurality of evaporating flow passages and the air;

the plurality of heat releasing constituents are stacked in the stacking direction;

the plurality of evaporating constituents are stacked in the stacking direction;

the heat releasing unit and the evaporating unit are both fixed to the side plate portion;

a heat releasing unit outlet is formed at an outlet-side heat releasing constituent that is one of the plurality of heat releasing constituents placed at an end of the plurality of heat releasing constituents;

an evaporating unit inlet is formed at an inlet-side evaporating constituent that is one of the plurality of evaporating constituents placed at an end of the plurality of evaporating constituents;

all of the plurality of heat releasing flow passages, which are respectively formed in the plurality of heat releasing constituents, are connected to the plurality of evaporating flow passages through the heat releasing unit outlet and the evaporating unit inlet;

the stacking direction is a direction that intersects a gravity direction; and the heat releasing unit is located on a lower side of the evaporating unit.

2. The heat exchanger according to claim 1, wherein the side plate portion includes a pressure reducing portion that is located between the heat releasing unit outlet and the evaporating unit inlet along a flow of the refrigerant and is configured to reduce a pressure of the refrigerant.

3. The heat exchanger according to claim 1, wherein at least one of the plurality of heat releasing constituents includes a pair of heat releasing plate portions each of which is in a form of a plate, and the pair of heat releasing plate portions are stacked in the stacking direction and are joined together such that a corresponding one of the plurality of heat releasing flow passages is formed between the pair of heat releasing plate portions.

4. The heat exchanger according to claim 1, wherein at least one of the plurality of evaporating constituents includes a pair of evaporating plate portions each of which is in a form of a plate, and the pair of evaporating plate portions are stacked in the stacking direction and are joined together such that a corresponding one of the plurality of evaporating flow passages is formed between the pair of evaporating plate portions.

5. The heat exchanger according to claim 1, wherein:

at least one of the plurality of heat releasing constituents includes a pair of heat releasing plate portions each of which is in a form of a plate, and the pair of heat releasing plate portions are stacked in the stacking direction and are joined together such that a corresponding one of the plurality of heat releasing flow passages is formed between the pair of heat releasing plate portions;

at least one of the plurality of evaporating constituents includes a pair of evaporating plate portions each of which is in a form of a plate, and the pair of evaporating plate portions are stacked in the stacking direction and are joined together such that a corresponding one of the plurality of evaporating flow passages is formed between the pair of evaporating plate portions; and one of the pair of heat releasing plate portions and one of the pair of evaporating plate portions are integrated together to form a plate member.

6. The heat exchanger according to claim 5, wherein:

the plate member is a primary plate member;

another one of the pair of heat releasing plate portions and another one of the pair of evaporating plate portions are integrated together to form a secondary plate member;

the primary plate member and the secondary plate member are joined together to form a joined plate member assembly that includes a corresponding heat releasing constituent among the plurality of heat releasing constituents and a corresponding evaporating constituent among the plurality of evaporating constituents;

a primary intermediate through hole and a secondary intermediate through hole extend through the joined plate member assembly at a location that is between the corresponding heat releasing constituent and the corresponding evaporating constituent of the joined plate member assembly;

the primary intermediate through hole and the secondary intermediate through hole respectively extend in an assembly width direction that intersects an arranging direction in which the corresponding heat releasing constituent and the corresponding evaporating constituent are arranged one after another; and a projected shape of the primary intermediate through hole, which is projected in the arranging direction, and a projected shape of the secondary intermediate through hole, which is projected in the arranging direction, overlap with each other.

7. The heat exchanger according to claim 5, wherein:

the plate member is a primary plate member;

another one of the pair of heat releasing plate portions and another one of the pair of evaporating plate portions are integrated together to form a secondary plate member;

the primary plate member and the secondary plate member are joined together to form a joined plate member assembly that includes a corresponding heat releasing constituent among the plurality of heat releasing constituents and a corresponding evaporating constituent among the plurality of evaporating constituents;

an intermediate through hole extends through the joined plate member assembly at a location that is between the corresponding heat releasing constituent and the corresponding evaporating constituent of the joined plate member assembly;

the primary plate member includes a primary plate member's intermediate hole that is a portion of the intermediate through hole which belongs to the primary plate member;

the primary plate member includes a hole peripheral plate portion that is bent from a peripheral portion around the primary plate member's intermediate hole and is raised in the stacking direction; and the hole peripheral plate portion extends in an assembly width direction that intersects an arranging direction in which the corresponding heat releasing constituent and the corresponding evaporating constituent are arranged one after another.

8. The heat exchanger according to claim 7, wherein:

the hole peripheral plate portion is one of a plurality of hole peripheral plate portions that include a primary hole peripheral plate portion and a secondary hole peripheral plate portion which are respectively formed at two different locations of the primary plate member; and a projected shape of the primary hole peripheral plate portion, which is projected in the arranging direction, and a projected shape of the secondary hole peripheral plate portion, which is projected in the arranging direction, overlap with each other.

9. The heat exchanger according to claim 5, wherein:

the plate member is a primary plate member;

another one of the pair of heat releasing plate portions and another one of the pair of evaporating plate portions are integrated together to form a secondary plate member;

the primary plate member and the secondary plate member are joined together to form a joined plate member assembly that includes a corresponding heat releasing constituent among the plurality of heat releasing constituents and a corresponding evaporating constituent among the plurality of evaporating constituents;

an intermediate through hole extends through the joined plate member assembly at a location that is between the corresponding heat releasing constituent and the corresponding evaporating constituent of the joined plate member assembly; and the primary plate member includes:

a primary plate member main body that has the heat releasing plate portion and the evaporating plate portion of the primary plate member; and a primary outer peripheral plate portion that is raised from an outer peripheral portion of the primary plate member main body;

the secondary plate member includes:

a secondary plate member main body that has the heat releasing plate portion and the evaporating plate portion of the secondary plate member; and a secondary outer peripheral plate portion that is raised from an outer peripheral portion of the secondary plate member main body; and the intermediate through hole extends from the primary plate member main body to the primary outer peripheral plate portion at the primary plate member and extends from the secondary plate member main body to the secondary outer peripheral plate portion at the secondary plate member.

10. The heat exchanger according to claim 9, wherein the primary outer peripheral plate portion is bent and raised from the outer peripheral portion of the primary plate member main body.

11. The heat exchanger according to claim 9, wherein:

the primary outer peripheral plate portion is one of a plurality of primary outer peripheral plate portions of the primary plate member that include:

a one-side primary outer peripheral plate portion that is located at one side of the primary plate member main body in an assembly width direction that intersects an arranging direction in which the corresponding heat releasing constituent and the corresponding evaporating constituent are arranged one after another; and an other-side primary outer peripheral plate portion that is located at another side of the primary plate member main body in the assembly width direction;

the secondary outer peripheral plate portion is one of a plurality of secondary outer peripheral plate portions of the secondary plate member that include:

a one-side secondary outer peripheral plate portion that is located at one side of the secondary plate member main body in the assembly width direction; and an other-side secondary outer peripheral plate portion that is located at another side of the secondary plate member main body in the assembly width direction;

the intermediate through hole extends from the primary plate member main body to each of the one-side primary outer peripheral plate portion and the other-side primary outer peripheral plate portion at the primary plate member and extends from the secondary plate member main body to each of the one-side secondary outer peripheral plate portion and the other-side secondary outer peripheral plate portion at the secondary plate member;

the intermediate through hole separates the corresponding heat releasing constituent from the corresponding evaporating constituent at the primary plate member main body and the secondary plate member main body; and at the joined plate member assembly, the corresponding heat releasing constituent and the corresponding evaporating constituent are connected with each other through each of the one-side primary outer peripheral plate portion, the other-side primary outer peripheral plate portion, the one-side secondary outer peripheral plate portion and the other-side secondary outer peripheral plate portion.

12. The heat exchanger according to claim 1, wherein:

the outlet-side heat releasing constituent is the one of the plurality of heat releasing constituents located at the end of the plurality of heat releasing constituents at one side or another side of the plurality of heat releasing constituents in the stacking direction; and the inlet-side evaporating constituent is the one of the plurality of evaporating constituents located at the end of the plurality of evaporating constituents at one side or another side of the plurality of evaporating constituents in the stacking direction.

* * * * *